US007376375B2

(12) United States Patent
Kobayashi et al.

(10) Patent No.: US 7,376,375 B2
(45) Date of Patent: May 20, 2008

(54) BELT-DRIVE CONTROL DEVICE, COLOR-SHIFT DETECTING METHOD, COLOR-SHIFT DETECTING DEVICE, AND IMAGE FORMING APPARATUS

(75) Inventors: Kazuhiko Kobayashi, Tokyo (JP); Hiromichi Matsuda, Kanagawa (JP); Toshiyuki Andoh, Kanagawa (JP); Nobuto Yokokawa, Kanagawa (JP); Ryoji Imai, Kanagawa (JP); Yuji Matsuda, Tokyo (JP); Hiroshi Okamura, Kanagawa (JP); Masato Yokoyama, Kanagawa (JP); Yohei Miura, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 290 days.

(21) Appl. No.: 11/334,630

(22) Filed: Jan. 19, 2006

(65) Prior Publication Data

US 2006/0165442 A1 Jul. 27, 2006

(30) Foreign Application Priority Data

Jan. 25, 2005 (JP) ..... 2005-017418
Jun. 29, 2005 (JP) ..... 2005-189777

(51) Int. Cl.
*G03G 15/00* (2006.01)

(52) U.S. Cl. ..... 399/301; 399/162; 399/312; 399/313

(58) Field of Classification Search ..... 399/162, 399/165, 167, 297, 301, 302, 303, 312, 313
See application file for complete search history.

(56) References Cited

U.S. PATENT DOCUMENTS 6,920,303 B2 7/2005 Yamanaka et al.
6,941,096 B2 9/2005 Matsuda et al.
6,952,557 B2 10/2005 Kobayashi
2003/0223784 A1 12/2003 Yamanaka et al.
2004/0126129 A1 7/2004 Kobayashi
2005/0031361 A1 2/2005 Kobayashi
2005/0036797 A1 2/2005 Miura
2005/0057209 A1 3/2005 Andoh et al.

(Continued)

FOREIGN PATENT DOCUMENTS

JP 2573855 10/1996

(Continued)

OTHER PUBLICATIONS

U.S. Appl. No. 11/867,426, filed Oct. 4, 2007, Kobayshi et al.

(Continued)

*Primary Examiner*—Hoan Tran
(74) *Attorney, Agent, or Firm*—Oblon, Spivak, McClelland, Maier & Neustadt, P.C.

(57) ABSTRACT

A mark detecting unit detects a mark that is a reference position of an endless belt. An angular-displacement-error detecting unit detects an angular displacement error of an encoder caused by thickness fluctuation of the endless belt. A first calculating unit calculates a phase and a maximum amplitude to the mark. A second calculating unit calculates correction data according to a distance from the mark on the endless belt. A belt-drive control device controls a belt driving unit by adding the correction data to a preset control target value to stabilize speed fluctuation of the endless belt due to the thickness fluctuation.

42 Claims, 55 Drawing Sheets

U.S. PATENT DOCUMENTS

| | | | | |
|---|---|---|---|---|
| 2005/0085945 | A1 | 4/2005 | Andoh et al. | |
| 2005/0099153 | A1 | 5/2005 | Komatsu et al. | |
| 2006/0088338 | A1* | 4/2006 | Matsuda et al. | 399/167 |
| 2006/0133873 | A1* | 6/2006 | Andoh et al. | 399/388 |
| 2006/0165442 | A1 | 7/2006 | Kobayashi et al. | |
| 2006/0184258 | A1* | 8/2006 | Matsuda et al. | 700/56 |

FOREIGN PATENT DOCUMENTS

| | | |
|---|---|---|
| JP | 11-65208 | 3/1999 |
| JP | 11-102098 | 4/1999 |
| JP | 11-231586 | 8/1999 |
| JP | 11-249380 | 9/1999 |
| JP | 2000-112205 | 4/2000 |
| JP | 2000-310897 | 11/2000 |
| JP | 2004-233383 | 8/2004 |
| JP | 3677506 | 5/2005 |
| JP | 2005-258379 | 9/2005 |

OTHER PUBLICATIONS

U.S. Appl. No. 11/739,391, filed Apr. 24, 2007, Yokokawa et al.
U.S. Appl. No. 11/742,379, filed Apr. 30, 2007, Ehara et al.
U.S. Appl. No. 11/608,008, filed Dec. 7, 2006, Katoh et al.
U.S. Appl. No. 11/558,645, filed Nov. 10, 2006, Takahashi et al.
U.S. Appl. No. 11/335,657, filed Jan. 20, 2006, Okamura et al.
U.S. Appl. No. 11/334,630, filed Jan. 19, 2006, Kobayashi et al.

* cited by examiner

| COEFFICIENT | VALUE |
|---|---|
| a11= | 8173 |
| a21= | −2225 |
| b01= | 133 |
| b11= | 266 |
| b21= | 133 |
| a12= | 10389 |
| a22= | −5050 |
| b02= | 11022 |
| b12= | 22045 |
| b22= | 11022 |

| | |
|---|---|
| ISF | 2240 |
| qformat | 13 |

SYNTHESIZED WAVE CONDITIONS

| METHOD= | 1 |
|---|---|
| ITEM | |
| A1 | OPC DRUM |
| A2 | DRUM MOTOR |
| A3 | IDLER GEAR |
| A4 | DRIVE ROLLER |
| A5 | INDEPENDENT MOTOR |
| A6 | LOWER RIGHT ROLLER |
| A7 | EXIT ROLLER |
| A8 | ENTRANCE ROLLER |

FIG.38A

| FREQUENCY | Hz | PHASE | deg | SINGLE-SIDE AMPLITUDE mm | | |
|---|---|---|---|---|---|---|
| f1= | 1.3240486 | θ1= | 270 | A1= | 0.050 | 0.060 |
| f2= | 11.462478 | θ2= | 0 | A2= | 0.008 | 0.008 |
| f3= | 2.8656195 | θ3= | 0 | A3= | 0.016 | 0.016 |
| f4= | 1.271997 | θ4= | 0 | A4= | 0.020 | 0.025 |
| f5= | 3.8195517 | θ5= | 0 | A5= | 0.010 | 0.018 |
| f6= | 2.550917 | θ6= | 330 | A6= | 0.060 | 0.050 |
| f7= | 2.474073 | θ7= | 0 | A7= | 0.015 | 0.015 |
| f8= | 1.957375 | θ8= | 360 | A8= | 0.020 | 0.02 |

FIG.38B

COEFFICIENTS OF $\alpha A1+\beta A2+\gamma A3$

| | α | β | γ |
|---|---|---|---|
| M | 1 | 1 | 0 |
| C | 1 | 1 | 0 |
| Y | 1.2 | 1 | 1 |
| K | 1 | 1 | 0 |

FIG.38C $\eta(A4+A5+A6+A7+A8)$

| η= | 1 |
|---|---|

FIG.38D

PATTERN INTERVAL CONDITIONS

| LINE INTERVAL | | mm |
|---|---|---|
| HORIZONTAL-HORIZONTAL | ma= | 3.514 |
| SAME COLOR HORIZONTAL-DIAGONAL | mb= | 17.314 |
| LINE GROUP INTERVAL | L= | 36.787 |

REPETITION OF (Y HORIZONTAL - K HORIZONTAL - C HORIZONTAL - M HORIZONTAL - Y DIAGONAL - K DIAGONAL - C DIAGONAL - M DIAGONAL)

2.5~5.5 0.5mmStep
17.5~35 0.5mmStep
35~70 1.0mmStep

LOWER RIGHT 0 DEGREE

LOWER RIGHT 30 DEGREES

LOWER RIGHT 60 DEGREES

LOWER RIGHT 90 DEGREES

LOWER RIGHT 120 DEGREES

LOWER RIGHT 150 DEGREES

LOWER RIGHT 180 DEGREES

LOWER RIGHT 210 DEGREES

LOWER RIGHT 240 DEGREES

LOWER RIGHT 270 DEGREES

LOWER RIGHT 300 DEGREES

LOWER RIGHT 330 DEGREES

LOWER RIGHT 0 DEGREE

LOWER RIGHT 30 DEGREES

LOWER RIGHT 60 DEGREES

LOWER RIGHT 90 DEGREES

LOWER RIGHT 120 DEGREES

LOWER RIGHT 150 DEGREES

LOWER RIGHT 180 DEGREES

LOWER RIGHT 210 DEGREES

LOWER RIGHT 240 DEGREES

LOWER RIGHT 270 DEGREES

LOWER RIGHT 300 DEGREES

LOWER RIGHT 330 DEGREES

LOWER RIGHT 0 DEGREE

LOWER RIGHT 30 DEGREES

LOWER RIGHT 60 DEGREES

LOWER RIGHT 90 DEGREES

LOWER RIGHT 120 DEGREES

LOWER RIGHT 150 DEGREES

LOWER RIGHT 180 DEGREES

LOWER RIGHT 210 DEGREES

LOWER RIGHT 240 DEGREES

LOWER RIGHT 270 DEGREES

LOWER RIGHT 300 DEGREES

LOWER RIGHT 330 DEGREES

FIG.77

| OPC PHASE | LOWER RIGHT ROLLER PHASE | ENTRANCE PHASE | Y-K HORIZONTAL | C-K HORIZONTAL | M-K HORIZONTAL | Y-K DIAGONAL | C-K DIAGONAL | M-K DIAGONAL |
|---|---|---|---|---|---|---|---|---|
| 0 | 0 | 0 | 0.307345 | 0.806498 | 0.180898 | 6.323288 | 1.571618 | 4.393288 |
| | | 30 | 0.057814 | 1.178184 | 0.49645 | 5.384347 | 0.749605 | 2.794307 |
| | | 60 | 0.171669 | 1.352248 | 0.75348 | 4.97609 | 0.110108 | 1.634402 |
| | | 90 | 0.618402 | 1.282051 | 0.521319 | 5.207908 | 0.175521 | 1.224369 |
| | | 120 | 1.278311 | 0.986402 | 0.137825 | 6.017687 | 0.030747 | 1.674076 |
| | | 150 | 1.974575 | 0.54452 | 1.047335 | 7.188446 | 0.505637 | 2.863025 |
| | | 180 | 2.52063 | 0.074807 | 1.963507 | 8.406482 | 1.289907 | 4.472637 |
| | | 210 | 2.770161 | 0.296879 | 2.640856 | 9.345423 | 2.11192 | 6.071619 |
| | | 240 | 2.656307 | 0.470943 | 2.897885 | 9.75368 | 2.751418 | 7.231524 |
| | | 270 | 2.209574 | 0.400746 | 2.665724 | 9.521861 | 3.037047 | 7.641557 |
| | | 300 | 1.549664 | 0.105098 | 2.00658 | 8.712083 | 2.892273 | 7.191849 |
| | | 330 | 0.8534 | 0.336785 | 1.097071 | 7.541323 | 2.355889 | 6.002901 |
| | | 360 | 0.307345 | 0.806498 | 0.180898 | 6.323288 | 1.571618 | 4.393288 |
| 0 | 30 | 0 | 0.280079 | 0.804798 | 0.213836 | 6.342165 | 1.640795 | 4.570918 |
| | | 30 | 0.030548 | 1.176484 | 0.463512 | 5.403224 | 0.818782 | 2.971937 |
| | | 60 | 0.144403 | 1.350548 | 0.720541 | 4.994967 | 0.179284 | 1.812032 |
| | | 90 | 0.591135 | 1.280352 | 0.48838 | 5.226786 | 0.106345 | 1.401999 |
| | | 120 | 1.251045 | 0.984703 | 0.170763 | 6.036564 | 0.038429 | 1.851706 |
| | | 150 | 1.947309 | 0.54282 | 1.080273 | 7.207324 | 0.574813 | 3.040655 |
| | | 180 | 2.493364 | 0.073107 | 1.996445 | 8.425359 | 1.359084 | 4.650267 |
| | | 210 | 2.742895 | 0.298578 | 2.673794 | 9.3643 | 2.181097 | 6.249249 |
| | | 240 | 2.629041 | 0.472643 | 2.930823 | 9.772557 | 2.820594 | 7.409154 |
| | | 270 | 2.182308 | 0.402446 | 2.698662 | 9.540739 | 3.106223 | 7.819186 |
| | | 300 | 1.522398 | 0.106797 | 2.039518 | 8.73096 | 2.96145 | 7.369479 |
| | | 330 | 0.826134 | 0.335085 | 1.130009 | 7.560201 | 2.425066 | 6.180531 |
| | | 360 | 0.280079 | 0.804798 | 0.213836 | 6.342165 | 1.640795 | 4.570918 |
| ⋮ | ⋮ | ⋮ | ⋮ | ⋮ | ⋮ | ⋮ | ⋮ | ⋮ |
| 270 | 330 | 0 | 0.367078 | 0.768457 | 0.227727 | 6.374012 | 1.571808 | 4.341562 |
| | | 30 | 0.117547 | 1.140142 | 0.449621 | 5.435071 | 0.749795 | 2.742581 |
| | | 60 | 0.231401 | 1.314207 | 0.70665 | 5.026814 | 0.110298 | 1.582676 |
| | | 90 | 0.678134 | 1.24401 | 0.474489 | 5.258632 | 0.175331 | 1.172643 |
| | | 120 | 1.338044 | 0.948361 | 0.184655 | 6.068411 | 0.030558 | 1.62235 |
| | | 150 | 2.034308 | 0.506479 | 1.094164 | 7.23917 | 0.505826 | 2.811299 |
| | | 180 | 2.580363 | 0.036765 | 2.010337 | 8.457206 | 1.290097 | 4.420911 |
| | | 210 | 2.829894 | 0.33492 | 2.687685 | 9.396147 | 2.11211 | 6.019892 |
| | | 240 | 2.716039 | 0.508984 | 2.944714 | 9.804404 | 2.751608 | 7.179797 |
| | | 270 | 2.269306 | 0.438788 | 2.712553 | 9.572585 | 3.037237 | 7.58983 |
| | | 300 | 1.609397 | 0.143139 | 2.05341 | 8.762807 | 2.892463 | 7.140123 |
| | | 330 | 0.913133 | 0.298743 | 1.1439 | 7.592047 | 2.356079 | 5.951174 |
| | | 360 | 0.367078 | 0.768457 | 0.227727 | 6.374012 | 1.571808 | 4.341562 |
| | | max | 6.351051 | 3.064264 | 9.685688 | 10.66487 | 4.877646 | 15.91398 |
| | | min | 0.035439 | 0.749954 | 0.020575 | 0.614067 | 1.685997 | 0.077159 |
| | | av | 2.949567 | 1.905115 | 4.480446 | 4.650463 | 3.227886 | 7.004521 |

BELT-DRIVE CONTROL DEVICE, COLOR-SHIFT DETECTING METHOD, COLOR-SHIFT DETECTING DEVICE, AND IMAGE FORMING APPARATUS

CROSS-REFERENCE TO RELATED APPLICATIONS

The present document incorporates by reference the entire contents of Japanese priority documents, 2005-017418 filed in Japan on Jan. 25, 2005 and 2005-189777 filed in Japan on Jun. 29, 2005.

BACKGROUND OF THE INVENTION

1. Field of the Invention

The present invention relates to a belt-drive control device, a color-shift detecting method, a color-shift detecting device, and an image forming apparatus.

2. Description of the Related Art

In an image forming apparatus, as described in Japanese Patent Application Laid-Open No. 2000-310897, when a transfer conveying belt is rotated by driving a drive roller at a fixed pulse rate, based on a position to be detected due to a belt mark on the transfer conveying belt, a speed profile that cancels a speed fluctuation Vh expected to occur due to a known thickness profile across the whole circumference of the transfer conveying belt is measured in advance, and at a pulse rate modulated with respect to the speed profile, a drive motor control signal is generated, and based on this, the motor is driven to drive the transfer conveying belt via the drive roller, whereby the final speed Vb of the transfer conveying belt is made free from fluctuation.

Color-shift detecting methods to detect positional deviations of images in a plurality of colors in a color image forming apparatus are disclosed in, for example, Japanese Patent No. 2573855, Japanese Patent Application Laid-Open No. H11-65208, Japanese Patent Application Laid-Open No. H11-102098, Japanese Patent Application Laid-Open No. H11-249380, and Japanese Patent Application Laid-Open No. 2000-112205. In these color-shift detecting methods, near the respective ends in the width direction of a transfer conveying belt that supports a transfer sheet and is conveyed along arrangement of a plurality of photoconductor drums and transfers toner images in the colors on the photoconductor drums onto the transfer sheet, toner marks in the colors are formed in a predetermined alignment pattern, and a pair of light sensors read the toner marks on the ends of the transfer conveying belt and based on the read signals, calculate the positions of the marks in the mark alignment (pattern). Then, deviation amounts in the vertical scanning direction (transfer conveying belt moving direction) and deviation amounts in the horizontal scanning direction (width direction of the transfer conveying belt) of the images in the colors from the reference position, a deviation amount of the effective line length of the horizontal scanning line, and skew of the horizontal scanning line are calculated.

Japanese Patent Application Laid-Open No. H11-231586 describes an image forming apparatus in which resist marks in black and yellow are formed on a transfer conveying belt and a parallel line pattern is formed in parallel to the resist marks, a photoelectric sensor detects straight line portions of the resist marks and temporarily detects a position deviation amount of an image in yellow from an image in black from the detected values, and when speed fluctuation is detected from the detection results of the resist marks by the photoelectric sensor, the temporary position deviation amount is corrected based on the speed fluctuation in a corresponding detecting section, and similar processing is also executed for position deviation amounts in magenta and cyan, and based on these corrected values, the writing positions of the images in the colors except for black are corrected to correct color shifts.

Japanese Patent Application Laid-Open No. 2004-123383 describes a belt driving method in which a rotation angular displacement or a rotation angular velocity of a driven roller, and from the detection results, an alternate current component of the rotation angular velocity including frequencies corresponding to periodical thickness fluctuation in the circumferential direction of the belt is detected, and based on an amplitude and a phase of this alternate current component, the rotation of the drive roller is controlled.

Japanese Patent Application No. 2004-161416 describes a color-shift detecting method to prevent harmful influences on color shift correction accuracies by eliminating fluctuation components caused by the belt thickness by arranging the plurality of mark set groups on the belt at 360 degrees/the number of mark sets.

Typical methods of color image forming include a direct transfer method in which toner images in different colors formed on a plurality of photoconductors are directly transferred onto a transfer sheet while superposing these, and an intermediate transfer method in which toner images in different colors formed on a plurality of photoconductors are transferred onto an intermediate transfer member such as an intermediate transfer conveying belt while superposing these and then collectively transferred onto a transfer sheet. These are called tandem-type since a plurality of photoconductors are arranged to face a transfer sheet or an intermediate transfer member, wherein, electrophotography processing such as electrostatic latent image forming and developing are applied to each of yellow (hereinafter, referred to as Y), magenta (referred to as M), cyan (referred to as C), and black (referred to as K) on each photoconductor to form toner images in the colors, and the toner images in the colors are transferred onto a transfer sheet while traveling in the direct transfer method or onto an intermediate transfer member while traveling in the intermediate transfer method.

Generally, in tandem-type color image forming apparatuses using these methods, in the case of the direct transfer method, an endless belt that travels while supporting a transfer sheet is used as a direct transfer conveying belt, and in the case of the intermediate transfer method, an endless belt that receives images from photoconductors and carries the images is used as an intermediate transfer conveying belt. An image forming unit including four photoconductors is arranged on one side in the traveling direction of the endless belt.

In the tandem-type color image forming apparatuses, accurate transferring of toner images in colors onto a transfer sheet as a transfer medium or an intermediate transfer conveying belt by a transfer unit is important to prevent color shifts. Therefore, in any transfer method, to prevent color shifts due to speed fluctuation of the direct transfer conveying belt or the intermediate transfer conveying belt, it is effective that an encoder is attached to one of a plurality of follower shafts that follow the direct transfer conveying belt or the intermediate transfer conveying belt of the transfer unit, and according to rotation speed fluctuation of this encoder, the rotation speed of a drive roller that drives the direct transfer conveying belt or intermediate transfer conveying belt is controlled by means of feedback.

However, it is difficult to completely eliminate the speed fluctuation of the direct transfer conveying belt or intermediate transfer conveying belt although it can be reduced by means of feedback control. Therefore, it is desirable for improvement in image quality that a color-shift detecting device is also mounted while feedback control of the direct transfer conveying belt or intermediate transfer conveying belt is performed to reduce the speed fluctuation of the direct transfer conveying belt or intermediate transfer conveying belt.

As most general method to realize feedback control, proportional control (PI control) is available. According to this, a position error e(n) is calculated from a difference between a target angular displacement Ref(n) of the encoder and a detection angular displacement P(n−1) of the encoder, and a low-pass filter is applied to the calculation results to eliminate high-frequency noise and control gain is applied, and the result is added with a constant standard drive pulse frequency to control a drive pulse frequency of a drive motor connected to the drive roller, whereby performing control so that the encoder is always driven with the target angular displacement.

As actual feedback control, by using an encoder pulse counter that counts rise edges of output pulses of the encoder and a control cycle counter that counts for each control cycle (for example, 1 millisecond), from a difference between the calculation results of a target angular displacement of movement during the control cycle (1 millisecond) and a detection angular displacement obtained by acquiring the count of the encoder pulse counter for each control cycle, a position error is acquired.

Detailed calculation when the roller diameter of the follower shaft to which the encoder is attached is set to ϕ15.615 is as follows $$e(n)=\theta 0*q-\theta 1*ne[\text{rad}]$$

where e(n) is position error (calculated by the current sampling), θ0 is moving angle per control cycle (=2π*V*E−3/15.565π [rad]), θ1 is moving angle per 1 pulse of encoder (=2π/p [rad]), q is count of control cycle timer, and ne is count of encoder pulse counter for each control cycle.

Assuming that an encoder with resolution of 300 pulses per rotation in a control cycle of 1 ms is used and an endless belt (direct transfer conveying belt or intermediate transfer conveying belt) is controlled by means of feedback so as to move at 162 mm/s, calculation is as follows $$\theta 0=2\pi*162*E-3/15.615\pi=0.0207487[\text{rad}]$$

$$\theta 1=2\pi/p=2\pi/300=0.0209439[\text{rad}]$$

A position error is acquired by performing the calculation for each control cycle and feedback control is performed.

However, this method causes changes in conveying speed of the transfer sheet or the intermediate transfer conveying belt due to a minute thickness of the endless belt, and causes lowering in image quality such as image deviation from an ideal position and positional displacement of an image among a plurality of recording sheets, resulting in deteriorated repetitive image position reproducibility among recording sheets.

As a reason, at an endless belt driving position, when it is assumed that the conveying speed of the endless belt is determined at the center in the thickness direction of the endless belt, the conveying speed V of the endless belt is as follows $$V=(R+B/2)\times\omega \quad (1)$$

where R is drive roller radius, B is belt thickness, and ω is drive roller angular velocity. However, if the belt thickness B fluctuates, the position of the thickness effective line of an endless belt 701 to be driven by a drive roller 702 changes as shown in FIG. 20. This means that the belt drive effective radius changes, and (R+B/2) of Equation (1) changes, so that the conveying speed of the endless belt 701 changes even when the angular velocity ω of the drive roller 702 is constant. Namely, even when the drive roller 702 is rotated at a constant angular velocity, if the endless belt 701 fluctuates in thickness, the conveying speed of the endless belt 701 changes.

FIG. 21 depicts a model of a belt drive conveying system. The endless belt 701 is laid across the drive roller 702 and driven rollers 703 and 704.

First, thickness fluctuation and conveying speed fluctuation in one round of the endless belt 701 when the drive shaft of the drive roller 702 is rotated at a constant angular velocity are schematically shown in FIG. 22. When a thick portion of the endless belt 701 is wound around the drive shaft, the belt drive effective radius shown in FIG. 20 is increased, and the belt conveying speed is increased. To the contrary, when a thin portion of the endless belt 701 is wound around the drive shaft, the belt conveying speed lowers.

FIG. 23 depicts belt thickness fluctuation on the follower shaft when the endless belt 701 is conveyed at a constant conveying speed and belt conveying speed fluctuation detected on the follower shaft of the driven roller 703, and FIG. 24 depicts an example of counts of the encoder pulse counter that counts main pulses of the encoder attached to the driven roller 703. Even when the endless belt 701 is ideally conveyed without speed fluctuation, if the thick portion of the endless belt 701 is wound around the follower shaft of the driven roller 703, the belt following effective radius is increased, and the rotation angular velocity of the follower shaft of the driven roller 703 is decreased. This is detected as conveying speed lowering of the endless belt 701. When the thin portion of the endless belt 701 is wound around the follower shaft of the driven roller 703, the rotation angular velocity of the follower shaft of the driven roller 703 is increased and is detected as an increase in belt conveying speed.

When the belt thickness fluctuation occurs and the belt conveying speed is detected by the encoder based on the rotation angular displacement of the follower shaft, erroneous detection components are generated. Therefore, even when the endless belt 701 is conveyed at a constant speed, due to thickness fluctuation of the endless belt 701, in the rotation angular displacement detection of the follower shaft, it is detected as if the endless belt 701 fluctuates in speed. Therefore, in feedback control to detect the belt conveying speed based on the follower shaft rotation angular displacement as conventionally, the speed fluctuation due to fluctuation in thickness of the belt cannot be controlled.

A method of solving the belt speed fluctuation due to belt thickness fluctuation is described in Japanese Patent Application Laid-Open No. 2000-310897. As a feature of the method, when a drive roller is driven at a constant pulse rate, based on a position to be detected by a belt mark on the belt, a speed profile that cancels speed fluctuation Vh expected to occur due to the known thickness profile across the whole circumference of the belt is measured in advance, a drive motor control signal is generated at a pulse rate modulated with respect to the speed profile, and based on this, the motor is driven to drive the belt via the drive roller, whereby the final belt speed Vb is made free from fluctuation.

However, in the above method, as speed profile data, data for each control cycle is needed, so that when the control cycle is short, a memory with a high capacity becomes necessary, and when the control cycle is set long, feedback control itself cannot show a sufficient effect. For example, when the belt circumferential length is 815 mm, the belt driving speed is 125 mm/s, and the control cycle is 1 ms, the control is performed 6520 times per one round of the belt as shown below.

$$815\ \text{mm}/(125\ \text{mm/s} \times 1\ \text{ms}) = 6520\ \text{times}$$

When a data size of a belt thickness per one point is expressed by 16 bits, a memory with a capacity equal to or more than 100 kilobits becomes necessary as shown below.

$$6520 \times 16\ \text{bits} = 104320\ \text{bits}$$

Therefore, when this control is performed in an actual apparatus, a belt thickness profile storage memory that stores speed profile data must be newly prepared as a nonvolatile memory, and even if the speed profile data is compressed and stored in the nonvolatile memory and is decompressed in a volatile memory when turning the power source on, a high-capacity memory is still necessary. Therefore, a separate memory is necessary in addition to the memory that has been used as a normal work area, and this results in a remarkable cost increase and is not realistic.

Furthermore, according to the above method, the belt thickness itself must be measured as belt thickness profile data, and as means for this, a laser displacement gauge is used to measure the belt thickness. The measurement data is inputted from an input unit such as an operation panel when shipping the product or by service man.

However, to measure the thickness fluctuation of several micrometers of the belt, a high-accuracy measuring unit is necessary, and data management and data amount of the measured results are large in size, and this may cause an input error.

In the color-shift detecting device, since speed fluctuation of the belt due to belt thickness fluctuation cannot be controlled by means of feedback control in that the belt conveying speed is detected based on the conventional follower shaft rotation angular displacement, the fluctuation harmfully influences the color shift correction accuracies and causes image deterioration. Namely, the belt speed when mark sets for color shift correction are drawn on the belt and the belt speed when the mark sets are detected are different from the belt speed when images are actually drawn on the belt, resulting in color shifts. As seen in the color-shift detecting method described in Japanese Patent Application No. 2004-161416, the plurality of mark sets are arranged at 360 degrees/the number of mark set groups so as to eliminate the belt thickness fluctuation components and prevent harmful influences on the color shift correction accuracies. However, in this case, the length of all groups of mark sets may become long, the color shift correction time may become slightly long, or the toner consumption may slightly increase.

Furthermore, if the execution timing of color shift detection and correction is only either one of an execution timing instructed through an operation panel or an automatic execution timing, image quality that a customer desires cannot be provided in a desired timing in some cases.

The belt thickness has a sine-wave-shaped profile in most cases, so that when high-resolution measurement can be made with an external jig, the external jig calculates a phase and a maximum amplitude based on belt marks of a follower shaft rotation angular displacement detection error from the measuring results of the belt thickness, and stores the calculation results in a nonvolatile memory, and by using the results as control parameters and inputting them from an operation panel mounted on an actual apparatus, feedback control of the belt drive motor can be realized. However, if calculation of the phase and maximum amplitude to be stored in the nonvolatile memory is performed by only either one of manual execution or automatic execution, in some cases, image quality that a customer desires cannot be provided in a desired timing. Particularly, when the phase and maximum amplitude of the angular displacement error change due to aging of the belt, color shift detection and correction makes worse the color shifts unless the calculation is performed.

SUMMARY OF THE INVENTION

It is an object of the present invention to at least solve the problems in the conventional technology.

A belt-drive control device according to one aspect of the present invention includes an endless belt; a belt driving unit that rotates the endless belt; at least one driven roller that is in contact with the endless belt; an encoder that is attached to the driven roller; a mark detecting unit that detects a mark that is a reference position of the endless belt; an angular-displacement-error detecting unit that detects an angular displacement error of the encoder caused by thickness fluctuation of the endless belt, based on an output signal from the mark detecting unit; a first calculating unit that calculates a phase and a maximum amplitude to the mark, based on the detected angular displacement error of the encoder; a nonvolatile memory that stores a result of calculation by the first calculating unit; a second calculating unit that calculates correction data according to a distance from the mark on the endless belt based on the result of calculation stored in the nonvolatile memory; and a volatile memory that stores the calculated correction data. The belt-drive control device controls the belt driving unit by adding the correction data stored in the volatile memory to a preset control target value to stabilize speed fluctuation of the endless belt due to the thickness fluctuation.

A color-shift detecting method according to another aspect of the present invention is for a color image forming apparatus that uses a belt drive system for controlling at least one of an image carrier and a transfer medium, rotates the image carrier by an image carrier drive system, rotates the transfer medium by a transfer drive system, forms images in a plurality of colors on the image carrier, and transfers the images onto the transfer medium in a superimposing manner to form a color image. The belt drive system includes an endless belt, a belt driving unit that rotates the endless belt, at least one driven roller that is in contact with the endless belt, an encoder that is attached to the driven roller, a mark detecting unit that detects a mark that is a reference position of the endless belt, an angular-displacement-error detecting unit that detects an angular displacement error of the encoder caused by thickness fluctuation of the endless belt, based on an output signal from the mark detecting unit, a first calculating unit that calculates a phase and a maximum amplitude to the mark, based on the detected angular displacement error of the encoder, a nonvolatile memory that stores a result of calculation by the first calculating unit, a second calculating unit that calculates correction data according to a distance from the mark on the endless belt based on the result of calculation stored in the nonvolatile memory, and a volatile memory that stores the calculated correction data. The belt drive system controls the belt driving unit by adding the correction data stored in the volatile memory to a preset control target value to stabilize speed fluctuation of the endless belt due to the thickness fluctuation. The color-shift detecting method includes forming a plurality of mark sets including an array of marks in respective colors arranged in a moving direction of the transfer medium on the transfer medium; detecting each of the marks of the mark sets to detect an amount of deviation of the images; and setting mark intervals between a reference color and other colors, mark intervals in a same color, and an interval of the mark sets in such a manner that, when calculating an amount of the color: shift with respect to a synthesized wave including two or more of driving unevenness frequencies generated from the image carrier drive system and the belt drive system, a calculation error due to the synthesized wave is within a range in which the deviation of the images is correctable.

A color-shift detecting method according to still another aspect of the present invention is for a color image forming apparatus that uses a belt drive system for controlling at least one of an image carrier and a transfer medium, rotates the image carrier by an image carrier drive system, rotates the transfer medium by a transfer drive system, forms images in a plurality of colors on the image carrier, and transfers the images onto the transfer medium in a superimposing manner to form a color image. The belt drive system includes an endless belt, a belt driving unit that rotates the endless belt, at least one driven roller that is in contact with the endless belt, an encoder that is attached to the driven roller, a mark detecting unit that detects a mark that is a reference position of the endless belt, an angular-displacement-error detecting unit that detects an angular displacement error of the encoder caused by thickness fluctuation of the endless belt, based on an output signal from the mark detecting unit, a first calculating unit that calculates a phase and a maximum amplitude to the mark, based on the detected angular displacement error of the encoder, a nonvolatile memory that stores a result of calculation by the first calculating unit, a second calculating unit that calculates correction data according to a distance from the mark on the endless belt based on the result of calculation stored in the nonvolatile memory, and a volatile memory that stores the calculated correction data. The belt drive system controls the belt driving unit by adding the correction data stored in the volatile memory to a preset control target value to stabilize speed fluctuation of the endless belt due to the thickness fluctuation. The color-shift detecting method includes forming a plurality of mark sets including an array of marks in respective colors arranged in a moving direction of the transfer medium on the transfer medium; detecting each of the marks of the mark sets to detect an amount of deviation of the images; and setting mark intervals between a reference color and other colors, mark intervals in a same color, and an interval of the mark sets in such a manner that, when calculating an amount of the color shift with respect to a synthesized wave including two or more of driving unevenness frequencies generated from the image carrier drive system and the belt drive system, a calculation error due to the synthesized wave is equal to or less than 20 μm.

A color-shift detecting device according to still another aspect of the present invention is for a color image forming apparatus that uses a belt drive system for controlling at least one of an image carrier and a transfer medium, rotates the image carrier by an image carrier drive system, rotates the transfer medium by a transfer drive system, forms images in a plurality of colors on the image carrier, and transfers the images onto the transfer medium in a superimposing manner to form a color image. The belt drive system includes an endless belt, a belt driving unit that rotates the endless belt, at least one driven roller that is in contact with the endless belt, an encoder that is attached to the driven roller, a mark detecting unit that detects a mark that is a reference position of the endless belt, an angular-displacement-error detecting unit that detects an angular displacement error of the encoder caused by thickness fluctuation of the endless belt, based on an output signal from the mark detecting unit, a first calculating unit that calculates a phase and a maximum amplitude to the mark, based on the detected angular displacement error of the encoder, a nonvolatile memory that stores a result of calculation by the first calculating unit, a second calculating unit that calculates correction data according to a distance from the mark on the endless belt based on the result of calculation stored in the nonvolatile memory, and a volatile memory that stores the calculated correction data. The belt drive system controls the belt driving unit by adding the correction data stored in the volatile memory to a preset control target value to stabilize speed fluctuation of the endless belt due to the thickness fluctuation. The color-shift detecting device includes a test-pattern forming unit that forms a plurality of mark sets including an array of marks in respective colors arranged in a moving direction of the transfer medium on the transfer medium; a sensor that detects each of the marks of the mark sets; an image-deviation-amount detecting unit that detects an amount of deviation of the images; and a setting unit that sets mark intervals between a reference color and other colors, mark intervals in a same color, and an interval of the mark sets in such a manner that, when calculating an amount of the color shift with respect to a synthesized wave including two or more of driving unevenness frequencies generated from the image carrier drive system and the belt drive system, a calculation error due to the synthesized wave is within a range in which the deviation of the images is correctable.

A color-shift detecting device according to still another aspect of the present invention is for a color image forming apparatus that uses a belt drive system for controlling at least one of an image carrier and a transfer medium, rotates the image carrier by an image carrier drive system, rotates the transfer medium by a transfer drive system, forms images in a plurality of colors on the image carrier, and transfers the images onto the transfer medium in a superimposing manner to form a color image. The belt drive system includes an endless belt, a belt driving unit that rotates the endless belt, at least one driven roller that is in contact with the endless belt, an encoder that is attached to the driven roller, a mark detecting unit that detects a mark that is a reference position of the endless belt, an angular-displacement-error detecting unit that detects an angular displacement error of the encoder caused by thickness fluctuation of the endless belt, based on an output signal from the mark detecting unit, a first calculating unit that calculates a phase and a maximum amplitude to the mark, based on the detected angular displacement error of the encoder, a nonvolatile memory that stores a result of calculation by the first calculating unit, a second calculating unit that calculates correction data according to a distance from the mark on the endless belt based on the result of calculation stored in the nonvolatile memory, and a volatile memory that stores the calculated correction data. The belt drive system controls the belt driving unit by adding the correction data stored in the volatile memory to a preset control target value to stabilize speed fluctuation of the endless belt due to the thickness fluctuation. The color-shift detecting device includes a test-pattern forming unit that forms a plurality of mark sets including an array of marks in respective colors arranged in a moving direction of the transfer medium on the transfer medium; a sensor that detects each of the marks of the mark sets; an image-deviation-amount detecting unit that detects an amount of deviation of the images; and a setting unit that sets mark intervals between a reference color and other colors, mark intervals in a same color, and an interval of the mark sets in such a manner that, when calculating an amount of the color shift with respect to a synthesized wave including two or more of driving unevenness frequencies generated from the image carrier drive system and the belt drive system, a calculation error due to the synthesized wave is equal to or less than 20 μm.

An image forming apparatus according to still another aspect of the present invention uses a belt drive system for controlling at least one of an image carrier and a transfer medium, and detects a color shift by a color-shift detecting method. The belt drive system includes an endless belt; a belt driving unit that rotates the endless belt; at least one driven roller that is in contact with the endless belt; an encoder that is attached to the driven roller; a mark detecting unit that detects a mark that is a reference position of the endless belt; an angular-displacement-error detecting unit that detects an angular displacement error of the encoder caused by thickness fluctuation of the endless belt, based on an output signal from the mark detecting unit; a first calculating unit that calculates a phase and a maximum amplitude to the mark, based on the detected angular displacement error of the encoder; a nonvolatile memory that stores a result of calculation by the first calculating unit; a second calculating unit that calculates correction data according to a distance from the mark on the endless belt based on the result of calculation stored in the nonvolatile memory; and a volatile memory that stores the calculated correction data. The belt drive system controls the belt driving unit by adding the correction data stored in the volatile memory to a preset control target value to stabilize speed fluctuation of the endless belt due to the thickness fluctuation. The color-shift detecting method includes forming a plurality of mark sets including an array of marks in respective colors arranged in a moving direction of the transfer medium on the transfer medium; detecting each of the marks of the mark sets to detect an amount of deviation of the images; and setting mark intervals between a reference color and other colors, mark intervals in a same color, and an interval of the mark sets in such a manner that, when calculating an amount of the color shift with respect to a synthesized wave including two or more of driving unevenness frequencies generated from the image carrier drive system and the belt drive system, a calculation error due to the synthesized wave is within a range in which the deviation of the images is correctable.

An image forming apparatus according to still another aspect of the present invention uses a belt drive system for controlling at least one of an image carrier and a transfer medium, and detects a color shift by a color-shift detecting method. The belt drive system includes an endless belt; a belt driving unit that rotates the endless belt; at least one driven roller that is in contact with the endless belt; an encoder that is attached to the driven roller; a mark detecting unit that detects a mark that is a reference position of the endless belt; an angular-displacement-error detecting unit that detects an angular displacement error of the encoder caused by thickness fluctuation of the endless belt, based on an output signal from the mark detecting unit; a first calculating unit that calculates a phase and a maximum amplitude to the mark, based on the detected angular displacement error of the encoder; a nonvolatile memory that stores a result of calculation by the first calculating unit; a second calculating unit that calculates correction data according to a distance from the mark on the endless belt based on the result of calculation stored in the nonvolatile memory; and a volatile memory that stores the calculated correction data. The belt drive system controls the belt driving unit by adding the correction data stored in the volatile memory to a preset control target value to stabilize speed fluctuation of the endless belt due to the thickness fluctuation. The color-shift detecting method includes forming a plurality of mark sets including an array of marks in respective colors arranged in a moving direction of the transfer medium on the transfer medium; detecting each of the marks of the mark sets to detect an amount of deviation of the images; and setting mark intervals between a reference color and other colors, mark intervals in a same color, and an interval of the mark sets in such a manner that, when calculating an amount of the color shift with respect to a synthesized wave including two or more of driving unevenness frequencies generated from the image carrier drive system and the belt drive system, a calculation error due to the synthesized wave is equal to or less than 20 μm.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 38A to 38D are diagrams of synthesized wave composition conditions for determining mark arrangement of an embodiment of the present invention;

FIG. 77 is a diagram of a part of the third calculation results;

DETAILED DESCRIPTION OF THE PREFERRED EMBODIMENTS

Exemplary embodiments of the present invention are explained in detail below with reference to the accompanying drawings. An example in which the present invention is applied to a color laser printer (hereinafter, "laser printer") employing an electrophotographic direct transfer method as an image forming apparatus is explained with reference to FIGS. 1 and 2.

Figure 1:
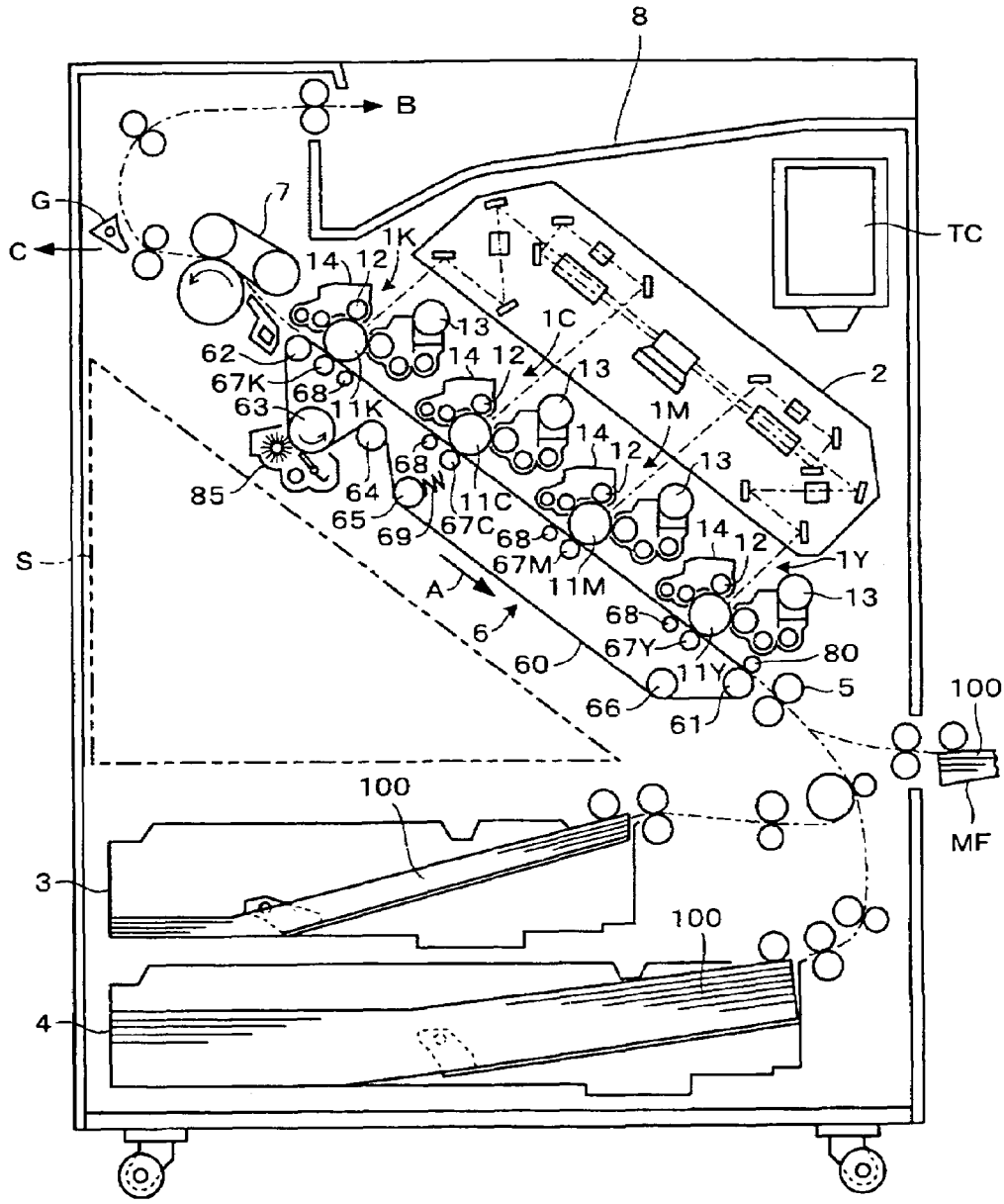
FIG. 1 is a sectional view of a laser printer according to an embodiment of the present invention.

FIG. 1 depicts the laser printer of the present embodiment. In this laser printer, four toner image forming units 1Y, 1M, 1C, and 1K (hereinafter, Y, M, C, and K attached to these symbols indicate the yellow, magenta, cyan, and black members, respectively) for forming images in colors of yellow (Y), magenta (M), cyan (C), and black (K) are arranged in order from the upstream side in the moving direction (traveling direction of a transfer conveying belt 60 as a direct transfer conveying belt along the arrow A of the figure) of a transfer sheet 100. The toner image forming Units 1Y, 1M, 1C, and 1K include photoconductor drums 11Y, 11M, 11C, and 11K as image carriers, and developing units 13. The arrangement of the toner image forming units 1Y, 1M, 1C, and 1K is set so that the rotation shafts of the photoconductor drums 11Y, 11M, 11C, and 11K are arranged in parallel to each other at predetermined pitches in the transfer sheet moving direction.

The laser printer includes, in addition to the toner image forming units 1Y, 1M, 1C, and 1K, an optical writing unit 2 as an exposure unit, paper feed cassettes 3 and 4, a pair of resist rollers 5, a transfer unit 6 having the transfer conveying belt 60 that carries and conveys the transfer sheet 100 so as to pass through the transfer positions of the toner image forming units 1Y, 1M, 1C, and 1K, a fixing unit 7 employing a belt fixing method, and an paper eject tray 8. In addition, the printer includes a manual paper feed tray MF and a toner supply container TC, and also includes an unillustrated waste toner bottle, a double-side inverting unit, and a power source unit in the space S shown by an alternate long and short double-dashed line.

In the toner image forming units 1Y, 1M, 1C, and 1K, the photoconductor drums 11Y, 11M, 11C, and 11K are driven to rotate by rotation driving units not shown, and then evenly changed by charging rollers 12 as charging units, and exposed to a plurality of laser beams modulated according to image data of the colors Y, M, C, and K by the optical writing unit 2, whereby electrostatic latent images are formed.

The optical writing unit 2 includes a light source, a polygon mirror, an f-θ lens, a reflecting mirror, and so on, and irradiating the surfaces of the photoconductor drums 11Y, 11M, 11C, and 11K with a plurality of laser beams modulated according to the image data of the colors Y, M, C, and K while scanning. Electrostatic latent images on the photoconductor drums 11Y, 11M, 11C, and 11K are developed by the developing units 13 to become toner images in the colors of Y, M, C, and K. The toner images in the colors on the photoconductor drums 11Y, 11M, 11C, and 11K are transferred onto the transfer sheet 100 on the transfer conveying belt 60 at drawing transfer positions by means of transfer electrical fields formed by the transfer unit 6, and thereafter, the photoconductor drums 11Y, 11M, 11C, and 11K are cleaned by a cleaning unit 14 and removed of electricity by a neutralization device, and get ready for the next electrostatic latent image formation.

Figure 2:
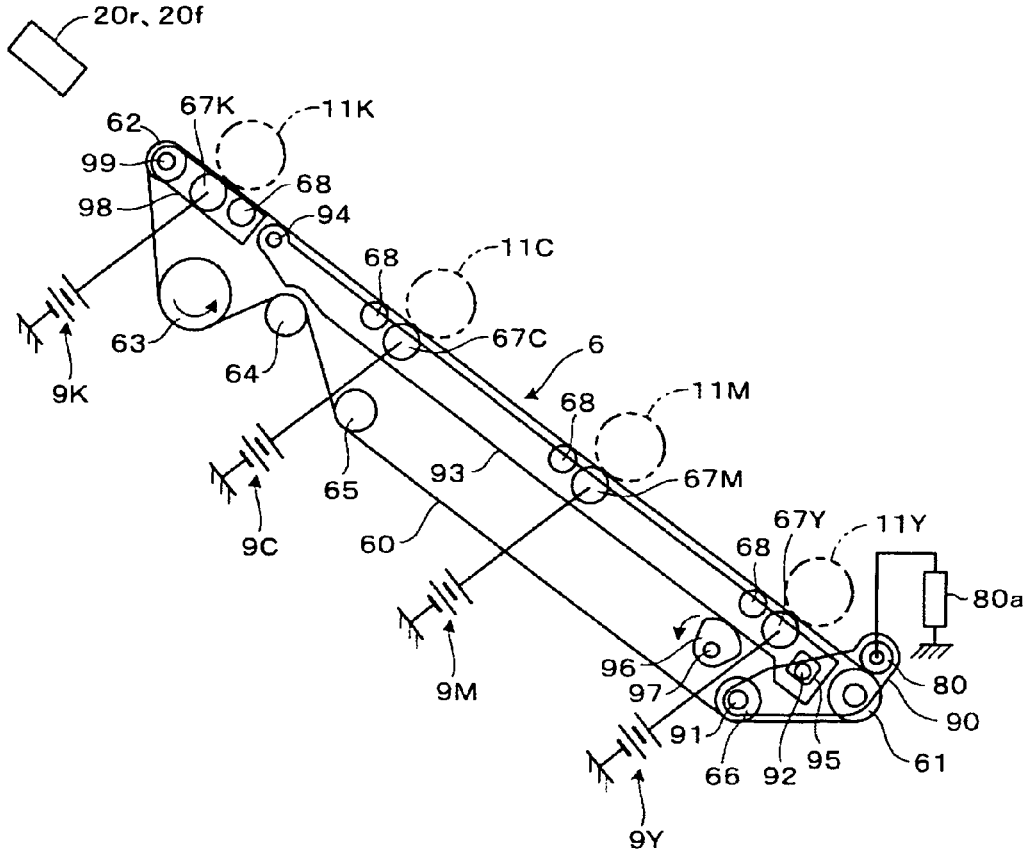
FIG. 2 is a front view of a construction of a transfer unit according to the present embodiment.

FIG. 2 depicts the construction of the transfer unit 6. The transfer conveying belt 60 used in the transfer unit 6 is an endless single layer belt with high resistance of a volume resistivity of $10^9$ through $10^{11}$ Ωcm, and its material is PVDF (polyvinylidene fluoride). The transfer conveying belt 60 is laid across supporting rollers 61 through 68 so as to pass through the transfer positions facing in contact with the photoconductor drums 11Y, 11M, 11C, and 11K of the toner image forming units 1Y, 1M, 1C, and 1K.

An entrance roller 61 on the upstream side of the transfer sheet moving direction among the supporting rollers 61 through 68 is disposed so as to face an electrostatic adsorbing roller 80 to which a predetermined voltage have been applied from the power source 80*a* and contact with the outer circumferential surface of the transfer conveying belt 60. The transfer sheet 100 that passes through between these two rollers 61 and 80 and charged is electrostatically adsorbed on the transfer conveying belt 60. A drive roller 63 frictionally drives the transfer conveying belt 60, and is connected to an unillustrated drive source and driven to rotate in the arrow direction.

As transfer electrical field forming units that form transfer electrical fields at the respective transfer positions of the toner image forming units 1Y, 1M, 1C, and 1K, transfer bias applying members 67Y, 67M, 67C, and 67K are provided so as to face the photoconductor drums 11Y, 11M, 11C, and 11K and come into contact with the back surface of the transfer conveying belt 60. The transfer bias applying members 67Y, 67M, 67C, and 67K are bias rollers provided with sponges on their outer circumferences, and transfer biases are applied to the roller core metals from transfer bias power sources 9Y, 9M, 9C, and 9K. Due to action of the applied transfer biases, transfer charges are applied to the transfer conveying belt 60, and at the respective transfer positions, transfer electrical fields with predetermined intensities are formed between the transfer conveying belt 60 and the surfaces of the photoconductor drums 11Y, 11M, 11C, and 11K. To maintain properly the contact between the transfer sheet and the photoconductor drums 11Y, 11M, 11C, and 11K in the regions in which transfer is performed and obtain the best transfer nips, a backup roller 68 are provided.

The transfer bias applying members 67Y, 67M, and 67C, and the backup roller 68 disposed near these members are integrally held by a swing bracket 93 in a rotatable manner, and are rotatable around a rotation shaft 94. The transfer bias applying members 67Y, 67M, and 67C and the backup roller 68 rotate clockwise according to rotation of a cam 96 fixed to a cam shaft 97 in the arrow direction. The entrance roller 61 and the adsorbing roller 80 are integrally supported by an entrance roller bracket 90 and are rotatable clockwise around a shaft 91 from the state of FIG. 2. A hole 95 formed in the swing bracket 93 and a pin 92 fixed and stood on the entrance roller bracket 90 engage with each other, and the entrance roller 61 and the adsorbing roller 80 rotate in conjunction with the rotation of the swing bracket 93. According to the clockwise rotation of these brackets 90 and 93, the bias applying members 67Y, 67M, and 67C and the backup roller 68 are separated from the photoconductor drums 11Y, 11M, and 11C, and the entrance roller 61 and the adsorbing roller 80 also move downward. Accordingly, when forming an image in black only, the contact between the photoconductor drums 11Y, 11M, and 11C and the transfer conveying belt 60 can be avoided.

On the other hand, the transfer bias applying member 67K and the backup roller 68 adjacent to this transfer bias applying member are rotatably supported by an exit bracket 98 and rotatable around a shaft 99 coaxial with an exit roller 62. When the transfer unit 6 is attached to or detached from the laser printer main body, the transfer bias applying member 67K and the adjacent backup roller 68 are rotated clockwise so as to separate from the black photoconductor drum 11K by means of an operation on a handle (not shown).

On the outer circumferential surface of the transfer conveying belt 60 wound around the drive roller 63, a cleaning device 85 including a brush roller and a cleaning blade is disposed so as to be in contact with it, and the cleaning device 85 removes foreign bodies such as toners adhering on the transfer conveying belt 60.

At the more downstream side than the drive roller 63 in the traveling direction of the transfer conveying belt 60, a roller 64 is provided in the direction of pressing the outer circumferential surface of the transfer conveying belt 60, whereby a winding angle of the transfer conveying belt 60 around the drive roller 83 is secured. At the still more downstream side than the roller 64 within the loop of the transfer conveying belt 60, a tension roller 65 that gives tension to the belt by a spring 69 as a pressing member is provided.

The alternate long and short dashed line of FIG. 1 indicates the conveying route of the transfer sheet 100. The transfer sheet 100 fed from the paper feed cassette 3 or 4 or the manual paper feed tray MF is conveyed by the conveying rollers while being guided by conveying guides that are not shown, and then fed to a temporary stop position at which the pair of resist rollers 5 are provided. The transfer sheet 100 fed out in predetermined timing by the pairs of resist rollers 5 is carried by the transfer conveying belt 60, conveyed toward the toner image forming units 1Y, 1M, 1C, and 1K, and then pass through the transfer nips of the toner image forming units 1Y, 1M, 1C, and 1K.

The toner images in the colors formed on the photoconductor drums 11Y, 11M, 11C, and 11K of the respective toner image forming units 1Y, 1M, 1C, and 1K are superposed on the transfer sheet 100 at the transfer nips and transferred onto the transfer sheet 100 due to action of the transfer electrical fields and nipping pressures. By this superposing transfer of the toner images in the colors, a full-color toner image is formed on the transfer sheet 100.

On the other hand, on the transfer sheet 100 on which the full-color toner image has been formed, the fixing unit 7 fixes the full color toner image, and then the transfer sheet 100 is fed in a first sheet eject direction B or a second sheet eject direction C according to the rotating posture of a switching guide G. The transfer sheet 100 is stacked on the paper eject tray 8 in a so-called face-down state in that the image face turns down when the transfer sheet is ejected onto the paper eject tray 8 from the first eject direction B. On the other hand, when the transfer sheet 100 is ejected in the second eject direction C, it is conveyed to another processor (sorter, binder, etc.) that is not shown, or conveyed to the pair of resist rollers 5 again for double-side printing through a switchback unit.

In this tandem-type laser printer, accurate superposition of the toner images in the colors is important for preventing occurrence of color shifts. However, in the drive roller 63, the entrance roller 61, the exit roller 99, and the transfer conveying belt 60 used in the transfer unit 6, production errors of several tens of micrometers occur at the time of production of the parts. Due to the errors, fluctuation components occurring when the parts turn one round are transmitted to the transfer conveying belt 60 and cause fluctuation of the conveying speed of the transfer sheet 100, and accordingly, the timings of transferring the toners on the photoconductor drums 11Y, 11M, 11C, and 11K onto the transfer sheet 100 slightly shift, resulting in color shifts in the vertical scanning direction. Particularly, in the apparatus of the present embodiment that forms an image in fine dots of 1200×1200 DPI, timing shifts of several micrometers come out as color shifts.

According to the present embodiment, an encoder is attached onto the axis of a driven roller 66, and the rotation speed of this encoder is detected and the rotation of the drive roller 63 is controlled by means of feedback, whereby the transfer conveying belt 60 is made to travel at a constant speed.

Figure 3:
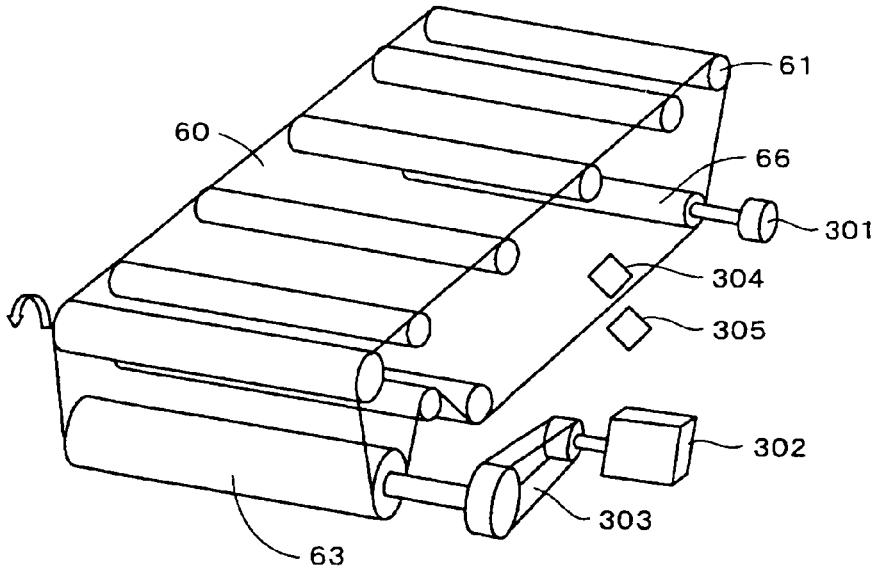
FIG. 3 is a perspective view of a construction of main components of the transfer unit according to the present embodiment.

FIG. 3 shows the construction of main components of the transfer unit 6. The drive roller 63 is connected to a drive gear of a motor 302 via a timing belt 303, and rotates at a speed in proportion to the driving speed of the motor 302 according to the driving and rotation of the motor 302. According to the rotation of the drive roller 63, the transfer conveying belt 60 is driven, and according to the driving of the transfer conveying belt 60, the driven roller 66 rotates by following the transfer conveying belt 60. According to the present embodiment, an encoder 301 is disposed on the axis of the driven roller 66, and the encoder 301 detects the rotation speed of the driven roller 66 to control the speed of the motor 302. This is for minimizing the speed fluctuation of the transfer conveying belt 60 since the speed fluctuation of the transfer conveying belt 60 causes color shifts as described above.

Figure 4:
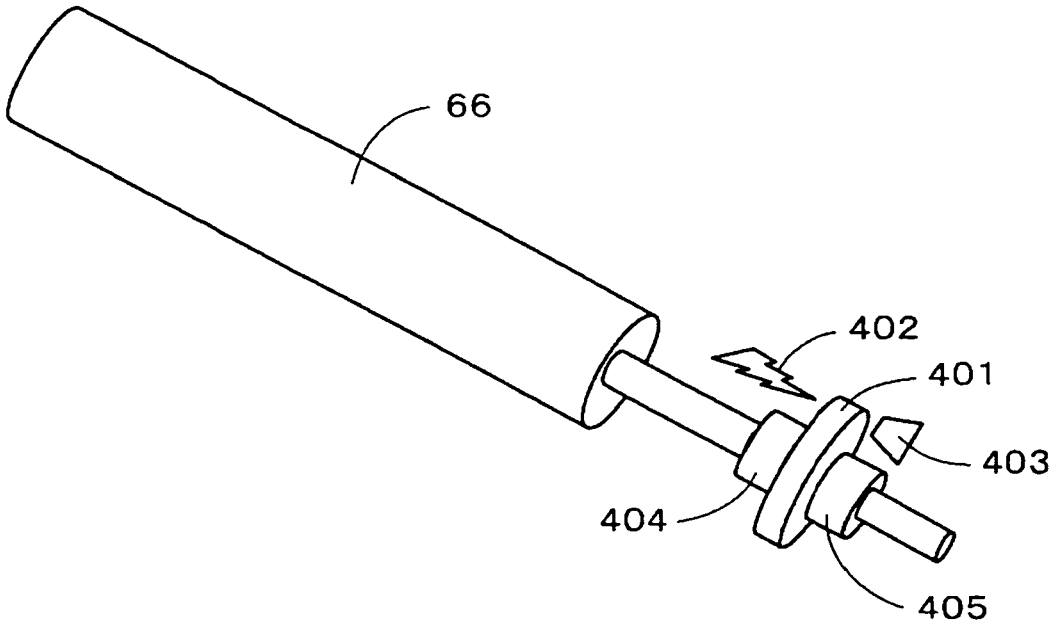
FIG. 4 is a perspective view of the details of a lower right roller and an encoder according to the present embodiment.

FIG. 4 depicts the details of the driven roller 66 and the encoder 301. The encoder 301 includes a disk 401, a light emitting element 402, a light receiving element 403, and press fit bushes 404 and 405. The disk 401 is fixed by press-fitting the press fit bushes 404 and 405 on the axis of the driven roller 66, and rotate simultaneously with the rotation of the driven roller 66. The disk 401 has in the circumferential direction a slit that transmits light at a resolution of several hundred units, and the light emitting element 402 and the light receiving element 403 are disposed at both sides of the slit and the light receiving element 403 receives light from the light emitting element 402 through the slit of the disk 401, whereby a pulsed ON/OFF signal according to the rotating amount of the driven roller 66 is obtained. By detecting the angle of movement (hereinafter, referred to as angular displacement) of the driven roller 66 by using this pulsed ON/OFF signal, the driving amount of the motor 302 is controlled.

A mark 304 for management of a reference position of the transfer conveying belt 60 is formed in a non-image forming region of the surface of the transfer conveying belt 60, and a mark sensor 305 attached near the mark detects the presence of the mark 304. This is for preventing changes in the working drive radius of the driven roller 66 due to thickness unevenness of the transfer conveying belt 60 and detection as if the encoder 301 fluctuates in speed although the speed of the transfer conveying belt 60 is constant in actuality as described below. An angular displacement error occurring due to belt thickness fluctuation of the transfer conveying belt 60 measured in advance is added to a control target value, and the result of this addition is set as a control target value and the motor 302 is controlled by means of feedback, whereby the transfer conveying belt 60 is conveyed at a constant speed. The mark 304 is provided for correspondence between the actual position of the transfer conveying belt 60 and the position of the angular displacement error.

In proportional control calculation in the feedback control, as described above, a control gain is added to the difference between a target angular displacement and a detection angular displacement for each control cycle to control the driving speed of the motor 302, so that if the angular displacement error due to the belt thickness is great, the motor 302 is further amplified and driven. Therefore, due to the belt thickness, the transfer conveying belt 60 fluctuates in speed, resulting in color shifts.

When the drive motor is driven at a constant speed, even in the case where the transfer conveying belt is ideally conveyed without speed fluctuation, if the thick portion of the belt is wound around the follower shaft, the following effective radius of the belt is increased and the rotation angular displacement of the follower shaft per fixed period lowers, and this lowering is detected as belt conveying speed lowering. If the thin portion of the belt is wound around the follower shaft, the rotation angular displacement of the follower shaft is increased, and this is detected as an increase in belt conveying speed.

Figure 5:
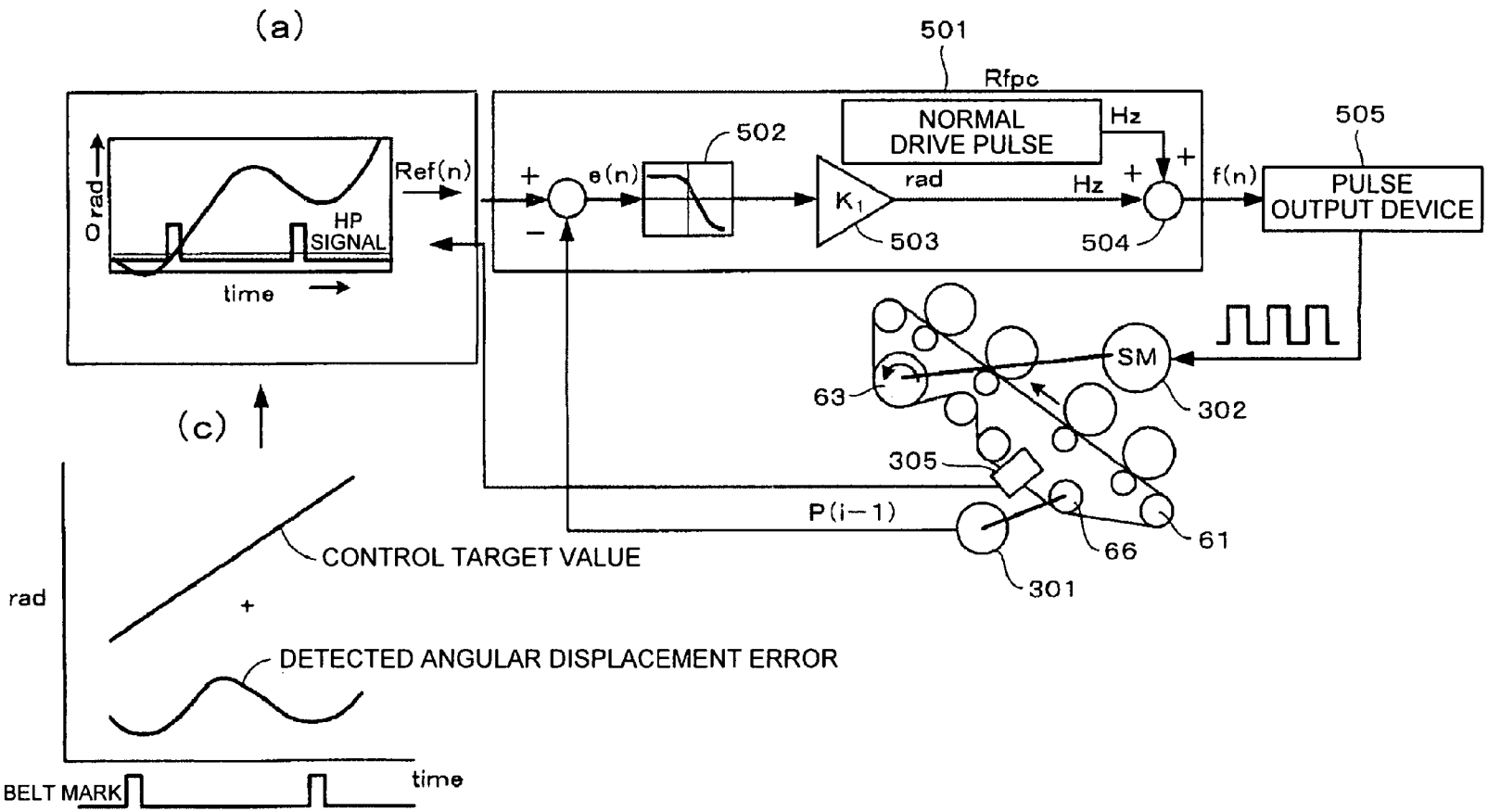
FIG. 5 is a schematic for illustrating a belt-drive control device according to the present embodiment and a diagram of an angular displacement error caused by belt thickness fluctuation of the encoder and a control target value and a sum of these.

This indicates the movement when the motor 302 is driven at a constant speed, and in other words, if the results of sampling the counts of the pulses of the encoder 301 in fixed timings are as shown in (c) of FIG. 5, this means that the driven roller 66 rotates at a constant speed. Therefore, according to the present embodiment, as shown in (A) of FIG. 5, a target angular displacement for each control cycle is generated and the encoder 301 is controlled according to the target angular displacement, whereby the speed of the transfer conveying belt 60 is made constant.

Instead of measuring the actual thickness of the transfer conveying belt 60 in units of micrometers and setting it as a control parameter, an angular displacement error of the encoder 301 in units of radians occurring due to influence from the thickness of the transfer conveying belt 60 is set as a control parameter.

The control parameters are generated from the output results of the encoder 301 when the motor 302 is driven at a constant speed, so that the control parameters can be generated in an actual apparatus, and therefore, a measuring device to measure the thickness of the transfer conveying belt 60 is not necessary, and very inexpensive construction can be realized.

In addition, the thickness of the transfer conveying belt 60 has a sine wave shape in most cases, so that when high-resolution measurement is possible with an external jig, a phase and a maximum amplitude at the mark 304 are calculated from the results of measurement with the external jig, and these are set as the control parameters and inputted from the operation panel on the actual apparatus, whereby the feedback control of the motor 302 can be realized.

In the actual output results of the encoder 301, not only the angular displacement error due to the thickness of the transfer conveying belt 60 but also fluctuation and rotation eccentric components of the drive roller 63 and of other components are overlapped and outputted. Therefore, processing of extracting only influence components of the driven roller 66 from the output results is performed, and the results of this extraction are set as control parameters for the angular displacement error.

A belt-drive control device as a rotor drive device for performing the belt drive control method as a rotor drive method according to the present embodiment is shown in (B) of FIG. 5. Hereinafter, a belt-drive control device of the present embodiment is explained.

As shown in FIGS. 5A and 5B, the difference e(n) between the target angular displacement Ref(n) of the encoder 301 and the detection angular displacement P(n−1) of the encoder 301 is inputted into a position controller 501. The position controller 501 includes a low pass filter 502 for removing high-frequency noise and a proportional element (gain: Kp). In the position controller 501, a correction amount with respect to a standard drive pulse (regular drive pulse) to be used for driving of the motor 302 is calculated, and given to a computing unit 504. In the computing unit 504, the correction amount is added to the constant standard drive pulse frequency Refp_c (Rfpc), whereby determining the drive pulse frequency f(n).

As the target angular displacement Ref(n), a control target value obtained by adding an angular displacement error occurring due to thickness fluctuation of the transfer conveying belt 60 is generated, and a difference e(n) between this control target value and the detection angular displacement P(n−1) of the encoder 301 is calculated, whereby the displacement that corresponds to the difference is calculated. The addition of the angular displacement error occurring due to the thickness fluctuation of the transfer conveying belt 60 is periodically repeated according to the output timings of the mark sensor 305 to be detected according to the rotation of the transfer conveying belt 60. A pulse output device 505 operates based on a pulsed control signal outputted from the computing unit 504 and applies a pulsed drive voltage to the motor 302, and drives and controls the motor 302 by means of a predetermined drive frequency outputted from the computing unit 504.

Figure 6:
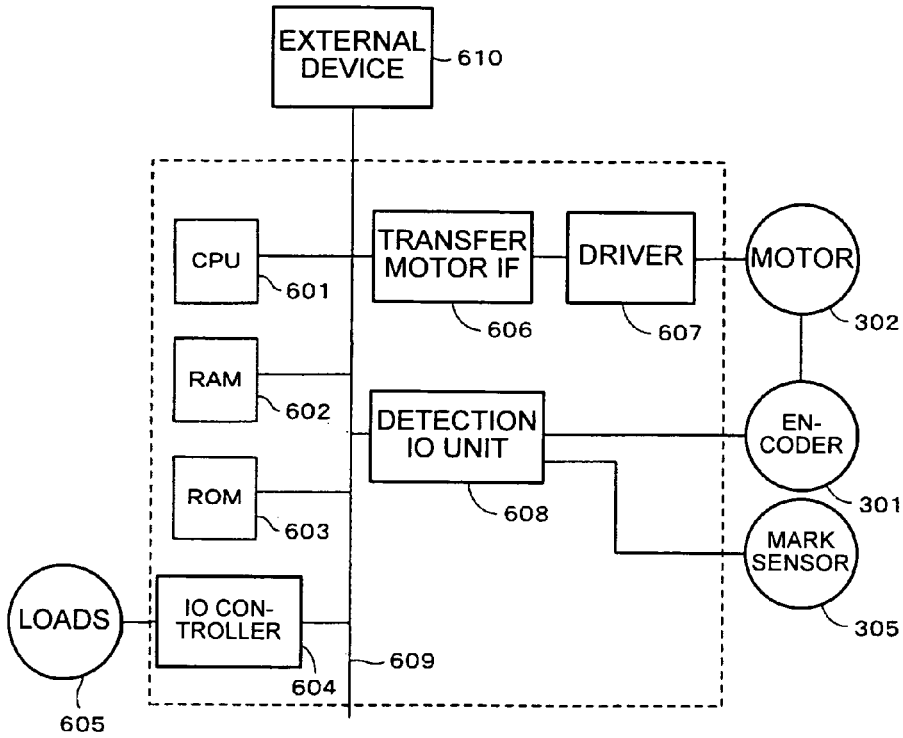
FIG. 6 is a block diagram of hardware construction of a transfer drive motor control system and a control target according to the present embodiment.

FIG. 6 depicts hardware construction of a control system of the motor 302 and the control target according to the present embodiment. This control system digitally controls a drive pulse of the motor 302 based on an output signal of the encoder 301. This control system includes a CPU 601, a RAM 602, a ROM 603, an IO controller 604, a transfer motor I/F 606, a driver 607, and a detection IO unit 608.

The CPU 601 controls the entirety of this laser printer, for example, controls receiving of image data inputted from an external device 610 and transmission and receiving of control commands inputted from the external device 610. The RAM 601 to be used for a work, the ROM 603 that stores programs, and the IO controller 604 are connected to each other via buses, and in response to an instruction from the CPU 601, perform various operations such as control of the data reading and writing, control of 605 including a motor that drives loads, a clutch, a solenoid, and a sensor, etc.

The transfer motor IF 606, in response to a driving instruction from the CPU 601, outputs an instruction signal to instruct a drive frequency of the drive pulse signal to the motor 302 via the driver 607 (corresponding to the pulse output device 505). According to this frequency, the transfer motor 302 is driven to rotate, so that driving speed control of the motor 302 becomes changeable. An output signal from the encoder 301 is inputted into the detection IO unit 608. The detection IO unit 608 processes and converts an output pulse of the encoder 301 into a digital value. The detection IO unit 608 has a counter that counts the output pulses of the encoder 301, and multiplies and converts the number counted by the counter by a predetermined converting constant of pulse number diagonal displacement into a digital value corresponding to the angular displacement of the axis of the driven roller 66 (the disk 401). A signal of this digital value corresponding to the angular displacement of the disk 401 is transmitted to the CPU 601 via a bus.

Based on a drive frequency instruction signal transmitted from the CPU 601, the transfer motor IF 606 generates a pulsed control signal having the drive frequency. The driver 607 includes a power semiconductor element (for example, transistor) and so on. The driver 607 operates based on the pulsed control signal outputted from the transfer motor IF 606 and applies a pulsed drive voltage to the motor 302. As a result, the driving of the motor 302 is controlled by a predetermined drive frequency outputted from the CPU 601. Thereby, the motor 302 is accordingly controlled so that the angular displacement of the disk 401 follows the target angular displacement, and the driven roller 66 rotates at a predetermined constant angular velocity. The angular displacement of the disk 401 is detected by the encoder 301 and the detection IO unit 608 and taken in the CPU 601, and the control is repeated.

Figure 7:
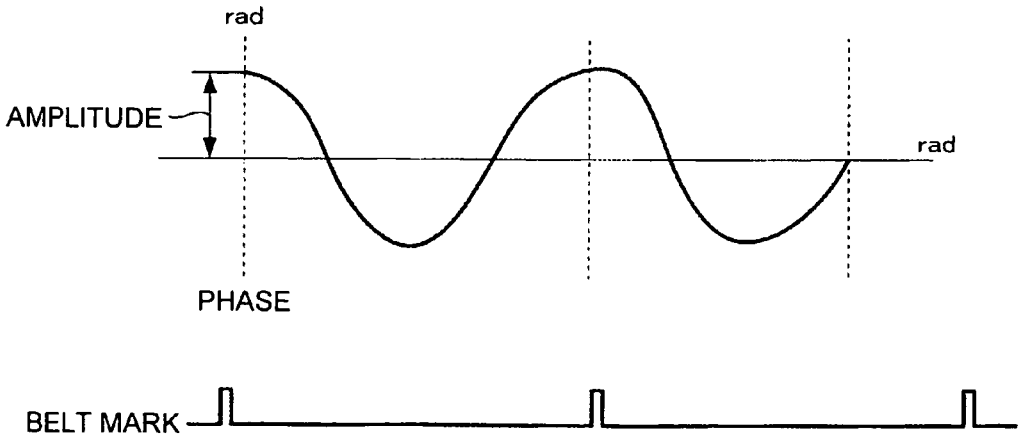
FIG. 7 is a diagram of an angular displacement error according to belt thickness fluctuation according to the present embodiment.

The RAM 602 has, in addition to the function to be used as a work area when executing a program stored in the ROM 603, a function of storing angular displacement error data for one round of the transfer conveying belt 60 from the mark 304 measured in advance in the CPU 601 based on outputs of the mark sensor 305 and the encoder 301 corresponding to the thickness fluctuation of the transfer conveying belt 60. The RAM 602 is a volatile memory, so that the CPU 601 stores phase and amplitude parameters of an angular displacement error according to thickness fluctuation of the transfer conveying belt 60 as shown in FIG. 7 calculated from the outputs of the mark sensor 305 and the encoder 301 (phase and maximum amplitude data of the angular displacement error to the mark 304) (or an angular displacement error inputted (instructed) from the operation panel or a personal computer (hereinafter, referred to as PC) to which this laser printer is connected) in a nonvolatile memory such as EEPROM that is not shown, and calculates angular displacement error data corresponding to the thickness fluctuation of one cycle of the transfer conveying belt 60 by using a sine function or approximation when the power source is turned on or the motor 302 is started, and develops the data on the RAM 602.

The actual thickness of the transfer conveying belt 60 greatly depends on the production process, and in most cases, the thickness has a sine profile, so that angular displacement error data of the whole one round of the belt is not needed, and when measuring, the CPU 601 calculates a phase and an amplitude of the angular displacement error corresponding to the thickness fluctuation of the transfer conveying belt 60 from a reference position (the mark 304 position), and calculates angular displacement error data of the encoder 301 from this data, and this data can be handled as equivalent data.

Therefore, it is not necessary that the angular displacement error data for each control cycle is stored in the nonvolatile memory, and angular displacement error data due to the belt thickness is generated from only the phase and amplitude parameters, so that control becomes possible by preparing only an area for the volatile memory. The angular displacement error data according to the thickness of the transfer conveying belt 60 is generated by the CPU 601 based on the following equation when the power source is turned on or the motor 302 is started.

$\Delta\theta = b^* \sin(2^*\pi^*ft+\tau)$ [rad]: rotation angular velocity fluctuation of the follower shaft of the driven roller 66

The CPU 601 calculates $\Delta\theta$ from the values of the nonvolatile memory based on the control cycle from the mark 304, and successively stores it in the RAM 602 as a volatile memory.

When the transfer motor 302 is driven in actuality, the CPU 601 switches the referring address of the RAM 602 according to the timing of detecting the mark 304 by the mark sensor 305 to readout the angular displacement error data from the RAM 602. The CPU 601 adds the readout data to the control target angular displacement, whereby performing feedback control without being influenced by the belt thickness.

Figure 18:
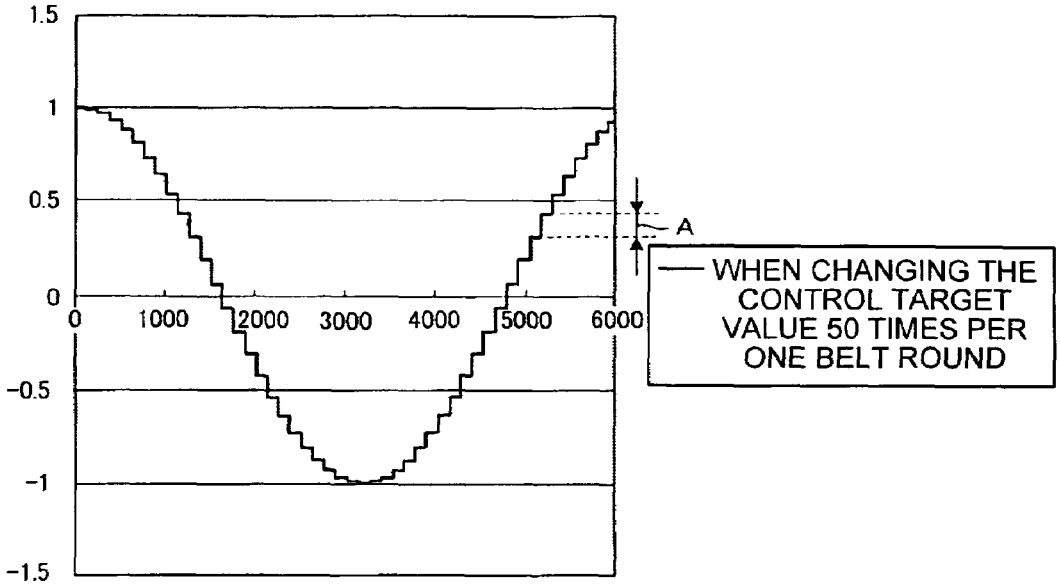
FIG. 18 is a diagram of a profile date example according to the present embodiment.
Figure 19A:
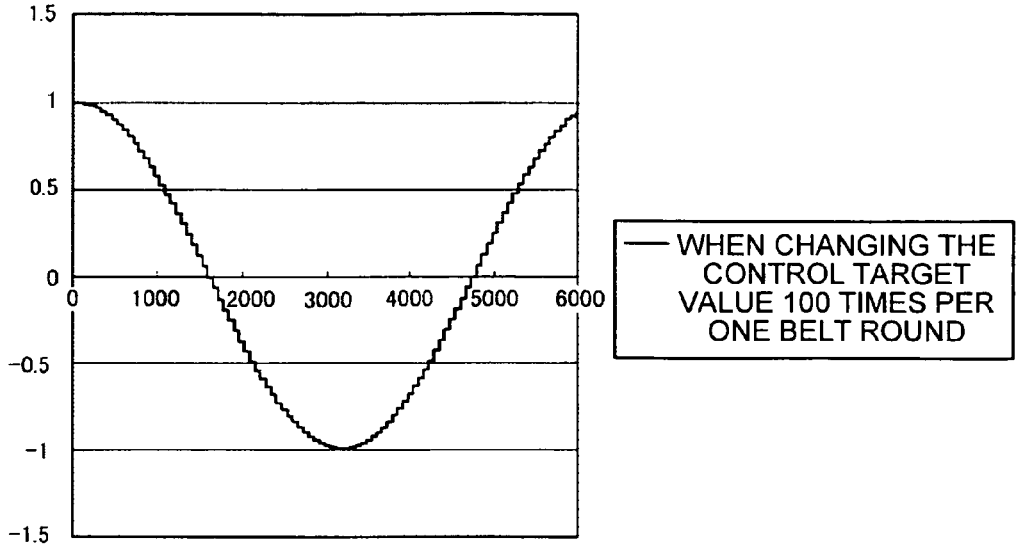
FIGS. 19A and 19B are diagrams of another profile data example according to the present embodiment.
Figure 19B:
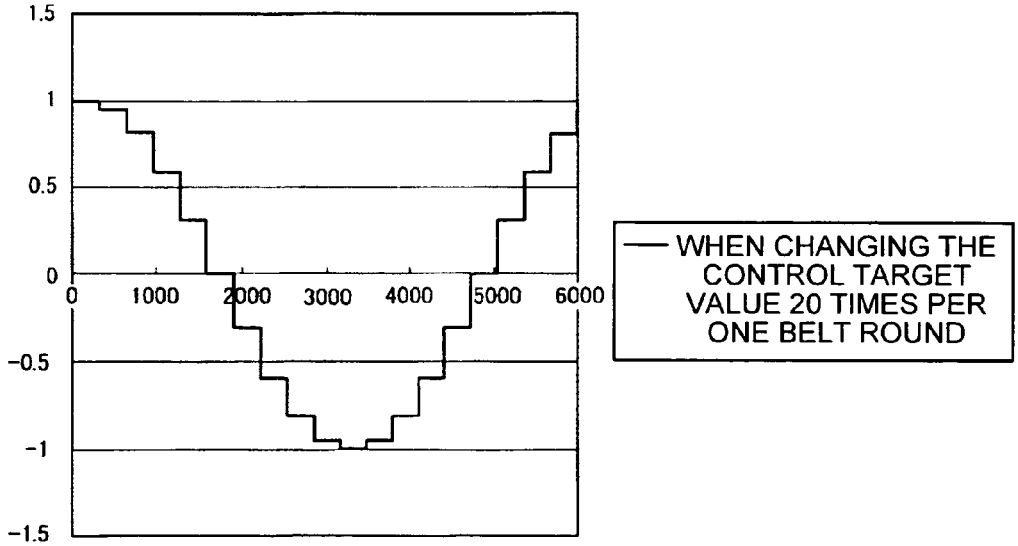
Figure 20:
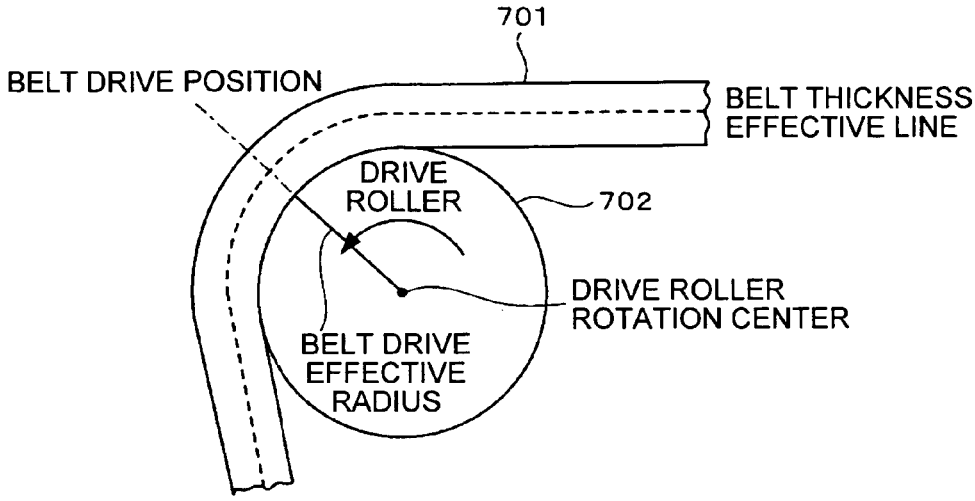
FIG. 20 is a front view of an example of a part of an endless belt and a drive roller.
Figure 21:
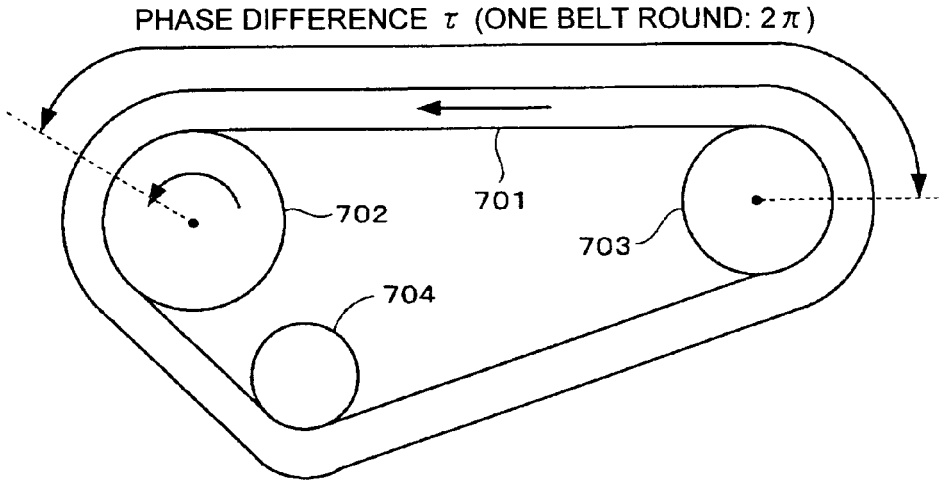
FIG. 21 is a front view of a model of a belt drive conveying system.
Figure 22:
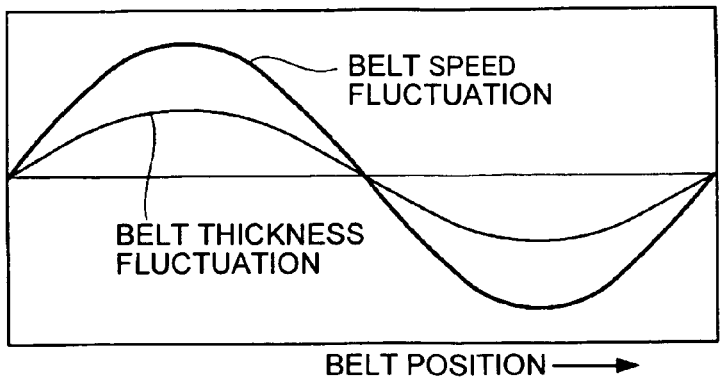
FIG. 22 is a conceptual diagram of belt thickness fluctuation and belt conveying speed fluctuation of one round of the belt when a drive shaft of the drive roller is rotated at a constant angular velocity.
Figure 23:
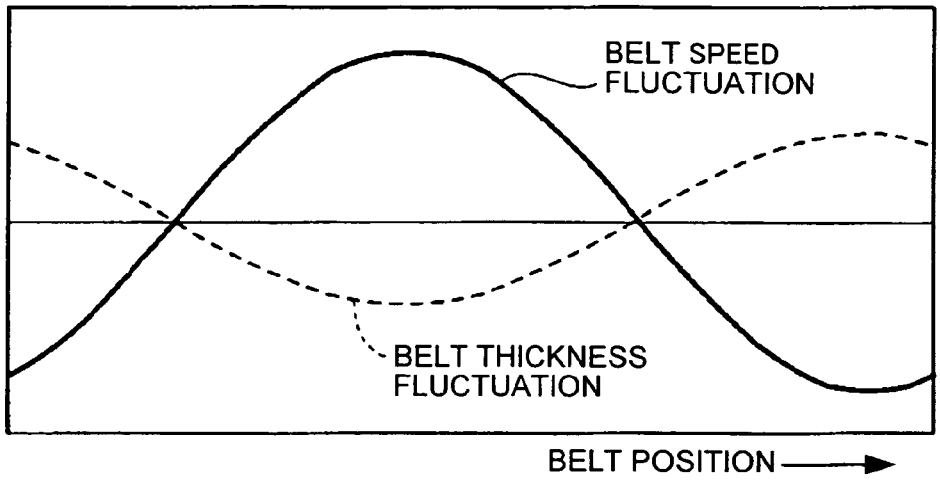
FIG. 23 is a diagram of belt thickness fluctuation on the follower shaft when the belt is conveyed at a constant conveying speed and belt conveying speed fluctuation detected on the follower shaft of the driven roller.
Figure 24:
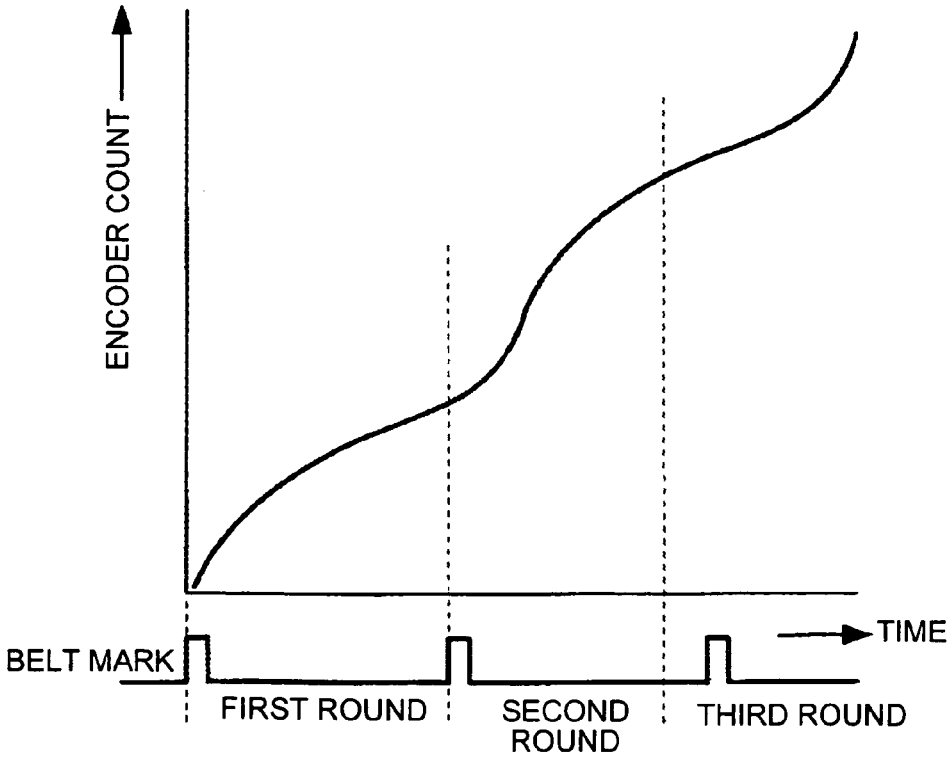
FIG. 24 is a diagram of an example of counts of the encoder pulse counter.

When only the peak value of the speed fluctuation due to the thickness of the transfer conveying belt 60 is lowered, the angular displacement error data according to the thickness of the transfer conveying belt 60 for each control cycle is not necessary. Therefore, to delete the memory area, the CPU 601 generates control target profile data of approximately 50 (or 100 or 20) points per one round of the transfer conveying belt 60 as shown in, for example, FIG. 18 (or FIGS. 19A and 19B), and updates the thickness profile data when the transfer conveying belt 60 reaches each point, and even by this method, the peak value of the speed fluctuation due to the thickness of the transfer conveying belt 60 can be sufficiently lowered.

Figure 8:
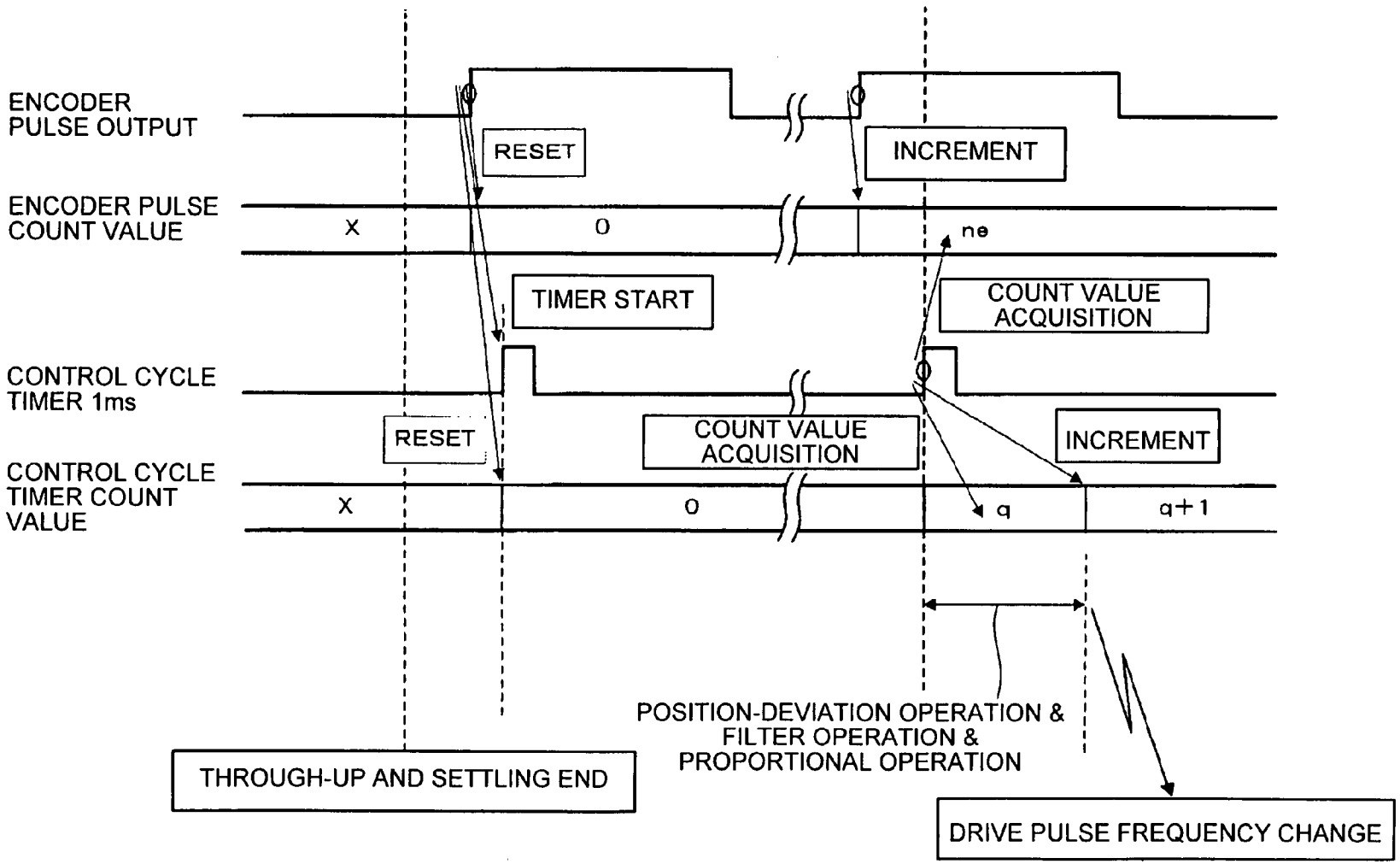
FIG. 8 is a timing chart of control timings of the present embodiment.
Figure 9:
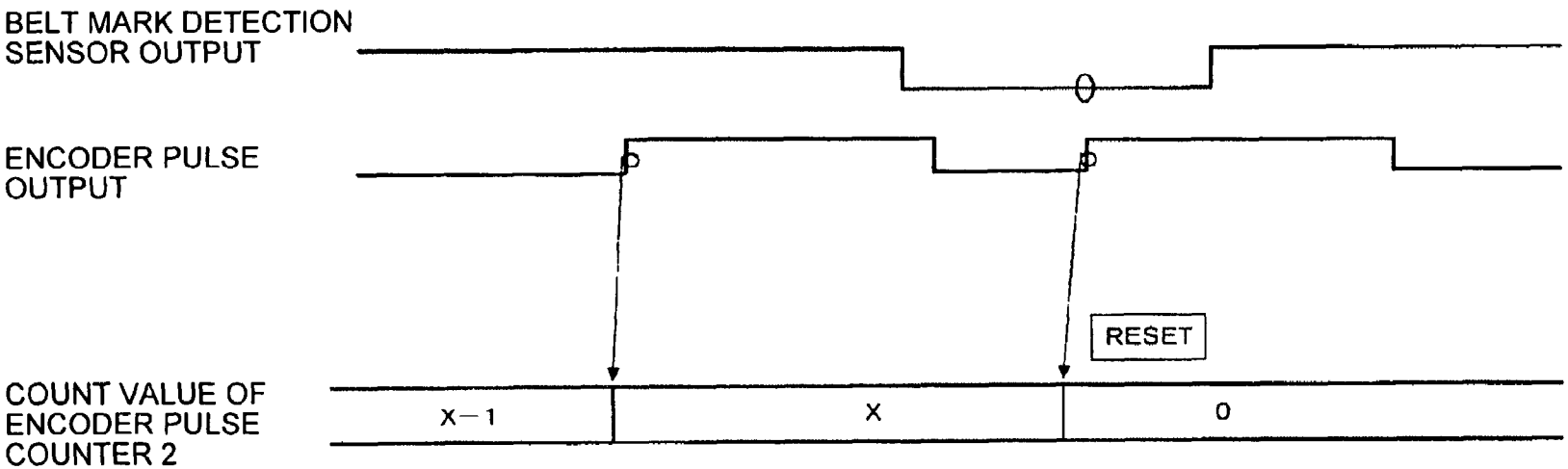
FIG. 9 is a timing chart of control timings of the present embodiment.

FIGS. 8 and 9 are timing charts in this control. First, the detection IO unit 603 increments the count of the encoder pulse counter 1 by the rise edge of the A-phase output of the output pulse of the encoder 301. The control cycle of this control is 1 millisecond, and the detection IO unit 608 increments the count of the control cycle timer counter every interruption of the control cycle timer into the CPU 601. The detection IO unit 608 starts the control cycle timer when a rise edge of an output pulse of the encoder 301 is detected for the first time after through-up and setting completion of the motor 302, and resets the count of the control cycle timer counter.

The detection IO unit 608 acquires the count ne of the encoder pulse counter 1 and increments the count q of the control cycle timer counter every interruption of the control cycle timer into the CPU 601. The detection IO unit 608 increments the encoder pulse counter 2 in the same manner as in the encoder pulse counter 1 by a rise edge of the A phase output of the output pulse of the encoder 301 and resets it by a first rise edge of the output pulse of the encoder 301 after a mark detection signal is inputted from the mark sensor 305. Therefore, the encoder pulse counter 2 counts the moving distance from the mark 304 on the transfer conveying belt 60, and according to this count, switches a referring address of the RAM 602 at which the control target profile data of one round of the transfer conveying belt 60 is stored.

The CPU 601 calculates position deviation of the transfer conveying belt 60 as shown below based on the counts of the counters of the detection IO unit 608.

$$e(n)=\theta 0^*q+(\Delta\theta-\Delta\theta_0)-\theta 1^*ne[\text{rad}]$$

where e(n) is position deviation (calculated by the current sampling), $\theta 0$ is moving angle per control cycle of 1 [ms] ($=2\pi^*V^*E-3/l\pi$[rad]), $\Delta\theta$ is rotation angular velocity fluctuation of follower shaft of the driven roller 66 ($=b^*\sin(2^*\pi^*ft+\tau)$) (table reference value), $\Delta\theta_0$ is $\Delta\theta$ acquired first after starting the motor 302, $\theta 1$ is moving angle per 1 pulse of the encoder 301 ($=2\pi/p$ [rad]), q is count of the control cycle timer, V is belt linear speed (mm/s), l is diameter of the driven roller 66 [mm], b is amplitude [rad] fluctuating according to the thickness of the transfer conveying belt 60, $\tau$ is phase [rad] of the thickness fluctuation of the transfer conveying belt 60 at the mark 304, and f is cycle [Hz] of thickness fluctuation of the transfer conveying belt 60.

According to the present embodiment, the diameter of the driven roller 66 attached to the encoder 301 is $\phi$15.515 mm, and the thickness of the transfer conveying belt 60 is 0.1 mm. The driven roller 66 is driven to rotate due to friction with the transfer conveying belt 60, and when assuming the thickness approximately half the thickness of the transfer conveying belt 60 is the core of the rotation of the driven roller 66, the drive effective radius 1 of the transfer conveying belt 60 is l=15.515+0.1=15.615 mm. According to the present embodiment, the resolution p of the encoder 301 is at 300 pulses per one rotation of the encoder 301.

Figure 25:
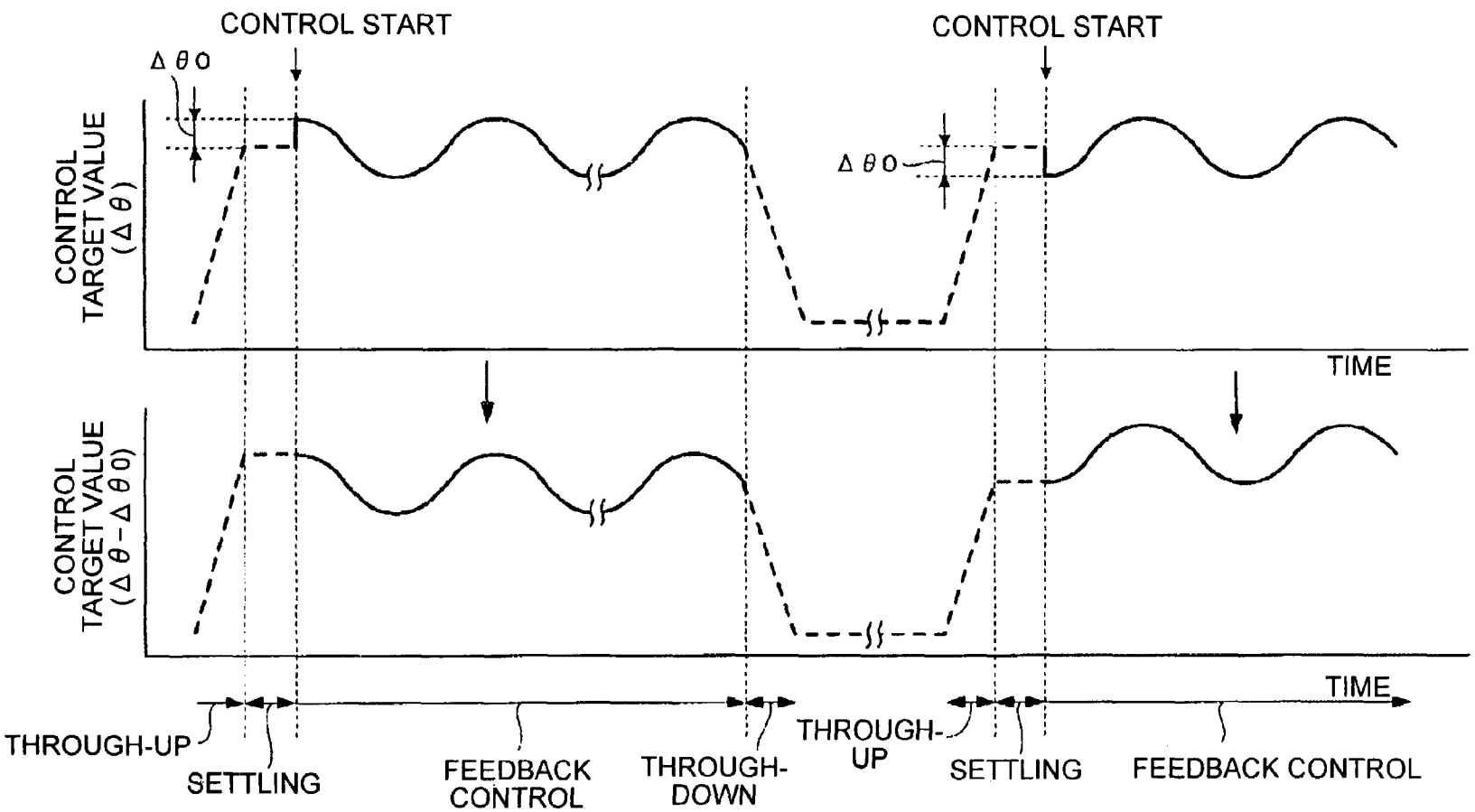
FIG. 25 is a diagram of a state in that sudden speed fluctuation when feedback control starts is eased according to the present embodiment.

According to the present embodiment, the CPU 601 reduces sudden speed fluctuation when starting feedback control as shown in FIG. 25 by subtracting $\Delta\theta_0$ acquired first when starting the motor 302 from $\Delta\theta$ by using Equation "$(\Delta\theta-\Delta\theta_0)$." The CPU 601 uses the same value as $\Delta\theta_0$ during rotation of the transfer rotor 302, and updates it every starting of the transfer motor 302.

The CPU 601 applies the following filter operation to the calculated position deviation in the low pass filter 502 of the position controller 501 shown in FIG. 5 to avoid response to sudden position fluctuation of the transfer conveying belt 60.

Filter type: Butterworth IIR low-pass filter

Sampling frequency: 1 kHz (equal to the control cycle)

Pass-band ripple (Rp): 0.01 dB

Stop band end attenuation (Rs): 2 dB

Pass-band end frequency (Fp): 50 Hz

Stop band end frequency (Fs): 100 Hz

Figure 10:
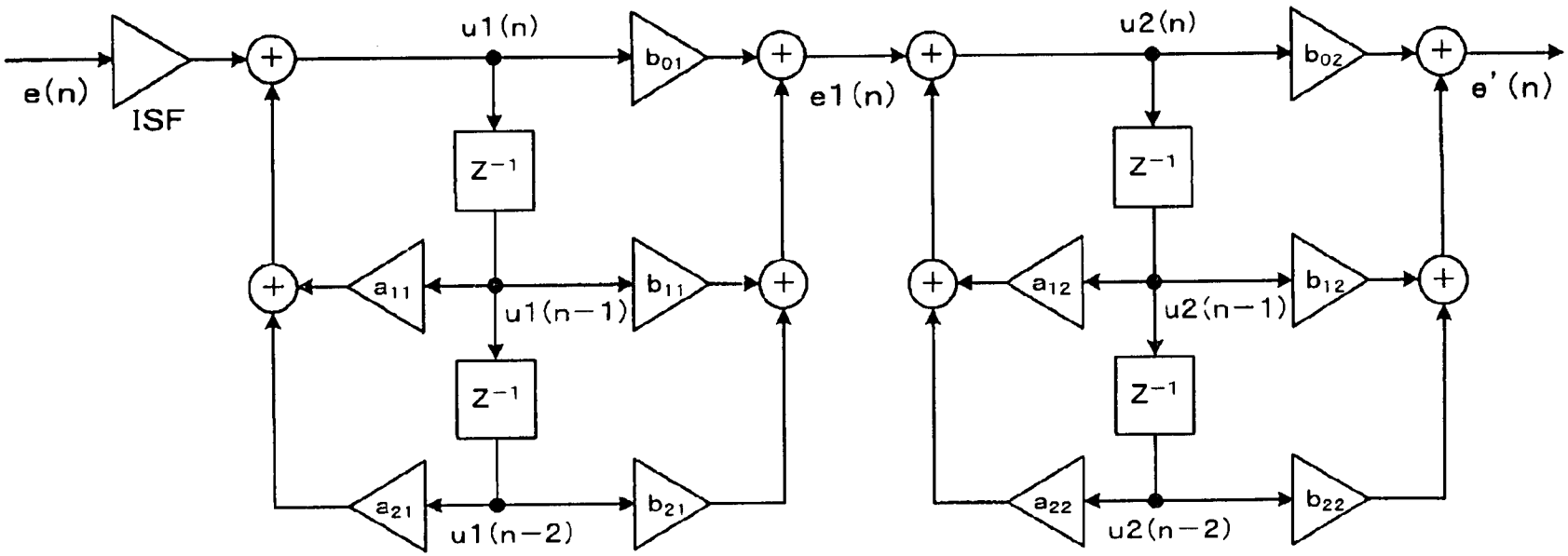
FIG. 10 is a block diagram of filter operation of the present embodiment.
Figures 11, 12:
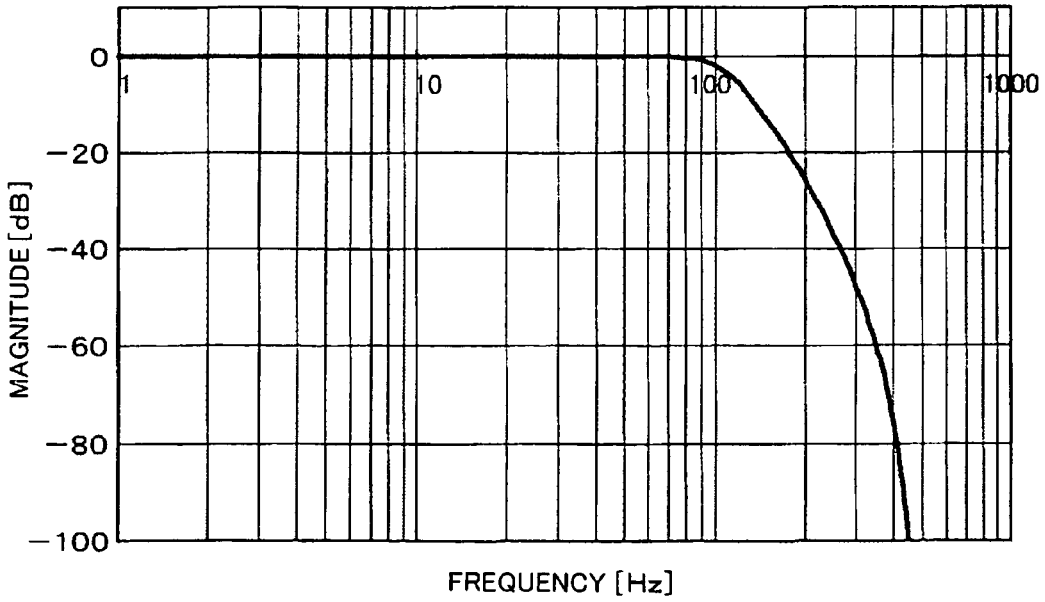
FIG. 11 is a diagram of a list of filter coefficients of the present embodiment.
FIG. 12 is a characteristic diagram of amplitude characteristics of the filter of the present embodiment.

The block diagram of this filter operation is shown in FIG. 10 and the filter coefficient list is shown in FIG. 11. This filter is double-cascade connected, and intermediate nodes on the stages are defined as u1(n), u1(n−1), u1(n−2), and u2(n), u2(n−1), and u2(n−2), where (n) is current sampling, (n−1) is previous sampling, and (n−2) is sampling before the previous sampling.

The CPU 601 executes the following program operation every interruption of the control cycle timer during execution of the feedback control.

$$u1(n)=a11^*u1(n-1)+a21^*u1(n-2)+e(n)^*ISF$$

$$e1(n)=b01^*u1(n)+b11^*u1(n-1)+b21^*u1(n-2)$$

$$u1(n-2)=u1(n-1)$$

$$u1(n-1)=u1(n)$$

$$u2(n)=a12*u2(n-1)+a22*u2(n-2)+e1(n)$$

$$e'(n)=b02*u2(n)+b12*u2(n-1)+b22*u2(n-2)$$

$$u2(n-2)=u2(n-1)$$

$$u2(n-1)=u2(n)$$

Figure 13:
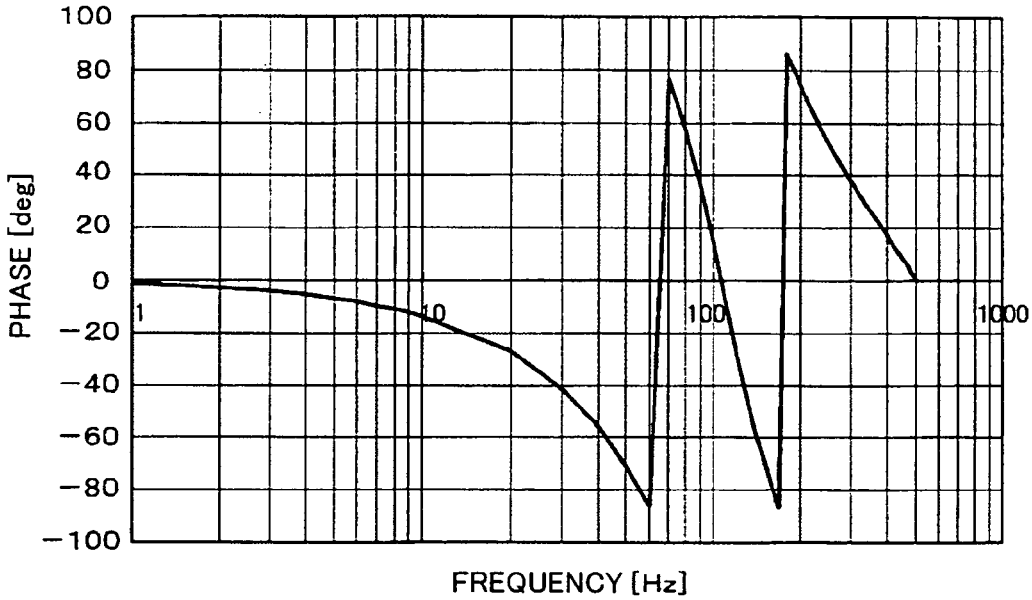
FIG. 13 is a characteristic diagram of phase characteristics of the filter of the present embodiment.

FIG. 12 depicts the amplitude characteristics of this filter, and FIG. 13 depicts the phase characteristics of this filter.

The CPU 601 calculates a control amount for a control target. As shown in FIG. 5, in the PID control at a proportional element 503 of the position controller 501, the CPU 601 calculates $$F(S)=G(S)*E'(S)=Kp*E'(S)+Ki*E'(S)/S+Kd*S*E'(S$$

where Kp is proportional gain, Ki is integral gain, and Kd is differential gain, $$G(S)=F(S)/E'(S)=Kp+Ki/S+Kd*S \quad (2)$$

Equation (2) is bilinearly transformed as $(S=(2/T)*(1-Z^{-1})/(1+Z^{-1}))$ and the following equation is obtained.

$$G(Z)=(b0+b1*Z^{-1}+b2*Z^{-2})/(1-a1*Z^{-1}-a2*Z^{-2})$$

where a1=0, a2=1, b0=Kp+T*Ki/2+2*Kd/T, b1=T*Ki−4*Kd/T, and b2=−Kp+T*Ki/2+2*Kd/T.

Figure 14:
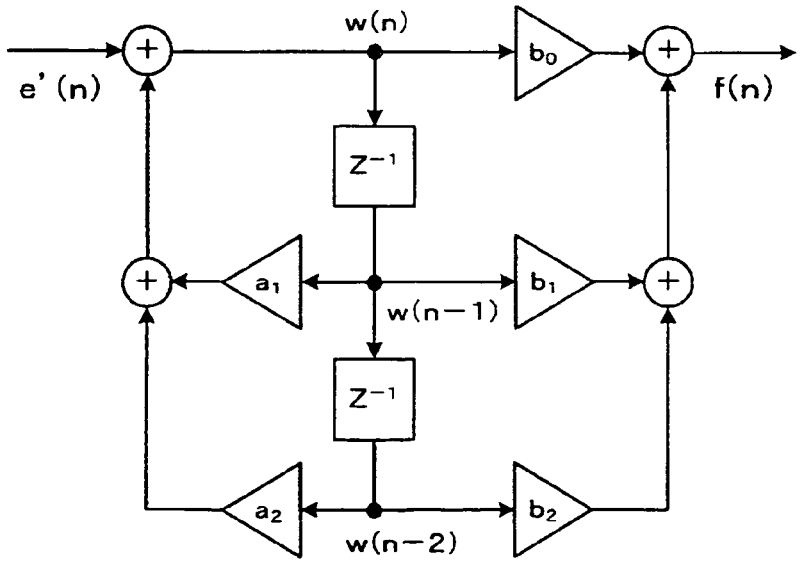
FIG. 14 is a diagram of a PID control equation according to the present embodiment.

The block diagram of Equation (3) is as shown in FIG. 14, where e'(n) and f(n) are discrete data of E'(S) and F(S). In FIG. 14, when middle nodes are defined as w(n), w(n−1), and w(n−2), the difference equation is as follows (general equation for PID control), where (n) is current sampling, (n−1) is previous sampling, and (n−2) is sampling before the previous sampling.

$$w(n)=a1*w(n-1)+a2*w(n-2)+e'(n) \quad (4)$$

$$f(n)=b0*w(n)+b1*w(n-1)+b2*w(n-2) \quad (5)$$

Considering the proportional control in the proportional element 503 of the position controller 501, the integral gain and the differential gain become zero. Therefore, the coefficients in FIG. 14 become as follows, and Equations (4) and (5) are simplified as Equation (6).

$$a1=0$$

$$a2=1$$

$$b0=Kp$$

$$b1=0$$

$$b2=-Kp$$

$$w(n)=w(n-2)+e'(n)$$

$$f(n)=Kp*w(n)-Kp*w(n-2)\rightarrow\therefore f(n)=Kp*e' \quad (6)$$

The discrete data f0(n) corresponding to F0(S) is constant according to the present embodiment, and $$f0(n)=6105\ [\mathrm{Hz}].$$

Therefore, the pulse frequency to be set for the motor 302 is calculated by $$f'(n)=f(n)+f0(n)=Kp*e'(n)+6105\ [\mathrm{Hz}] \quad (7)$$

Figure 15:
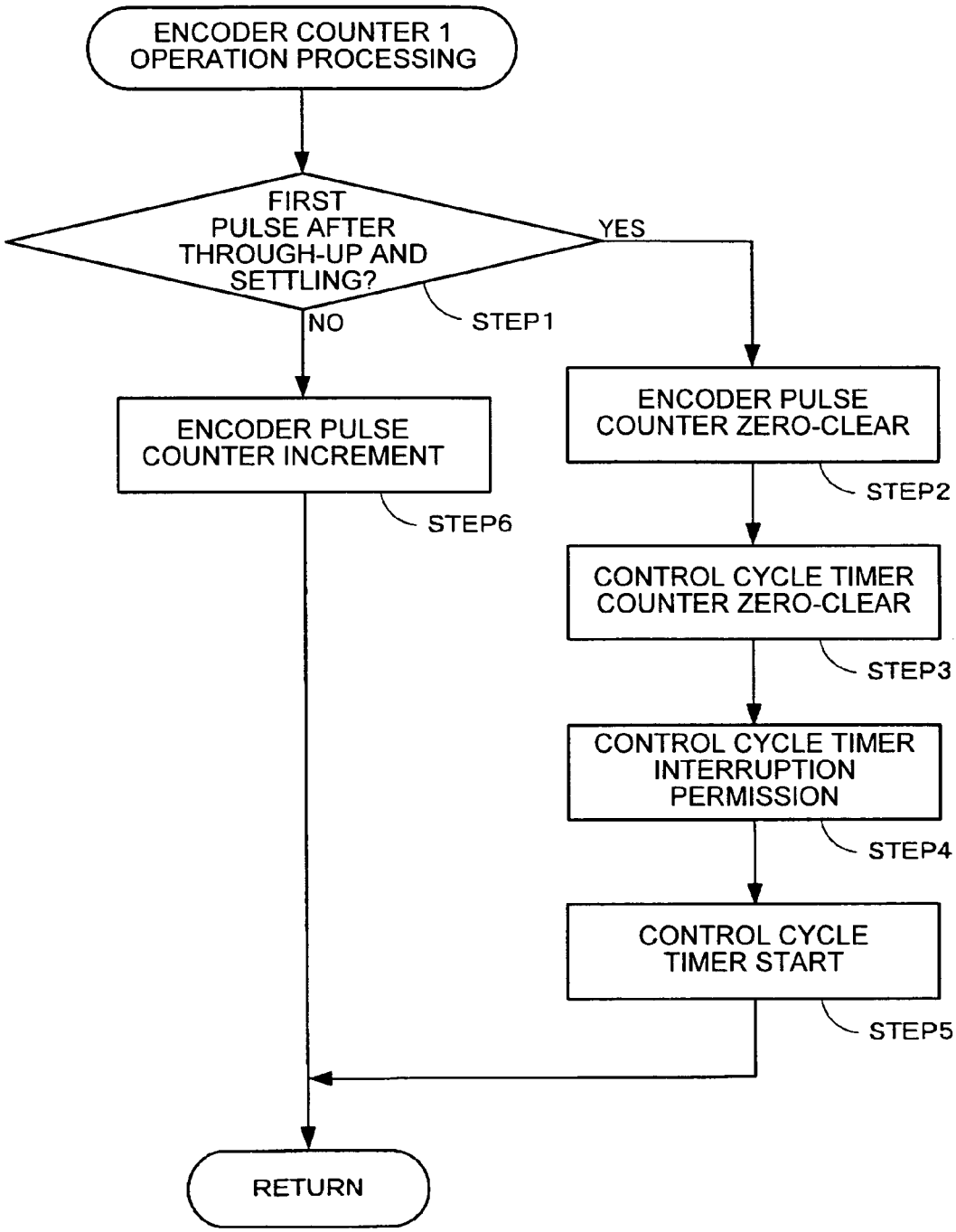
FIG. 15 is a flowchart of an operation flow of an encoder pulse counter 1 according to the present embodiment.

FIG. 15 is an operation flowchart of the encoder pulse counter 1. The detection IO unit 608 judges whether a pulse input from the encoder 301 is the first pulse input after through-up and settling of the motor 302 (STEP 1), and when the judgement is affirmative (YES), the encoder pulse counter 1 is cleared to zero (STEP 2), the control cycle counter is cleared to zero (STEP 3), interruption of the control cycle timer is permitted (STEP 4), the control cycle timer is started (STEP 5), and the process returns. The detection IO unit 608 increments the encoder pulse counter 1 when the judgement at the Step 1 is negative (NO) (STEP 6), and the process returns.

Figure 16:
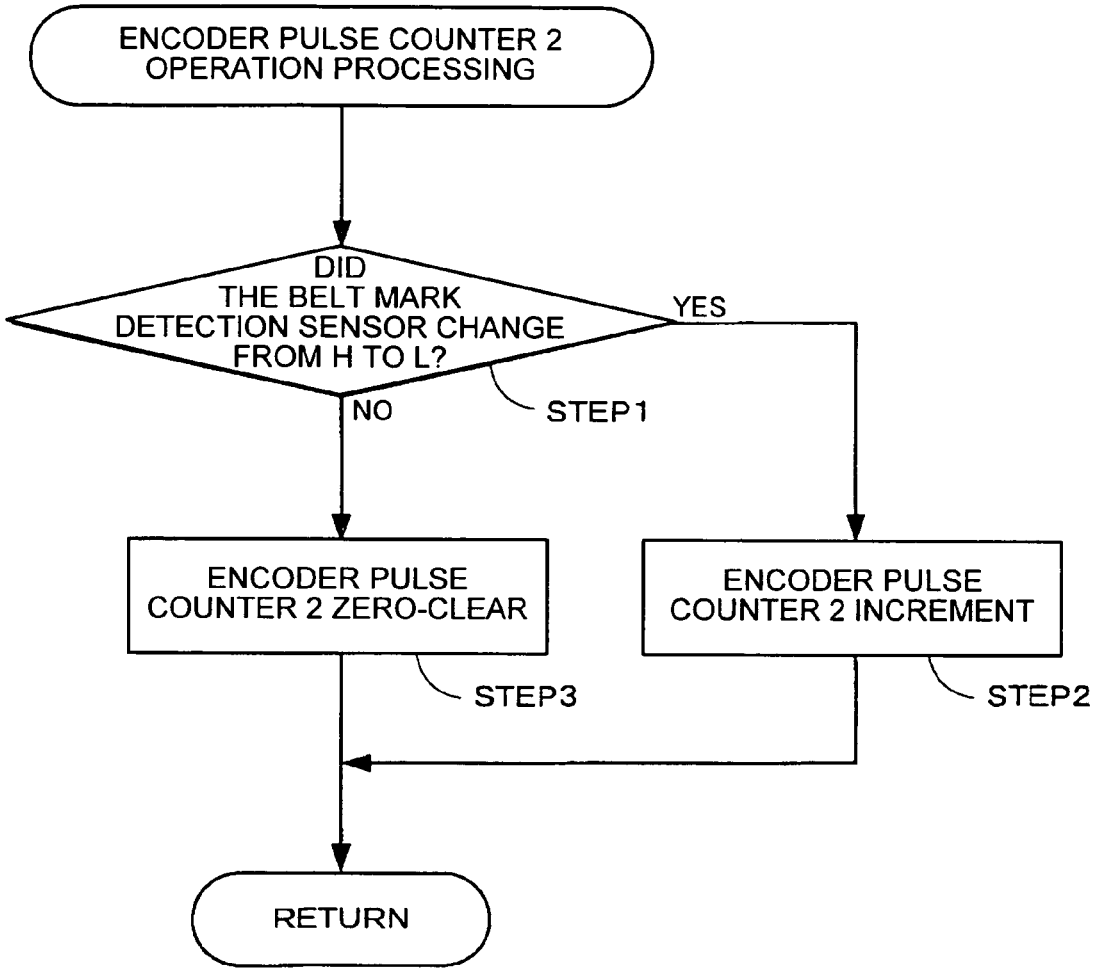
FIG. 16 is a flowchart of an operation flow of an encoder pulse counter 2 according to the present embodiment.

FIG. 16 is an operation flowchart of the encoder pulse counter 2. When a pulse is inputted from the encoder 301, the detection IO unit 608 judges whether the output of the mark sensor 305 has changed from a high level H to a low level L (STEP 1), and clears the encoder pulse counter 2 to zero when the judgement is YES (STEP 2). The detection IO unit 608 increments the encoder pulse counter 2 when the judgement at the STEP 1 is NO (STEP 3), and the process returns.

Figure 17:
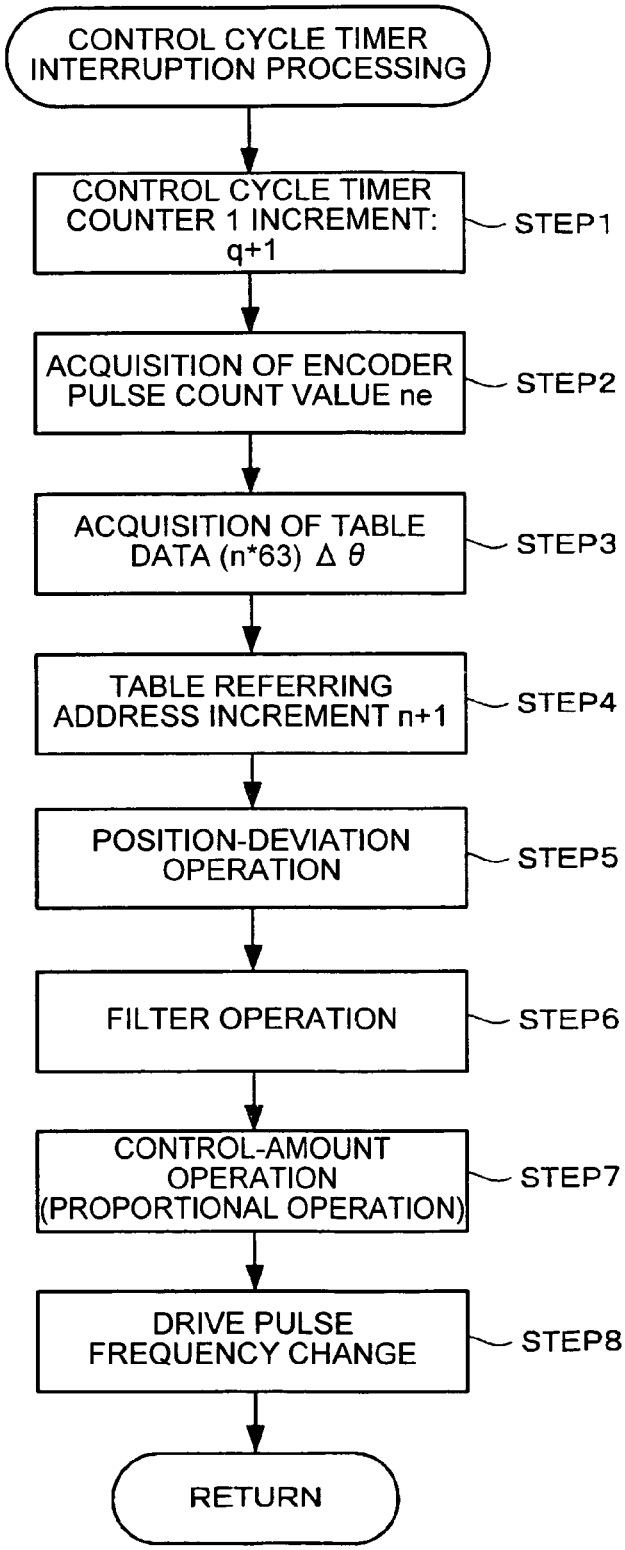
FIG. 17 is a flowchart of an interruption flow of a control cycle timer according to the present embodiment.

FIG. 17 is a flowchart of interruption of the control cycle timer. The detection IO unit 608 increments the control cycle timer counter (STEP 1), and acquires an encoder pulse count ne (STEP 2) The detection IO unit 608 further acquires Δθ by referring to table data based on the encoder pulse count ne (STEP 3), and increments the table referring address (STEP 4). The detection IO unit 608 performs operation to determine the position deviation as described above by using these values (STEP 5), applies filter operation as described above to the position deviation obtained through the operation (STEP 6), performs operation (proportional operation) of a control amount based on the results of the filter operation as described above (STEP 7), changes the actual frequency of the drive pulse of a stepping motor as the motor 302 (STEP 8), and then the process returns.

By this control, control to stabilize the speed fluctuation caused by the thickness of the transfer conveying belt 60 can be performed by an inexpensive method.

Figure 26:
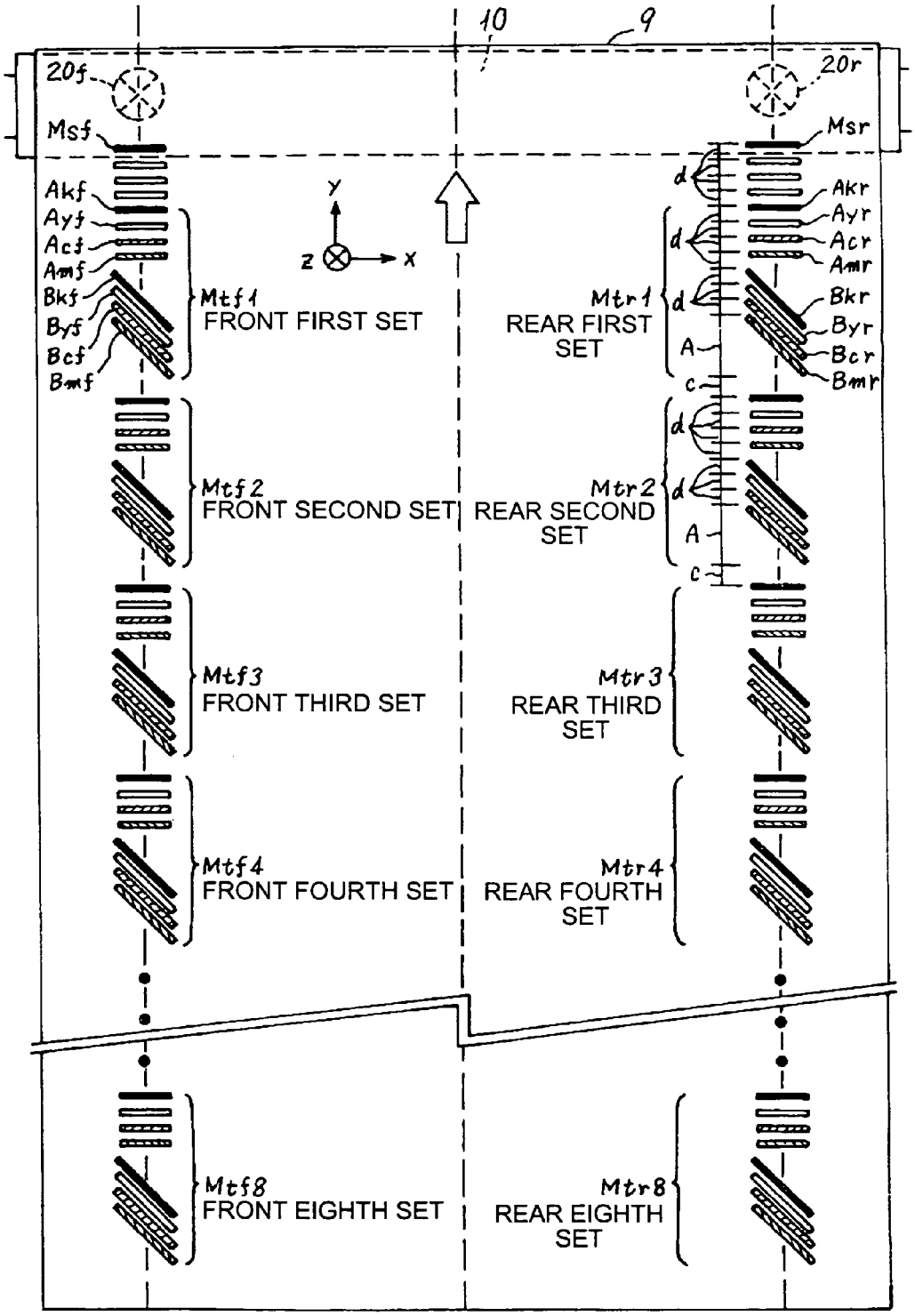
FIG. 26 is a plan view of the transfer conveying belt of the present embodiment.

As shown in FIG. 26, when performing "color pattern accordance," test patterns are formed on the transfer conveying belt 60 of the present embodiment. Namely, at the rear end in the width direction x orthogonal to the moving direction of the transfer conveying belt 60, a start mark Msr of black (Bk) in the lead and 8 mark sets Mtr1 through Mtr8 are successively formed at set pitches (fixed pitches) of 7*d*+A+c within one round length of the transfer conveying belt 60 after a blank corresponding to 4 pitches 4*d* of the mark pitches d.

In this laser printer, as a rear side test pattern, a start mark Msr and 8 mark sets Mtr1 through Mtr8 are formed within one round length of the rear of the transfer conveying belt 60, and the total number of marks of the start mark Msr and the 8 mark sets Mtr1 through Mtr8 is 65.

The first mark set Mtr1 includes, as an orthogonal mark group consisting of a mark group in parallel to the horizontal scanning direction x (width direction of the transfer conveying belt 60): a first orthogonal mark Akr in black (Bk), a second orthogonal mark Ayr in yellow (Y), a third orthogonal mark Acr in cyan (C), and a fourth orthogonal mark Amr in magenta (M), and as a diagonal mark group consisting of a mark group with 45 degrees from the horizontal scanning direction x: a first diagonal mark Bkr in Bk, a second diagonal mark Byr in Y, a third diagonal mark Bcr in C, and a fourth diagonal mark Bmr in M.

The marks Akr through Amr and Bkr through Bmr are arranged at mark pitches d in the vertical scanning direction (moving direction of the transfer conveying belt 60). The second through eighth mark sets Mtr2 through Mtr8 are the same as the first mark set Mtr1, and the mark sets Mtr1 through Mtr8 are arranged in the vertical scanning direction (moving direction of the transfer conveying belt 60) while leaving a blank c.

Likewise, at the front of the transfer conveying belt 60, the start mark Msf of Bk in the leading and eight mark sets Mtf1 through Mtf8 are successively formed at set pitches (fixed pitches) of 7*d*+A+c within one round length of the transfer conveying belt 60 after a blank corresponding to four pitches 4*d* of the mark pitch d.

In the laser printer of the present embodiment, the start mark Msf and eight mark sets Mtf1 through Mtf8 are formed within one round length of the transfer conveying belt 60 as a front side test pattern, and the total number of marks of the start mark Msf and the eight mark sets Mtf1 through Mtf8 is 65.

The first mark Mtf1 set includes, as an orthogonal mark group consisting of a mark group in parallel to the horizontal scanning direction x (width direction of the transfer conveying belt 60): a first orthogonal mark Akf in black (Bk), a second orthogonal mark Ayf in Y, a third orthogonal mark Acf in C, and a fourth orthogonal mark Amf in M, and as a diagonal mark group consisting of a mark group with 45 degrees from the horizontal scanning direction x: a first diagonal mark Bkf in Bk, a second diagonal mark Byf in Y, a third diagonal mark Bcf in C, and a fourth diagonal mark Bmf in M.

The marks Akf through Amf and Bkf through Bmf are arranged at mark pitches d in the vertical scanning direction (moving direction of the transfer conveying belt 60). The second through eighth mark sets Mtf2 through Mtf8 are the same as the first mark set Mtf1, and the mark sets Mtf1 through Mtf8 are arranged in the vertical scanning direction (moving direction of the transfer conveying belt 60) while leaving a blank c. "r" at the end of the symbols Msr, Akr through Amr, and Bkr through Bmr of the marks included in these test patterns means the rear side, and "f" at the end of the symbols Msf, Akf through Amf, and Bkf through Bmf of the marks included in these test patterns means the front side. The first mark set through the eighth mark set on the front and rear sides are called one mark set group.

Figure 37:
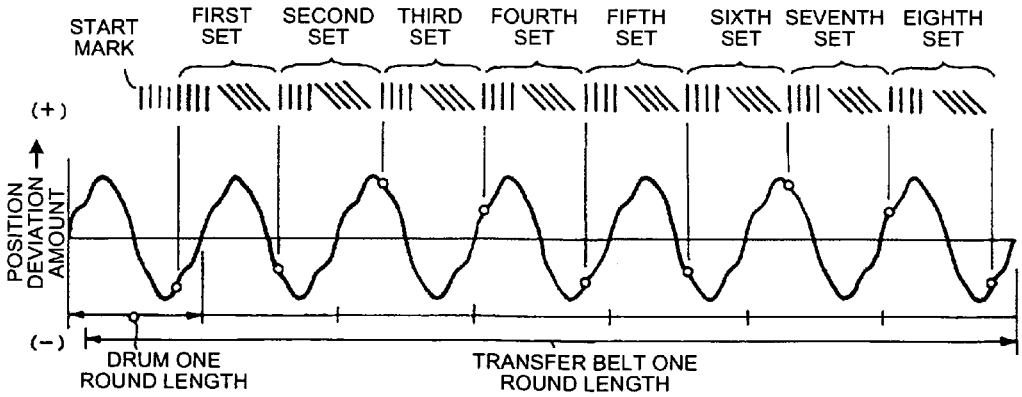
FIG. 37 is a diagram of distribution of a test pattern formed in one round length of the transfer conveying belt according to the present embodiment together with mark forming position deviations corresponding to the rotation angles of photoconductor drums.
Figure 39:
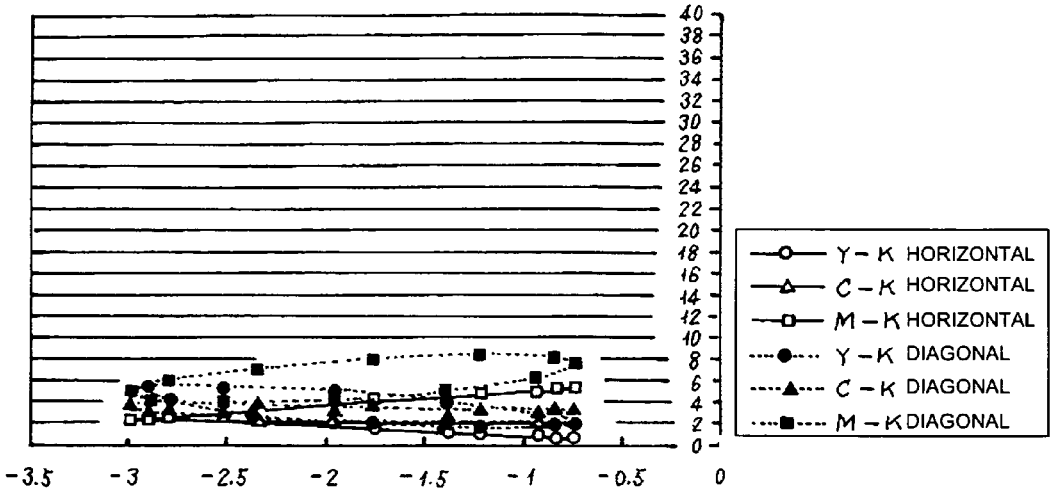
FIGS. 39 to 74 are diagrams of a part of second calculation results for determining mark arrangement of the present embodiment.
Figure 40:
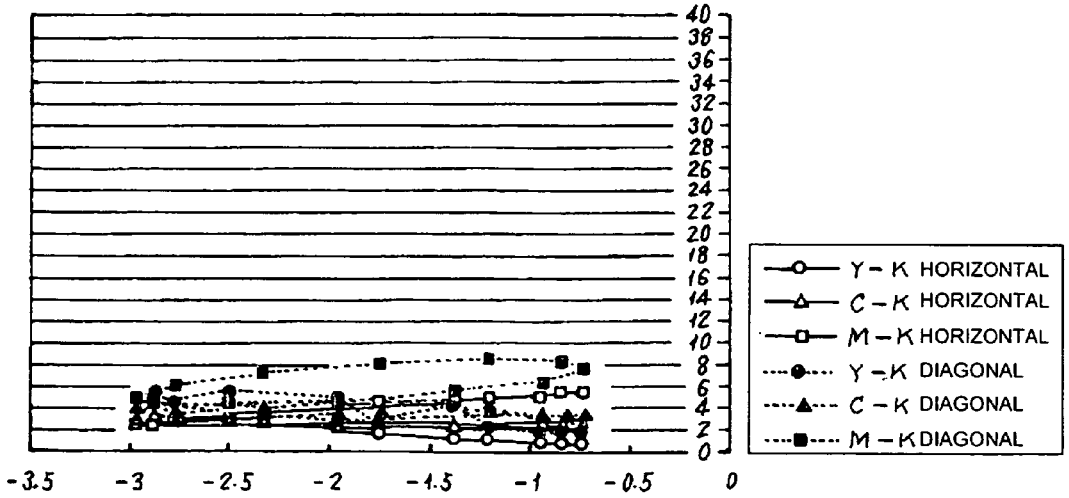
Figure 41:
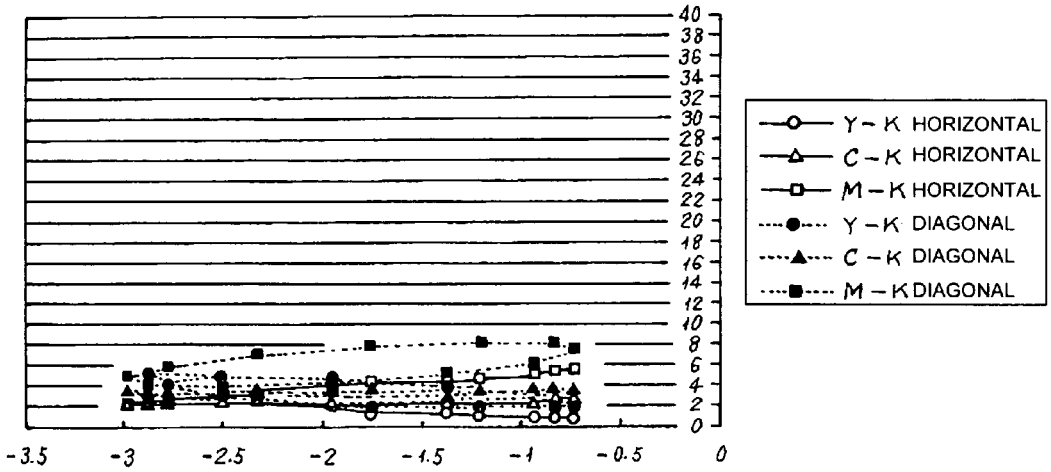
Figure 42:
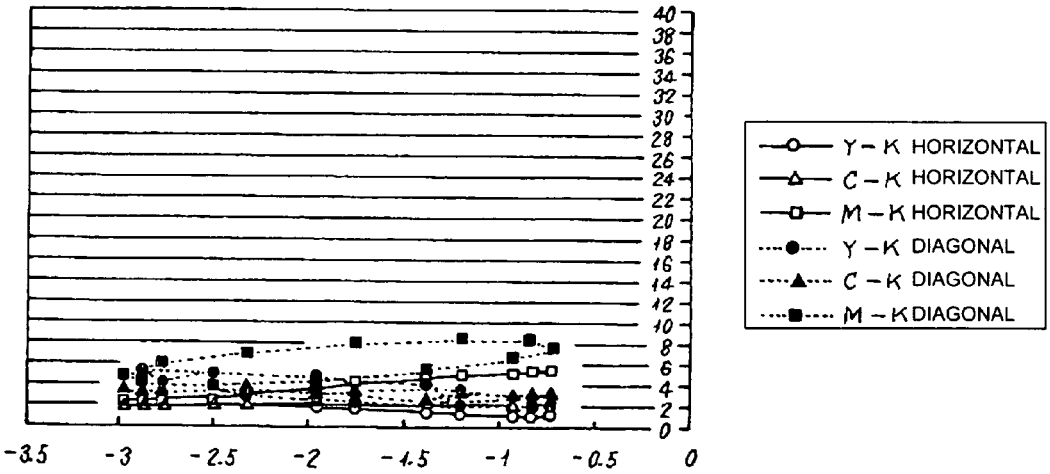
Figure 43:
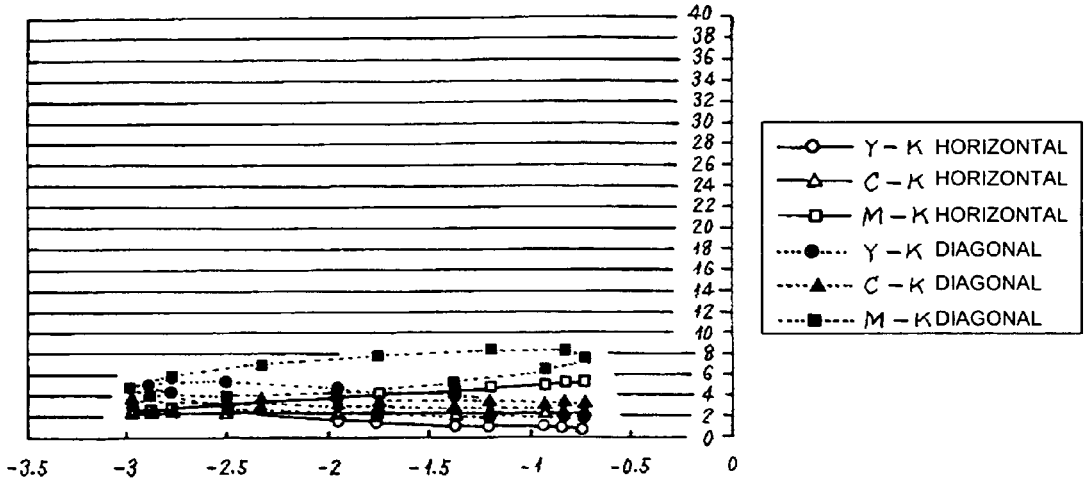
Figure 44:
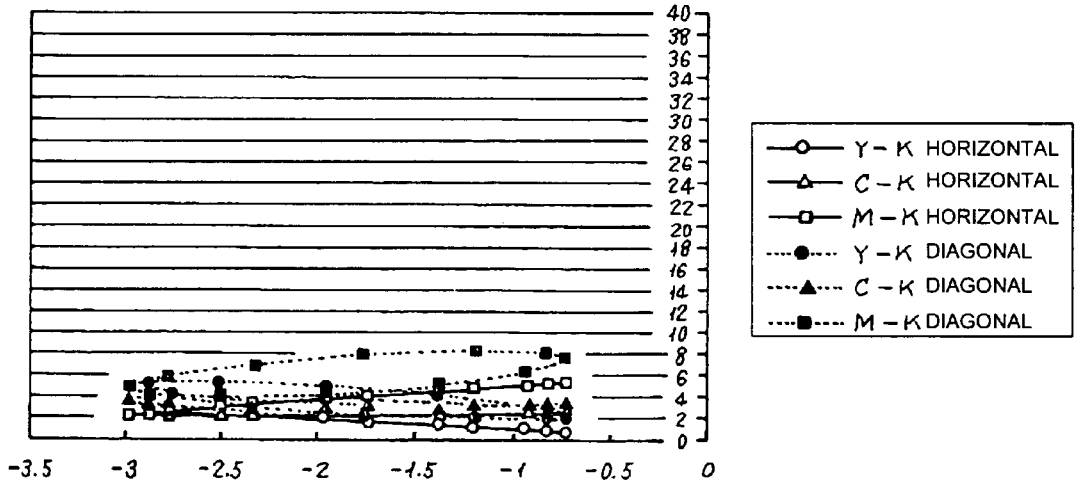
Figure 45:
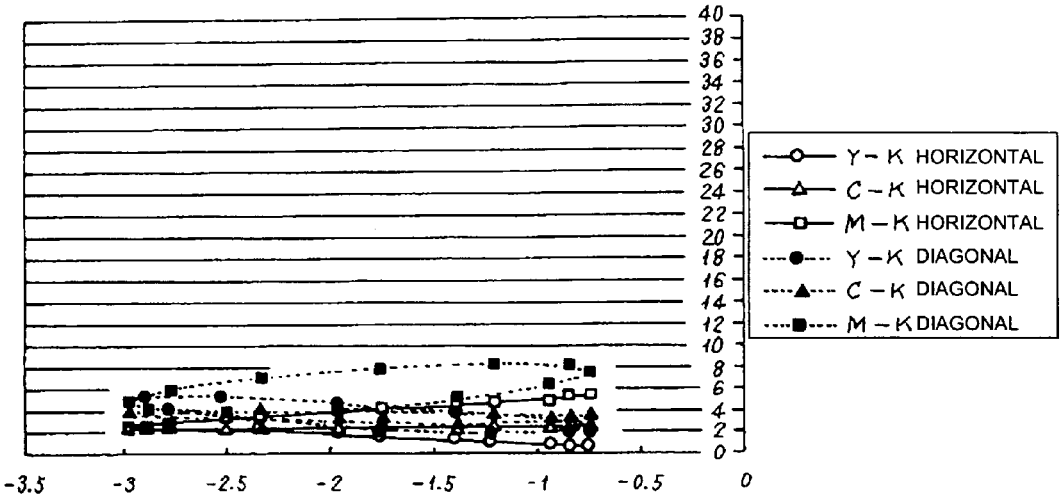
Figure 46:
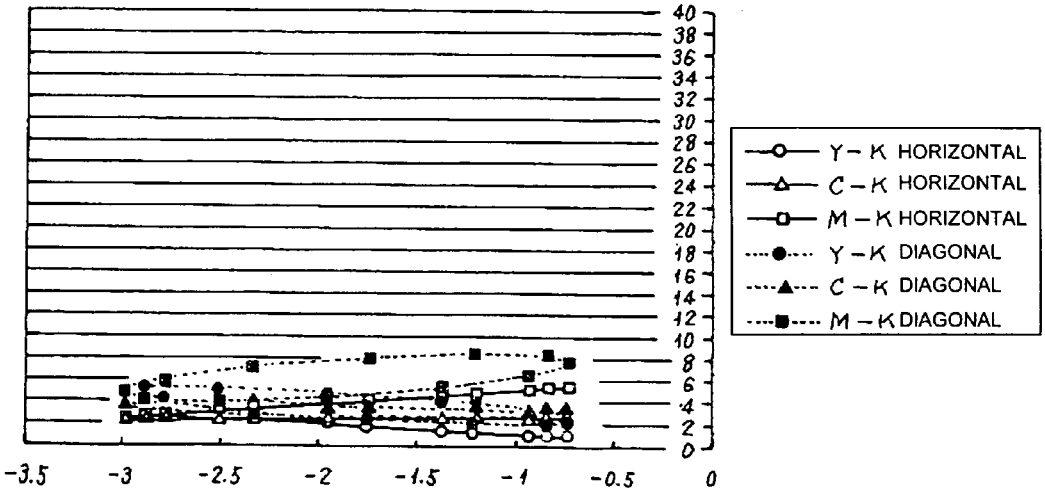
Figure 47:
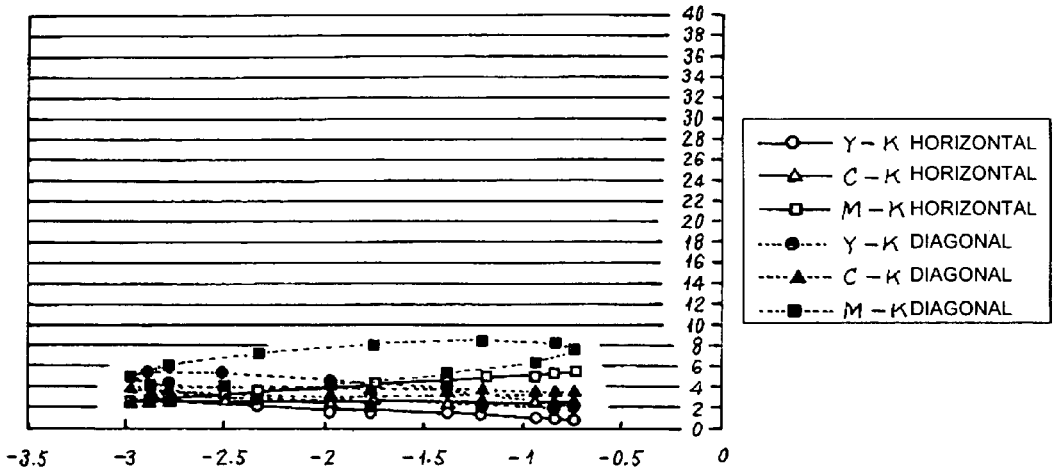
Figure 48:
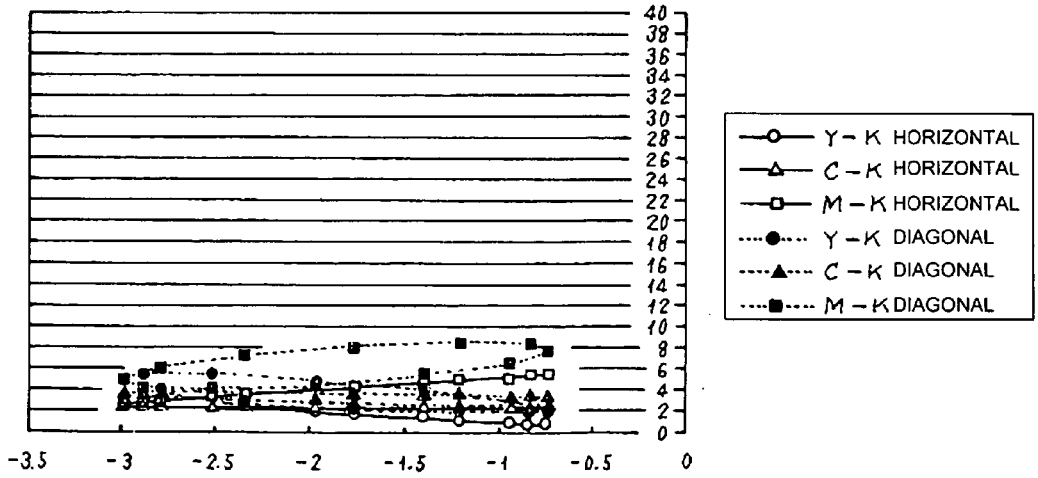
Figure 49:
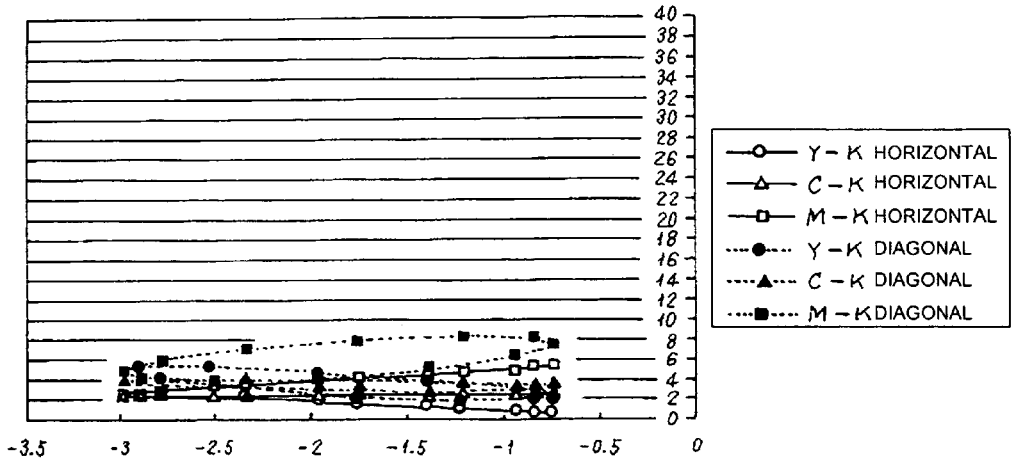
Figure 50:
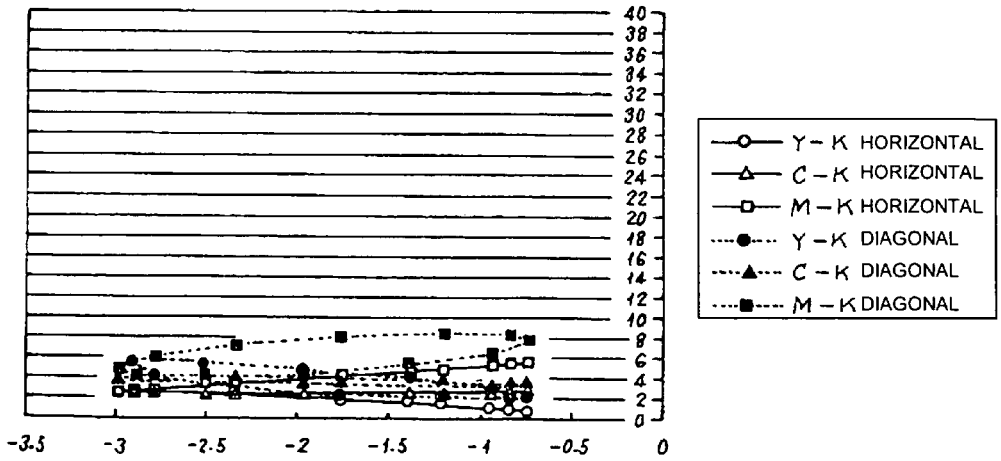
Figure 51:
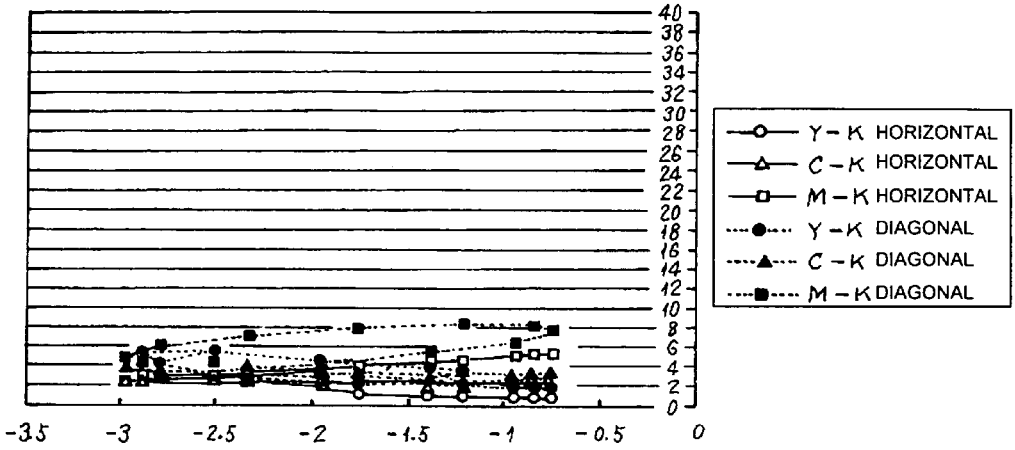
Figure 52:
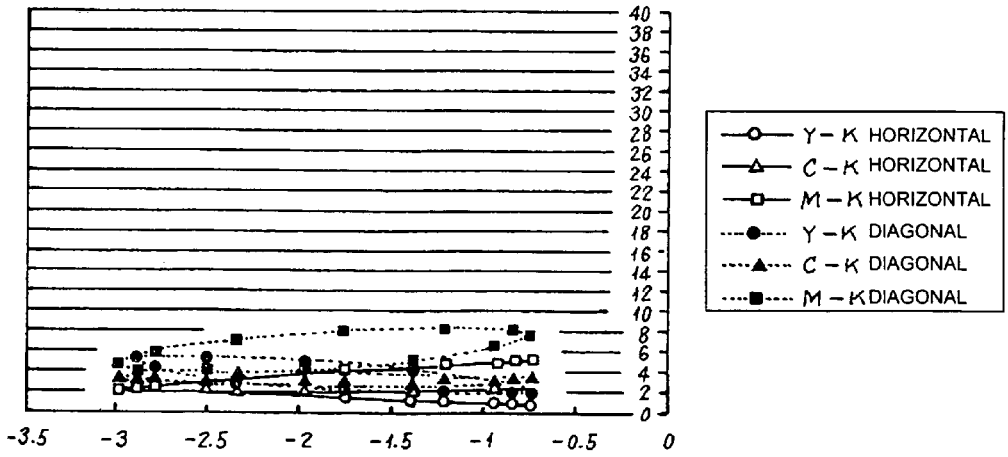
Figure 53:
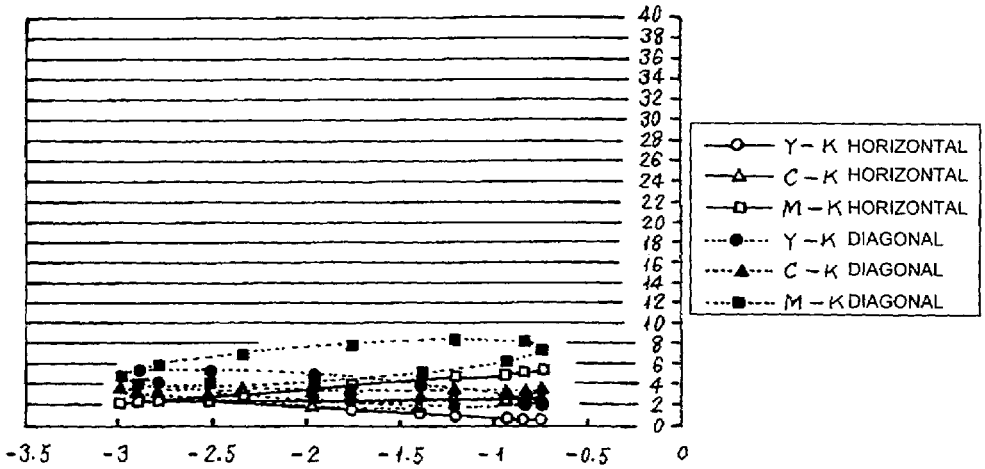
Figure 54:
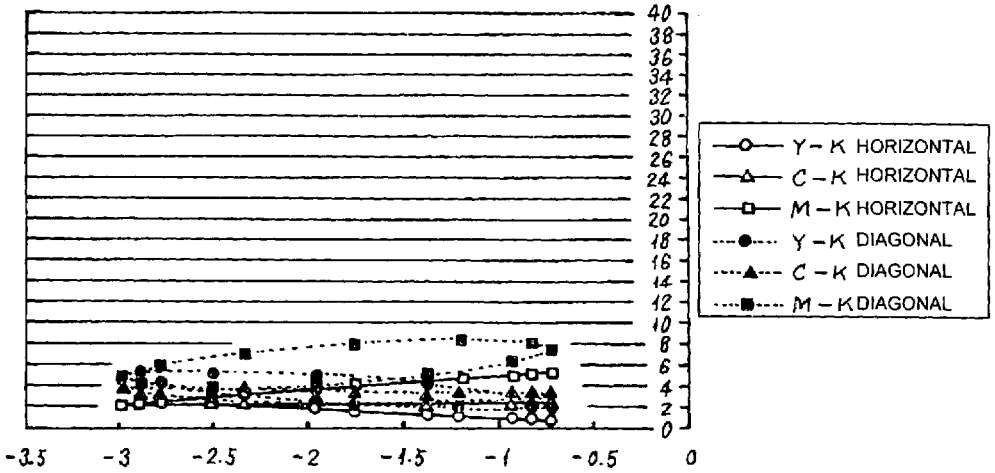
Figure 55:
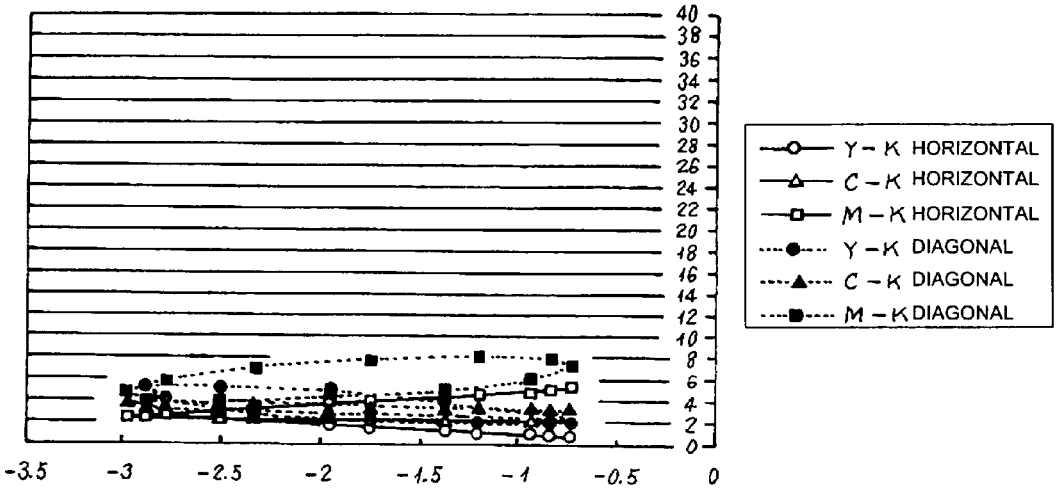
Figure 56:
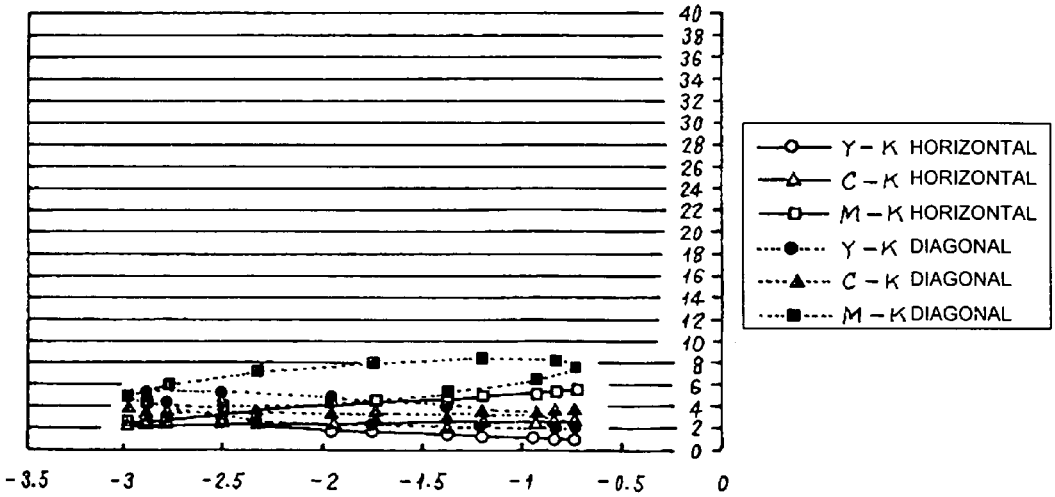
Figure 57:
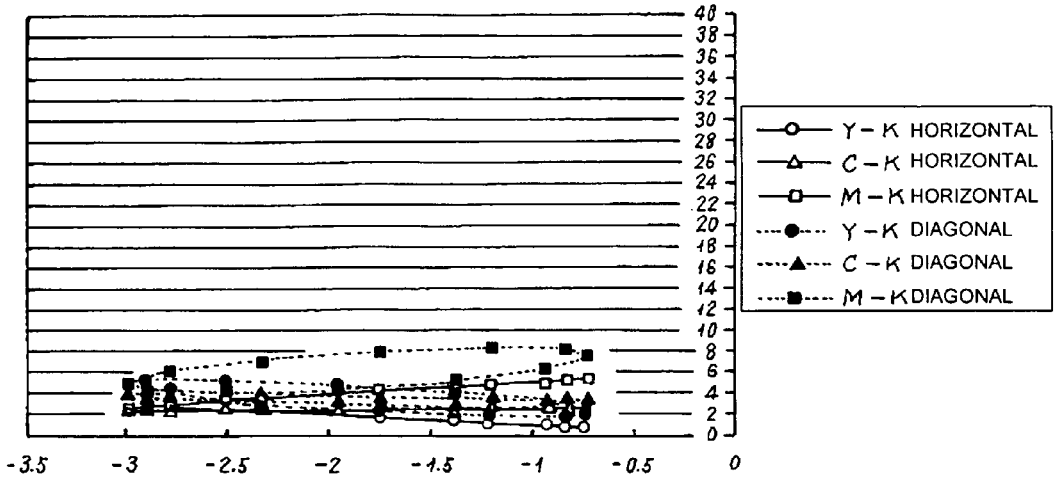
Figure 58:
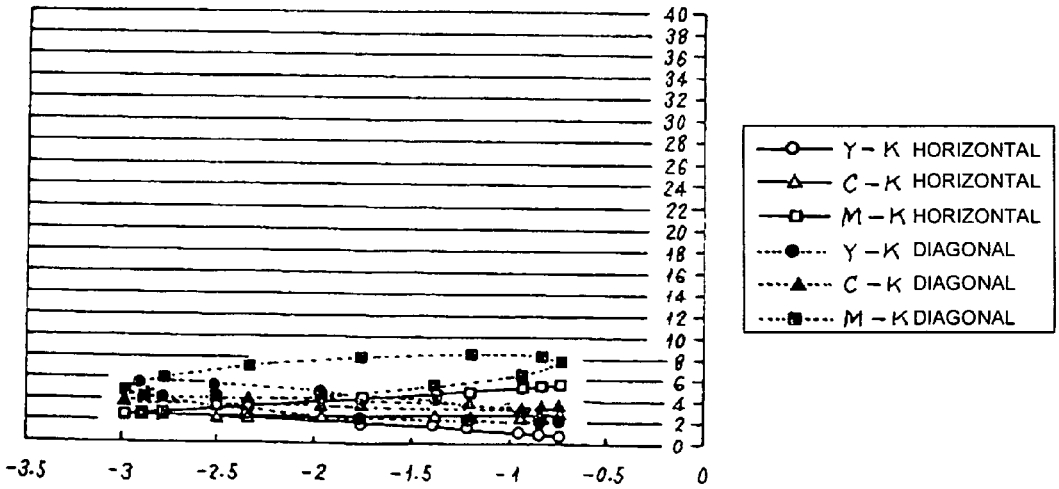
Figure 59:
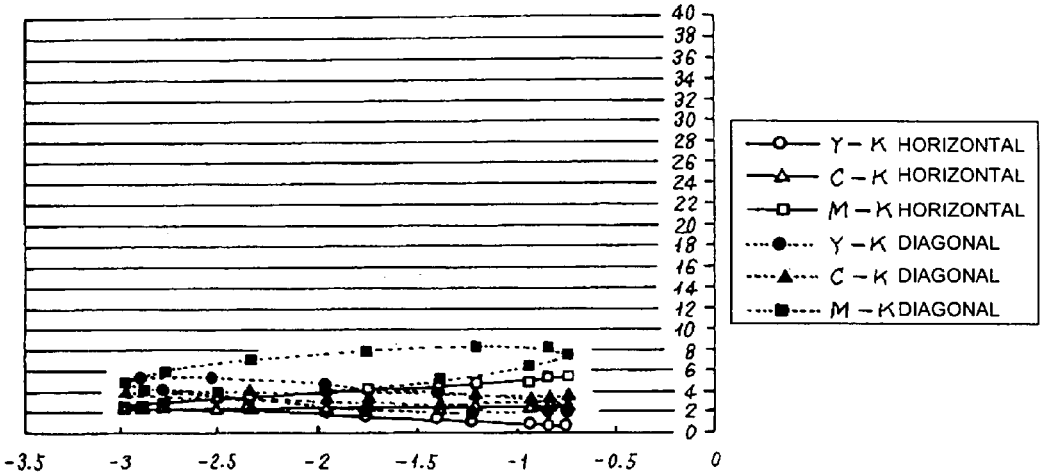
Figure 60:
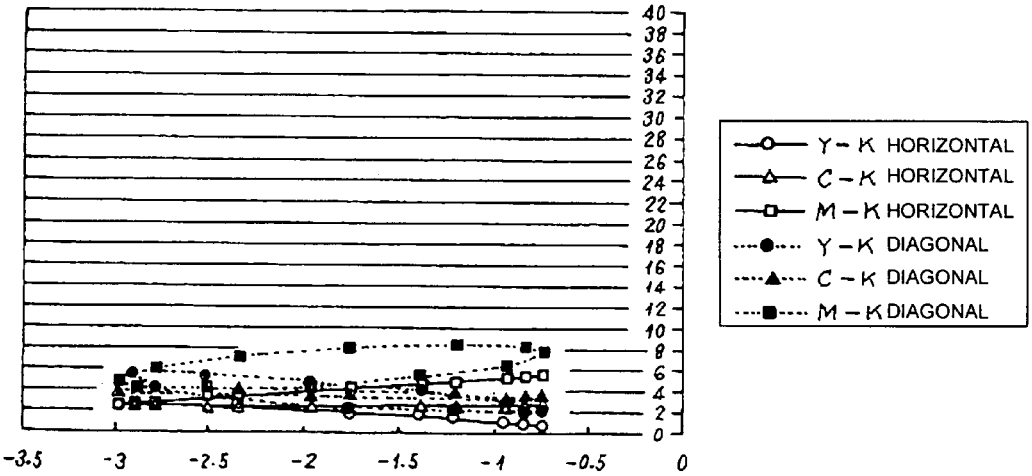
Figure 61:
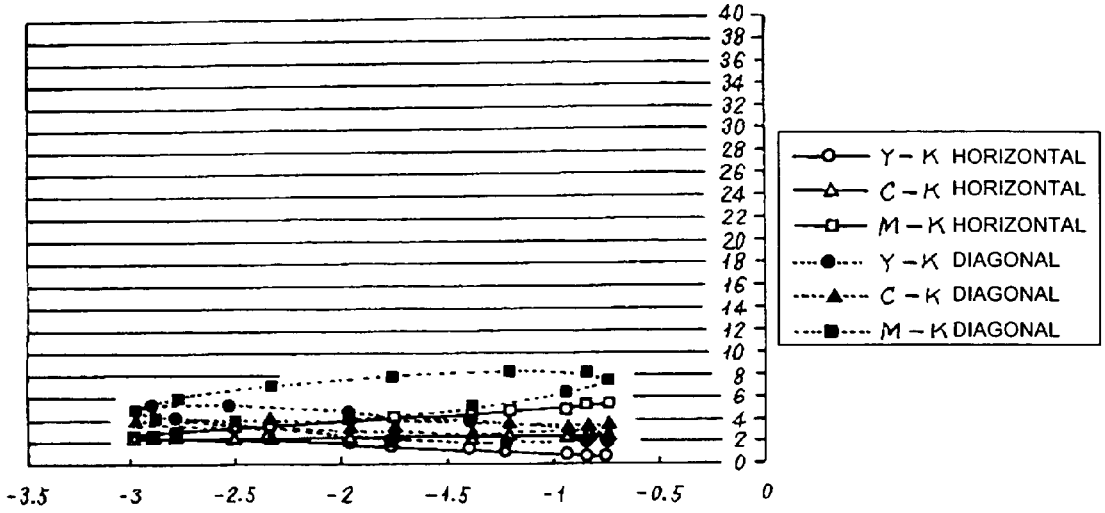
Figure 62:
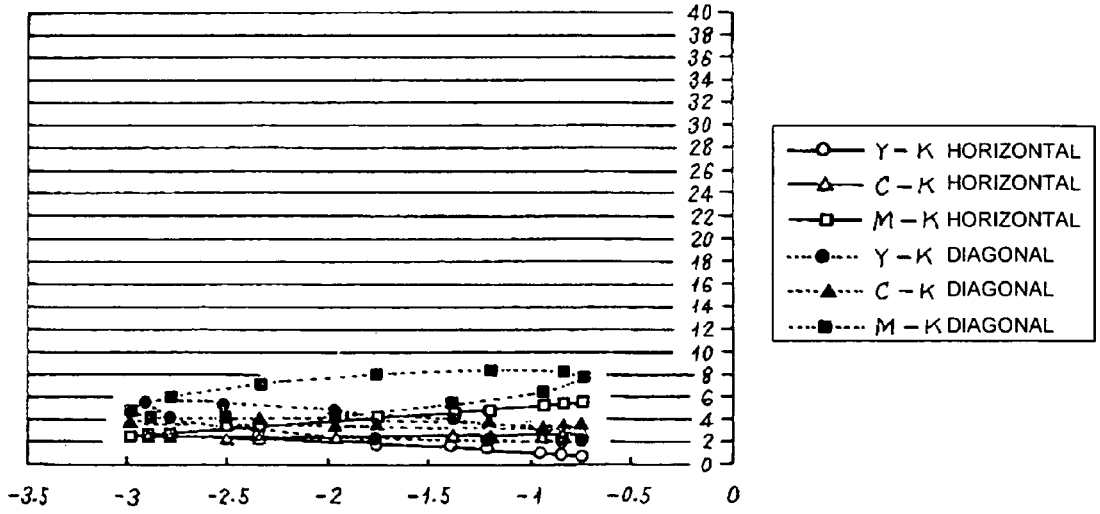
Figure 63:
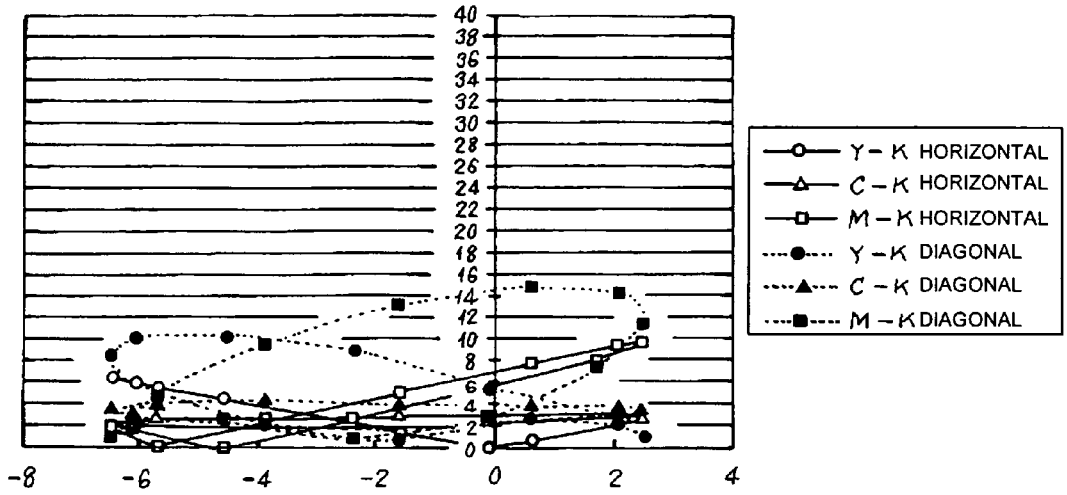
Figure 64:
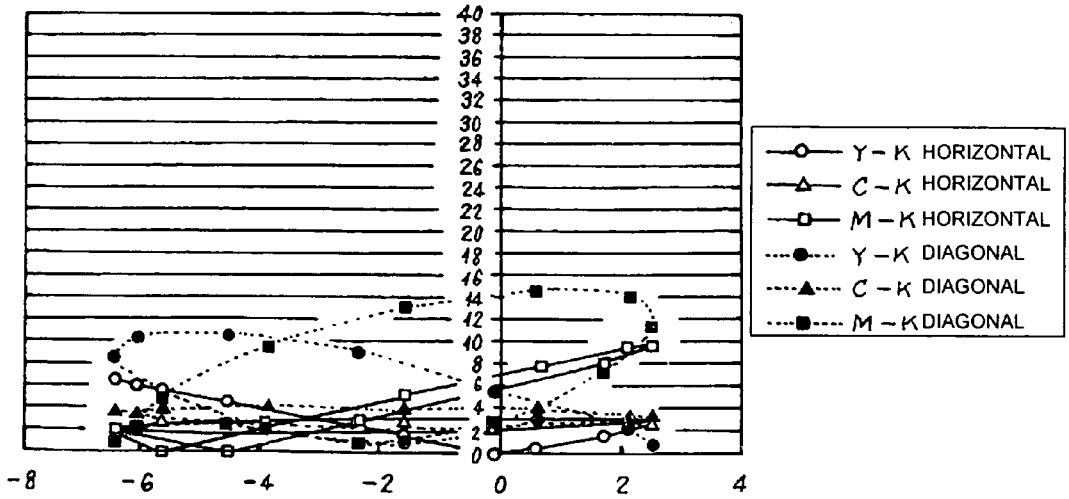
Figure 65:
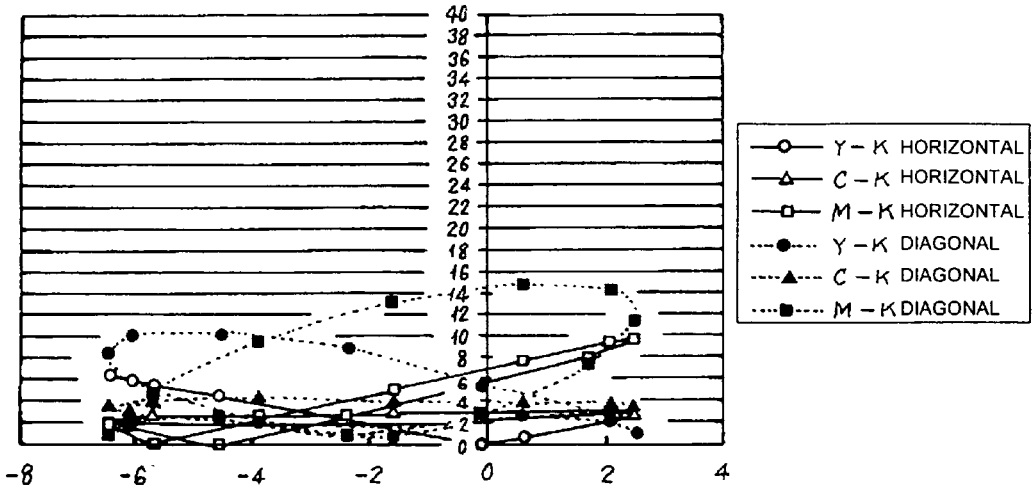
Figure 66:
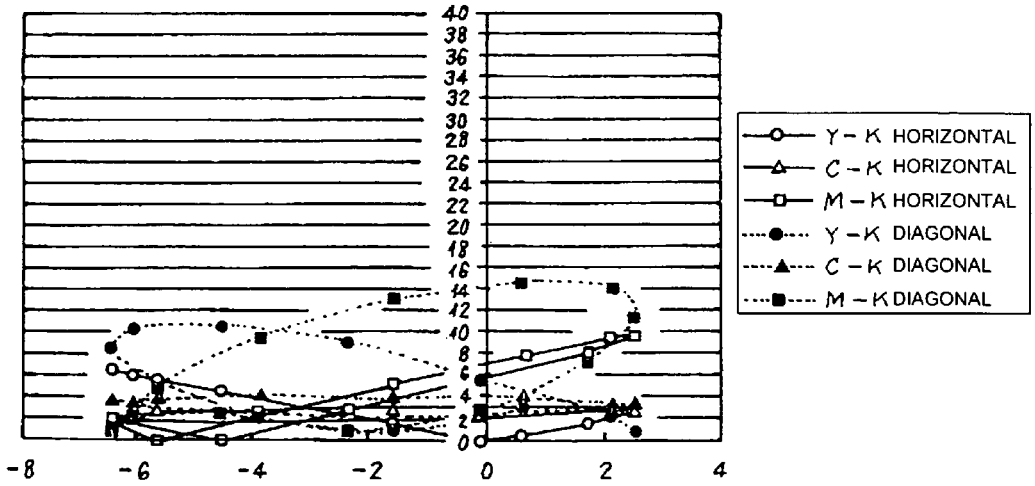
Figure 67:
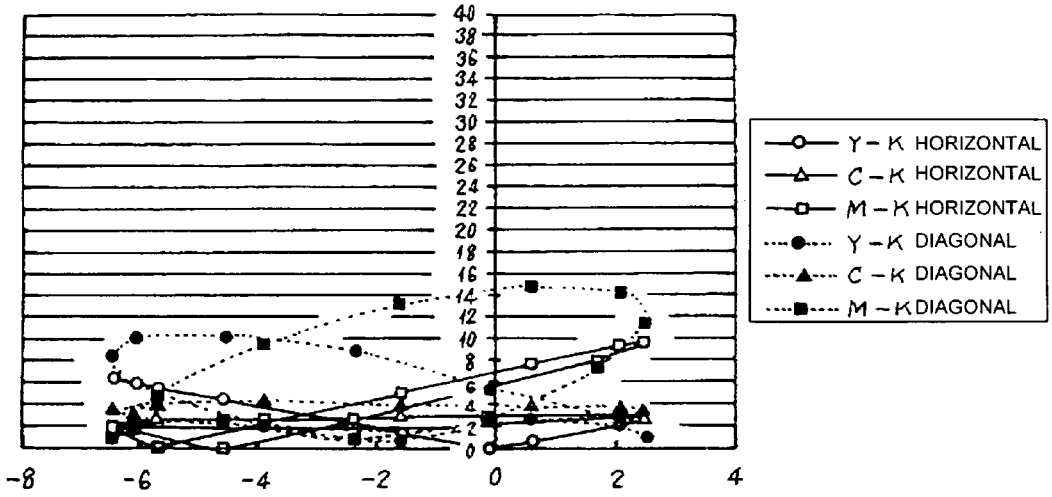
Figure 68:
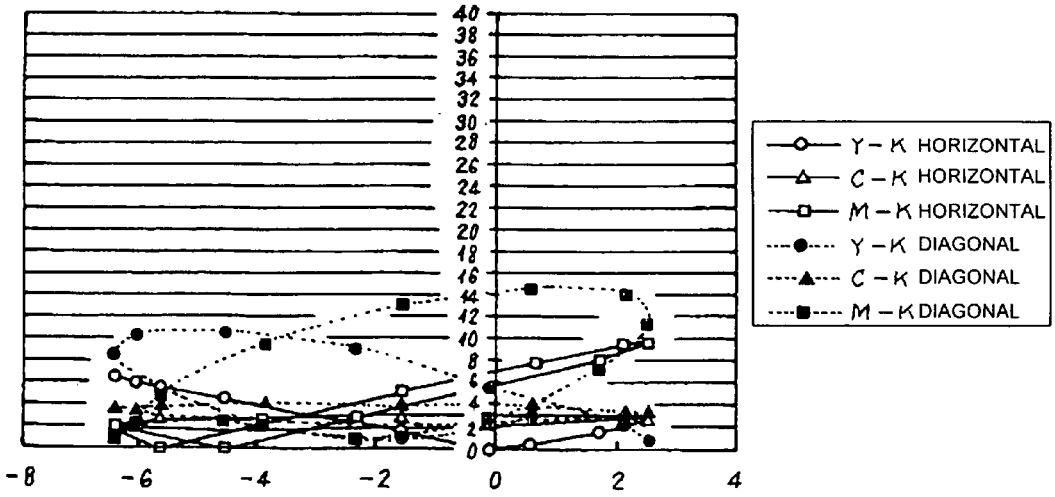
Figure 69:
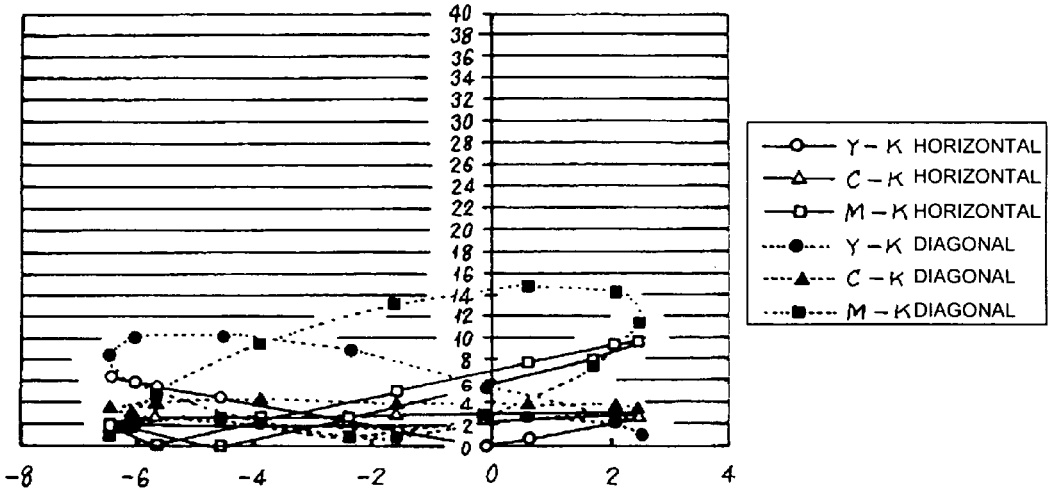
Figure 70:
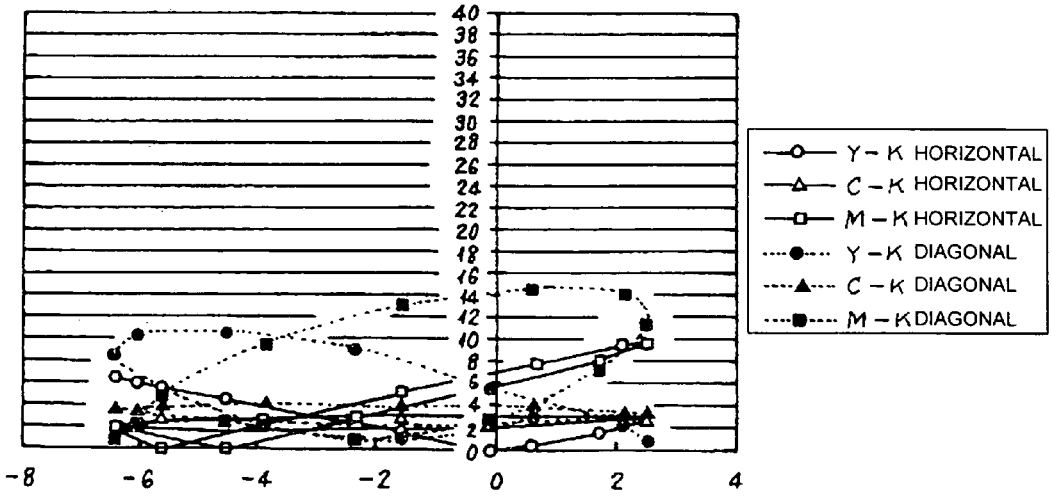
Figure 71:
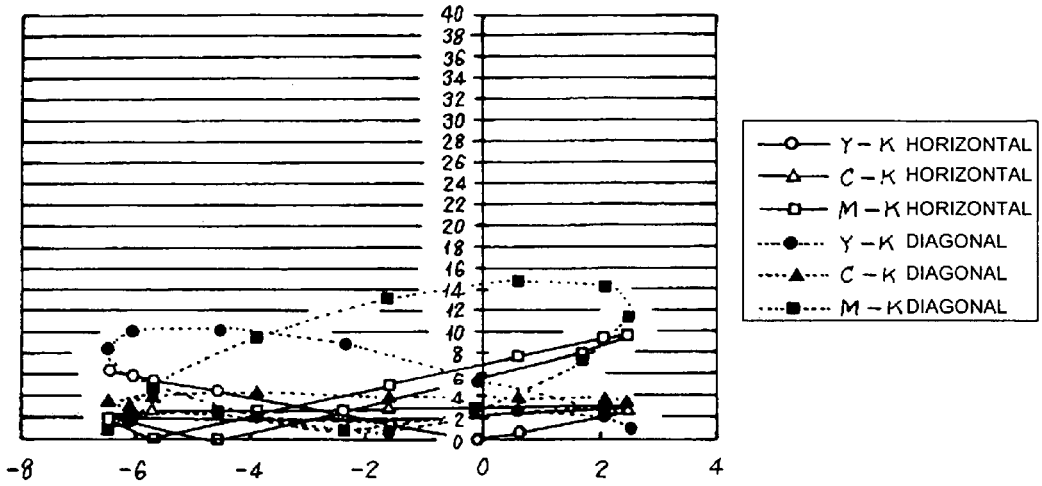
Figure 72:
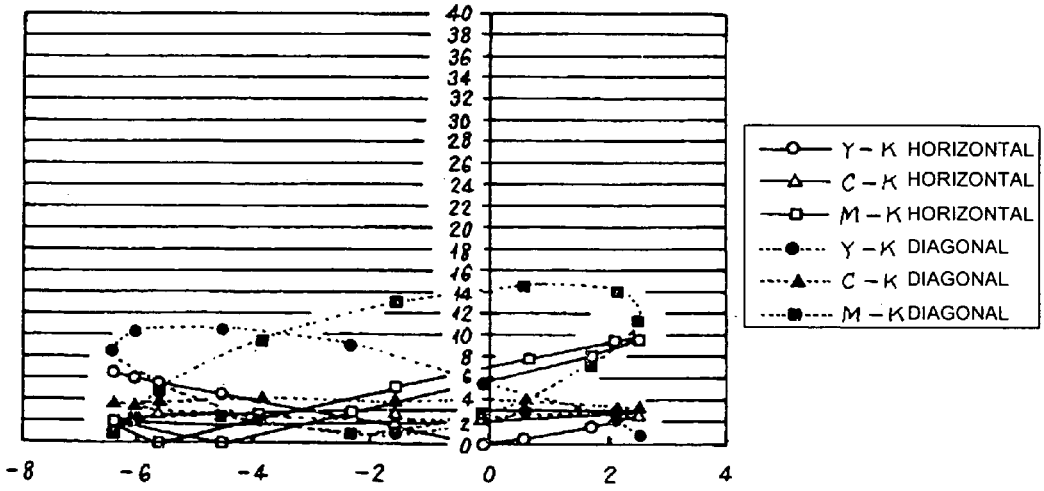
Figure 73:
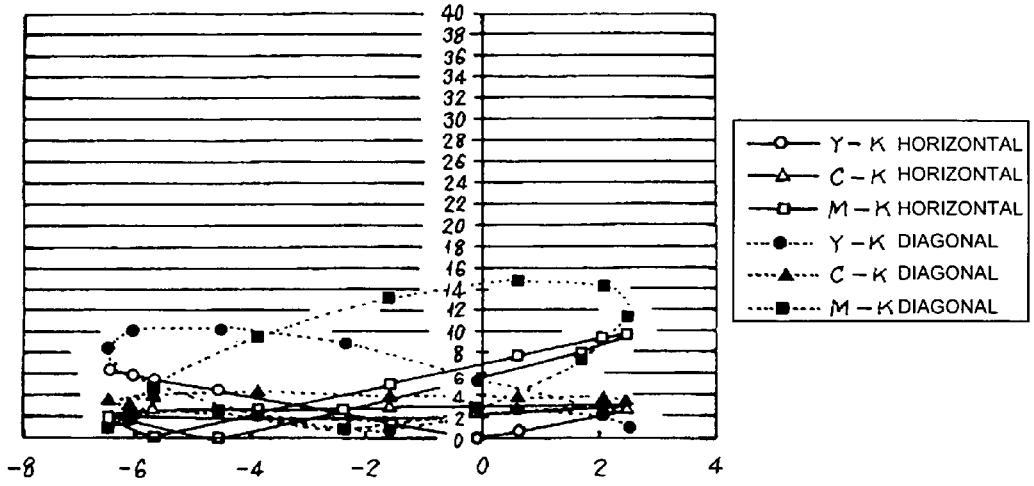
Figure 74:
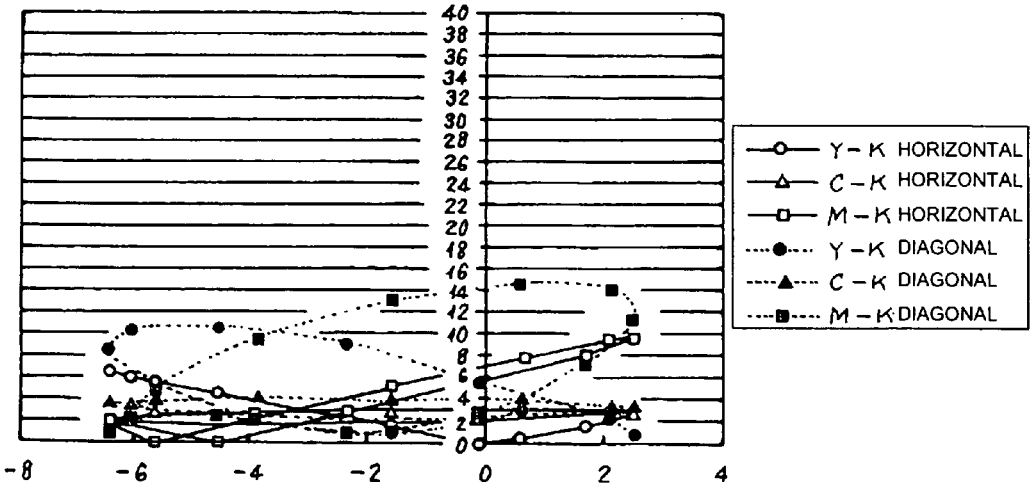

FIG. 37 depicts an example of linear development of deviations of the mark forming positions with respect to the reference position due to deviations of the circumferential surfaces of the photoconductor drums 11*k*, 11*y*, 11*c*, and 11*m*, one round length of the transfer conveying belt 60, and the mark sets to be transferred onto the transfer conveying belt from the photoconductor drums 11*k*, 11*y*, 11*c*, and 11*m*. In this laser printer, a length of approximately seven rounds of the photoconductor drums 11*k*, 11*y*, 11*c*, and 11*m* correspond to one round length of the transfer conveying belt 60, and the eight mark sets of the rear and front sides are transferred onto the transfer conveying belt 60 from the photoconductor drums 11*k*, 11*y*, 11*c*, and 11*m* across the six rounds of the photoconductor drums 11*k*, 11*y*, 11*c*, and 11*m*. The start mark is formed previous to the eight mark sets, so that 65 marks in total of the start mark and the eight mark sets are formed on the front and rear across the seven rounds of the photoconductor drums. However, it is not always necessary to draw the eight mark sets across one round of the transfer conveying belt 60.

FIG. 37 explains what pattern arrangement can cancel the driving unevenness of fluctuation generated from the drive system in an easily understood manner, and depicts an example in which, in a synthesized wave composed of eight driving unevenness frequency waves (fluctuation components) generated from the drive system of the photoconductor drums 11*k*, 11*y*, 11*c*, and 11*m* as an image carrier drive system of this laser printer and the transfer conveying belt 60 drive system as a transfer drive system of the eight fluctuating components shown in FIG. 38, fluctuation components of seven driving unevenness frequencies are not provided with amplitudes, and only a fluctuation component of one driving unevenness fluctuation is provided with an amplitude.

The time of color shift correction is a waiting time for a customer, and as a matter of course, the shorter the time the better since the customer wants to reduce the toner consumption, and therefore, it is better to shorten the entire length of the eight mark sets as short as possible. However, in this case, it is required to be careful of the failures described later.

If only the entire length of the mark patterns is shortened, an erroneous correction amount is calculated due to one period fluctuation of the transfer conveying belt 60. Therefore, conventionally, it is difficult to shorten the mark pattern entire length.

According to the present embodiment, the one period fluctuation of the transfer conveying belt 60 can be eliminated, so that no failure occurs even when the entire length of the mark patterns is set shorter than the circumferential length of the transfer conveying belt 60.

Figure 79A:
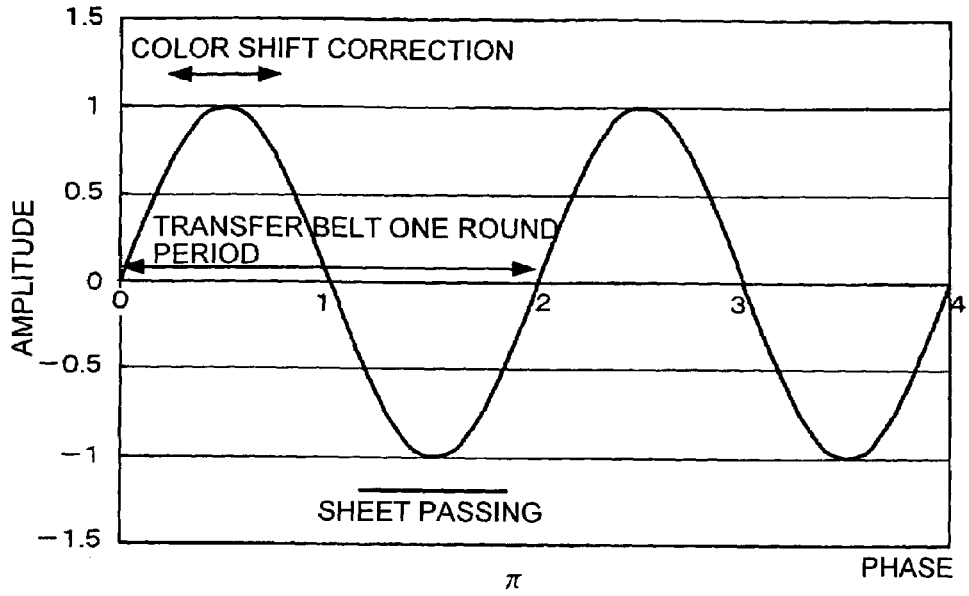
FIGS. 79A and 79B are diagrams of color shift correction execution timings and sheet passing timings during one round fluctuation of the transfer conveying belt of the present embodiment.

The failure is easily understood from FIG. 79A. In the case of FIG. 79A, color shift correction is performed at a point of a greatest positive fluctuation in the one round period of the transfer conveying belt 60. In this case, the transfer conveying belt 60 is judged as fast, and based on this, a correction value is determined. Therefore, if color shift correction is performed at a position of a greatest negative fluctuation in an image forming region when forming an image by using this correction value determined in this situation, the color shift becomes worst.

Figure 79B:
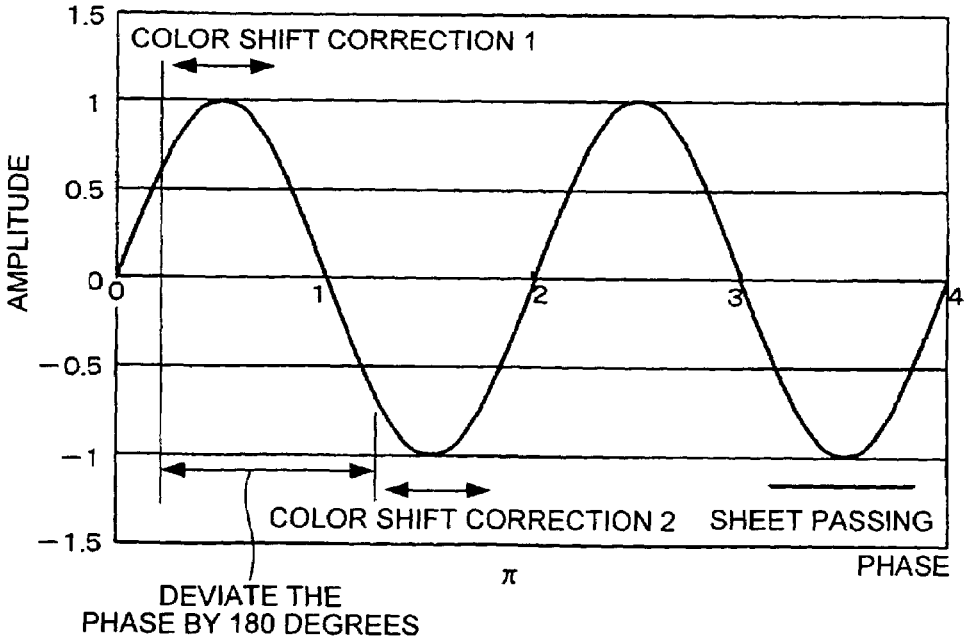
Figure 80:
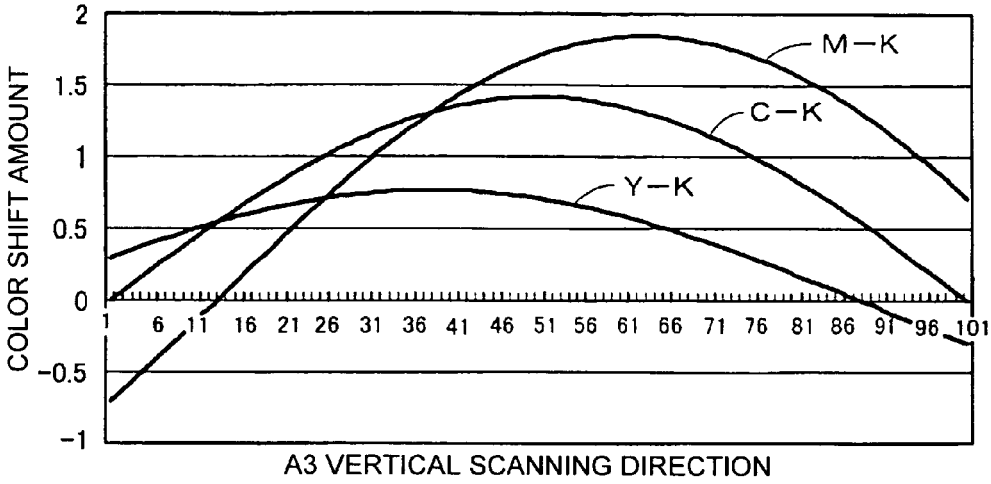
FIG. 80 is a diagram of transfer conveying belt position fluctuation (position deviation amounts) expressed by sine waves according to the present embodiment.

To avoid such a failure, in an embodiment of Japanese Patent Application No. 2004-161416, mark sets for color shift correction are arranged as shown in FIG. 79B. Namely, at least two or more mark set groups each including a predetermined number of marks are formed within one color shift correcting operation, and the mark sets are arranged so that the writing start timings at the intervals of the mark set groups shift their phases by 360 degrees/the number of mark set groups by targeting a wave of one round frequency lower than the frequency calculated from the length of the mark sets of all groups. Therefore, the color shift correction accuracies can be improved, and an increase in cost can be restrained. However, the mark pattern entire length needs a plurality of mark set groups, so that it becomes long.

In the calculation of a correction value to be finally reflected on the image forming, mark sets are arranged as shown in FIG. 79B, a correction amount to be used when forming an image is calculated based on (a+b)/2 from a correction amount a determined in color shift correction 1 and a correction amount b determined in color shift correction 2, that is, calculated values obtained from the mark sets are averaged to determine a correction amount to be used for image forming. For example, when color shift correction is performed four times, it is necessary that, from correction amounts a, b, c, and d determined in the four color shift corrections, (a+b+c+d)/4 is calculated to determine a correction amount to be used for image forming.

Thereby, the fluctuation of the one round period of the transfer conveying belt when correcting color shifts can be canceled, however, if the period unevenness due to the transfer conveying belt thickness fluctuation is eliminated, such calculation to determine a correction amount including the averaging also becomes unnecessary.

Figure 27:
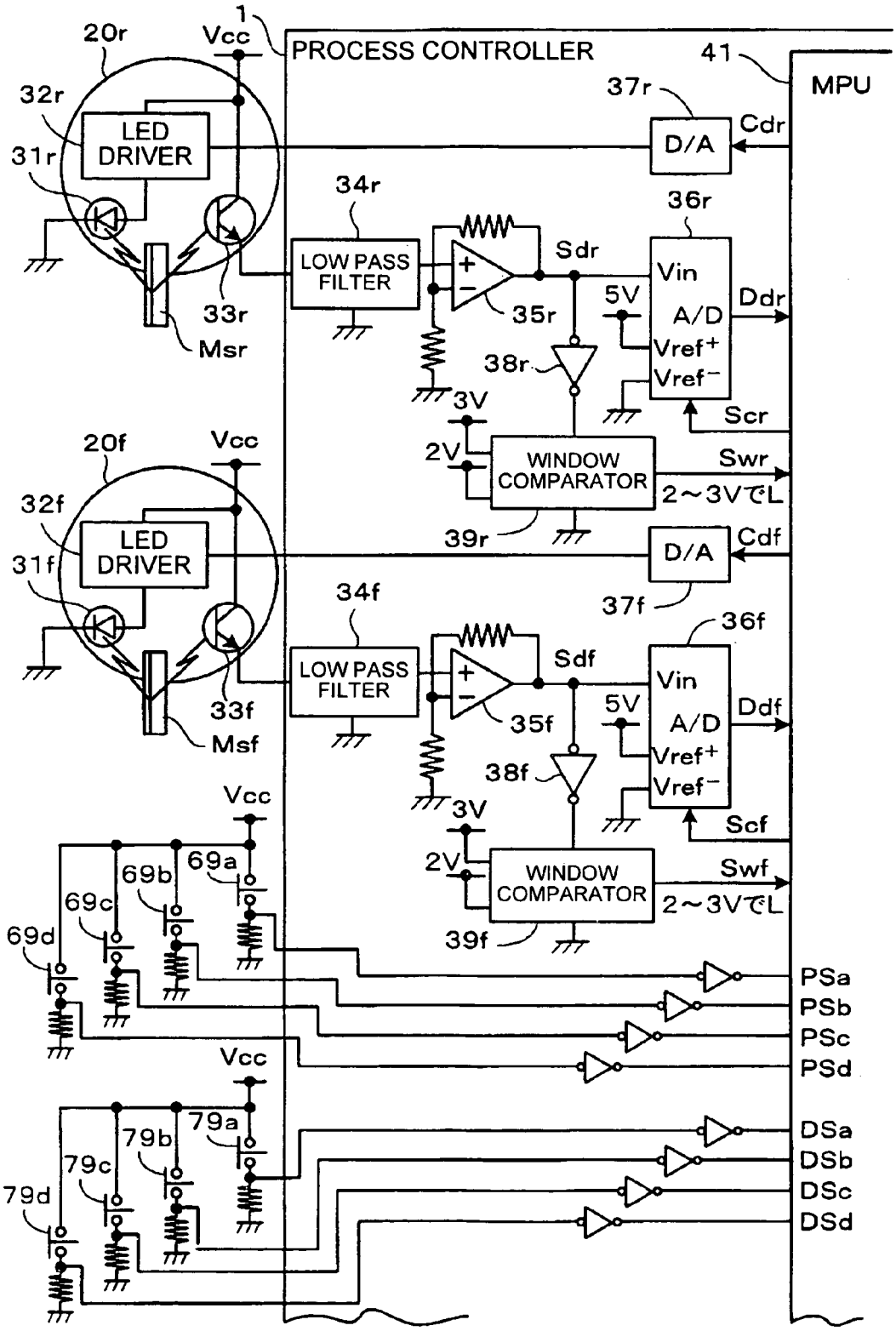
FIG. 27 is a block diagram of a part of a process controller of the present embodiment.

FIG. 27 depicts micro switches 69*a* through 69*d* and 79*a* through 79*d* and light sensors 20*r* and 20*f* for unit attachment detection and an electrical circuit that reads detection signals of these. At the mark detection stage, (CPU of) a microcomputer (hereinafter, referred to as MPU) 41 mainly including a ROM, a RAM, a CPU, and a detected data storing FIFO memory supplies D/A converters 37*r* and 37*f* with energization data that instructs energizing current values of light emitting diodes (LEDs) 31*r* and 31*f* of the light sensors 20*r* and 20*f*, and the D/A converters 37*r* and 37*f* convert the data into analog voltages and applies the voltages to LED drivers 32*r* and 32*f*. The drivers 32*r* and 32*f* conduct currents in proportion to the analog voltages from the D/A converters 37*r* and 37*f* to the LEDs 31*r* and 31*f*.

The light emitted by the LEDs 31*r* and 31*f* passes through an unillustrated slit and strikes the transfer conveying belt 60, and most of the light penetrates the transfer conveying belt 60 and is reflected by the exit roller 62 that slides and rotates on the back surface of the transfer conveying belt 60, and the reflected light penetrates the transfer conveying belt 60 and passes through an unillustrated slit, and then strikes transistors 33*r* and 33*f*. Thereby, a low impedance is obtained between the collectors and emitters of the transistors 33*r* and 33*f*, and the emitter potentials of the transistors 33*r* and 33*f* rise.

When the marks on the transfer conveying belt 60 reach the positions facing the LEDs 31*r* and 31*f*, the marks block the light from the LEDs 31*r* and 31*f*, so that the impedance between the collectors and emitters of the transistors 33*r* and 33*f* becomes high and the emitter voltages of the transistors 33*r* and 33*f*, that is, the levels of the detection signals of the light sensors 20*r* and 20*f* lower.

Therefore, when test patterns are formed on the moving transfer conveying belt 60, the detection signals of the light sensors 20*r* and 20*f* fluctuate to high and low. The high level of the detection signal means no presence of a mark, and the low level of the detection signal means the presence of a mark. The light sensors 20*r* and 20*f* form the mark detecting unit that detects the marks on the rear side on the transfer conveying belt 60 and the marks on the front rear side.

The detection signals of the light sensors 20*r* and 20*f* pass through high frequency noise removing low-band pass filters 34*r* and 34*f* and are further corrected in level to 0 through 5 volts by level correcting amplifiers 35*r* and 35*f* and applied to A/D converters 36*r* and 36*f*.

FIG. 35 depict a corrected detection signal SGU from the amplifier 35*r*. Referring to FIG. 27 again, detection signals Sdr and Sdf are supplied to the A/D converters 36*r* and 36*f*, and are supplied to window comparators 39*r* and 39*f* through amplifiers 38*r* and 38*f*.

The A/D converters 36*r* and 36*f* have sample-and-hold circuits on their inside input sides, and have data latches (output latches) on their output sides, and when A/D conversion instruction signals Scr and Scf are supplied from the MPU 41, the A/D converters hold the voltages of the detection signals Sdr and Sdf at this point from the amplifiers 35*r* and 35*f*, convert the voltages into digital data, and store the data in the data latches. Therefore, when the detection signals Sdr and Sdf reading is necessary, the MPU 41 supplies the A/D conversion instruction signals Scr and Scf to the A/D converters 36*r* and 36*f* and can read digital data indicating the levels of the detection signals Sdr and Sdf, that is, detection data Ddr and Ddf.

The window comparators 39*r* and 39*f* generate level judgement signals Swr and Swf at a low level L when the detection signals from the amplifiers 38*r* and 38*f* are in the range equal to or more than 2 volts and equal to or less than 3 volts, and generate level judgement signals Swr and Swf at a high level H when the detection signals from the amplifiers 38*r* and 38*f* are out of the range equal to or more than 2 volts and equal to or less than 3 volts. By referring to these level judgement signals Swr and Swf, the MPU 41 can immediately recognize as to whether the detection signals Sdr and Sdf are within the range. In addition, the MPU 41 takes-in signals indicating opening and closing of the micro switches 39*a* through 39*d* and 79*a* through 79*d* from these switches.

Figure 28:
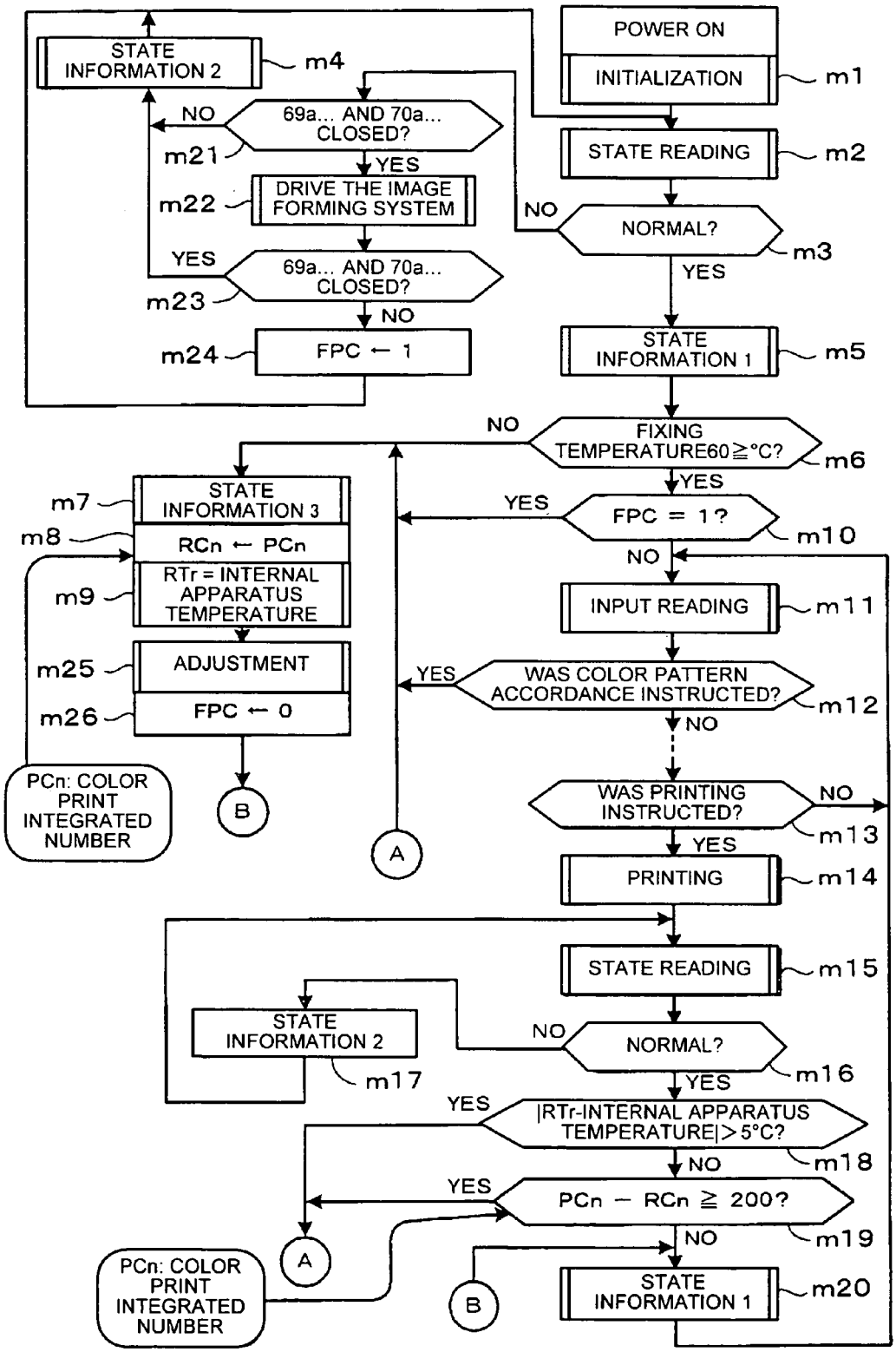
FIG. 28 is a flowchart of a print control flow of a microcomputer of the process controller.

FIG. 28 shows the outline of printer engine control of the MPU 41, i.e., a printing control. When the power source is turned on and applies an operation voltage, the MPU 41 sets the signal level of the input/output port to a standby level, and also sets the internal register and timer to be in a standby status (Step m1). Subsequently, when a step number or a step symbol is indicated in parenthesis, only the number or symbol is indicated by omitting "step."

After completing initialization (m1), the MPU 41 checks whether there is an obstacle in image forming and whether image forming is normal by reading the states of the mechanical parts and electrical circuits of the laser printer (m2, m3), and if there is an abnormality, the MPU checks the opening and closing states of the micro switches 69*a* through 69*d* and 79*a* through 79*d* (m21). When any of the micro switches 69*a* through 69*d* and 79*a* through 79*d* is closed (turned on), this means that a unit (latent image forming unit or developing unit) corresponding to the closed micro switches is not attached or the unit is in the state when the laser printer is turned on immediately after the unit is replaced with a new unit. Herein, the micro switches 69*a* through 69*d* are switches that detect the attaching of the four latent image carrier units including the charging rollers 12 of the toner image forming units 1Y, 1M, 1C, and 1K, the photoconductor drums 11Y, 11M, 11C, and 11K, and cleaning devices, to the laser printer main body, and the micro switches 79*a* through 79*d* are switches that detect the attaching of the developing devices 13 of the toner image forming units 1Y, 1M, 1C, and 1K to the laser printer main body.

To confirm the states of the micro switches 69*a* through 69*d* and 79*a* through 79*d*, the MPU 41 temporarily drives the four image forming systems that form images on the photoconductor drums 11*k*, 11*y*, 11*c*, and 11*m*, and checks the opening and closing states of the micro switches 69*a* through 69*d* and 79*a* through 79*d* (m22, m23). Thereby, the transfer conveying belt 60 is driven in the transfer sheet conveying direction, and the photoconductor drums 11*k*, 11*y*, 11*c*, and 11*m*, the charging rollers 12 . . . to come into contact with the photoconductor drums, and developing rollers of the developing devices 13 rotate, and when immediately after the unit (latent image forming unit or developing unit) is replaced with a new unit, the closed micro switch is switched to open (means that a unit has been attached). When no unit is attached, the micro switch is left closed.

As a result of driving the image forming systems, when any of the micro switches 69*a* through 69*d* and 79*a* through 79*d* that had been closed is switched to open, for example, the micro switch 69*d* that detects attachment and detachment of the Bk latent image forming unit is switched from closed (PSd=L) to open (PSd=H), MPU 41 clears a print integrated number register (one region on the nonvolatile memory) assigned to the Bk latent image forming unit (the Bk print integrated number is initialized to zero), and writes "1" indicating that unit replacement wALs performed on a register FPC (m24).

When the micro switch is not switched to open, the MPU 41 judges that no unit is attached, and makes the operation display board (operation panel) inform of an abnormality indicating it (m4). The MPU 41 repeats the state reading, abnormality check, and abnormality informing (m2 through m4) until no abnormality is detected.

When no abnormality is detected, the MPU 41 starts energization to the fixing unit 7 and checks whether the fixing temperature of the fixing unit 7 is a fixing enabling temperature, and when it is not the fixing enabling temperature, the MPU makes the operation display board display an indication of standby, and makes the operation display board display an indication of printing possibility when it is the fixing enabling temperature (m5).

The MPU 41 checks whether the fixing temperature is equal to or more than 60° C. (m6), and when the fixing temperature of the fixing unit 7 is less than 60° C., temporarily judges that the laser printer power source has been turned on after a long period of suspension (out of service) (for example, power source turning on first in the morning: great change in internal apparatus environment during suspension) and Snakes the operation display board display color pattern accordance execution (m7), writes an integrated number PCn of color prints stored in the nonvolatile memory at this point on the register (one region of the memory) RCn of the MPU 41 (m8), writes the internal apparatus temperature at this point on the register RTr of the MPU 41 (m9), executes "adjustment" (m25), and after finishing this, clears the register FPC (m26). The details of the "adjustment" (m25) are described later with reference to FIG. 29A and subsequent figures.

The MPU 41 can judge that the elapse time from the previous power source turning off of the laser printer is short when the fixing temperature of the fixing unit 7 is equal to or more than 60° C. In this case, it can be presumed that there is a change in the internal apparatus environment from the time immediately before previous turning off of the power source to the present time. However, it is checked whether the latent image forming unit or developing unit 13 of any color was replaced, that is, whether data indicating unit replacement was generated at the step m24 (FPC=1) (m10). When data indicating unit replacement is generated (FPC=1), the MPU 41 executes "color pattern accordance" described later by carrying out the steps m7 through m9 (adjustment of step m25 and step m26).

When the unit (latent image forming unit or developing unit) is not replaced, the MPU 41 waits for an input by an operator via the operation display board and a command of the PC connected to the laser printer, and reads these (m11). When a "color pattern accordance" instruction is given from the operator via the operation display board or PC (m12), the MPU 41 carries out the steps m7 through m9 and executes the "color pattern accordance" described later (adjustment of step m25 and step m26).

When the fixing temperature of the fixing unit 7 is a fixing enabling temperature and the parts thereof are ready, and a copy start instruction (printing instruction) is given from the operation display board, or a printing start instruction corresponding to a printing command from the PC is given from the system controller 26, the MPU 41 makes the image forming system form a designated number of images (m13, m14).

In this image forming process, after image forming on one transfer sheet is finished, every ejection of the transfer sheet, the MPU 41 increments the data of the print total number register assigned to the nonvolatile memory, the color print integrated number register PCn, and print integrated number registers of Bk, Y, C, and M by one in the case of color image forming. When image forming is monochrome image forming, the MPU 41 increments the data of the print total number register, the monochrome print integrated number register, and the Bk print integrated number register by one.

The data of the print integrated number registers of the colors Bk, Y, C, and M are initialized (cleared) to data indicating zero when the latent image carrying units are replaced by new ones.

The MPU 41 checks occurrence of an abnormality such as paper trouble every one image forming, and reads the developing density, fixing temperature, internal apparatus temperature, and the states of other parts after the designated number of images are formed (m15), and checks whether there is an abnormality (m16). When an abnormality occurs, the MPU 41 displays it on the operation display board (m17), and repeats the steps m15 through m17 until no abnormality is detected.

When the state allows start of image forming, that is, the state is normal, the MPU 41 checks whether the internal apparatus temperature at this point changed over 5° C. from the internal apparatus temperature (data RTr of the register RTr) in the previous color pattern accordance (m18). When the MPU 41 detects a temperature change over 5° C. from the internal apparatus temperature (data RTr of the register RTr) in the previous color pattern accordance, the MPU carries out the steps m7 through m9 and executes the "color pattern accordance" (adjustment of the step m25 and the step m26) described later.

When the MPU 41 detects no temperature change over 5° C. from the internal apparatus temperature (data RTr of the register RTr) in the previous color pattern accordance, the MPU checks whether the value of the color print integrated number register PCn is equal to or more than 200 over the value RCn of the color print integrated number register PCn in the previous color pattern accordance (data of the register RCn) (m19), and when the value of the color print integrated number register PCn is equal to or more than 200 over the value RCn of the color print integrated number register PCn in the previous color pattern accordance (data of the register RCn), the MPU carries out the steps m7 through m9 and executes the "color pattern accordance" (adjustment of the step m25 and the step m26) described later. When the value of the color print integrated number register PCn is less than 200 over the value RCn of the color print integrated number register PCn in the previous color pattern accordance (data of the register RCn), the MPU 41 checks whether the fixing temperature of the fixing unit 7 is a fixing enabling temperature, and when the fixing temperature of the fixing unit 7 is not a fixing enabling temperature, the MPU displays an indication of standby on the operation display board, and when the fixing temperature of the fixing unit 7 is a fixing enabling temperature, the MPU displays an indication of printing possibility on the operation display board (m20), and advances to "input reading" (m11).

The MPU 41 executes the "adjustment" (m25) according to the control flow of FIG. 28 when (1) the power source is turned on at a fixing temperature of less than 60° C. of the fixing unit 7, (2) when any of the Bk, Y, C, and M units (latent image forming unit or the developing unit) is replaced with new one, (3) when a color pattern accordance instruction is given from the operation display board or PC, (4) when a designated number of sheets are all printed out and the internal apparatus temperature changes over 5° C. from the internal apparatus temperature in the previous color pattern accordance, and (5) when a designated number of sheets are all printed out and the color print integrated number PCn becomes equal to or more than 200 over the value RCn in the previous color pattern accordance. Execution in the cases of (1), (2), (4) and (5) is called automatic execution and execution in the case of (3) is called manual execution.

A timer (not shown) as a clock means that does not depend on the turning on/off of the power source measures a machine suspension period of the present embodiment, and when the timer measures a machine suspension period of equal to or more than 20 hours and then the power source is turned on, the MPU 41 automatically measures the phase and the maximum amplitude, and stores the results in the nonvolatile memory.

After storing the results of measurement of the phase and maximum amplitude in the nonvolatile memory, the MPU 41 automatically executes the "adjustment" (m25), and this is also called automatic execution.

Figure 29:
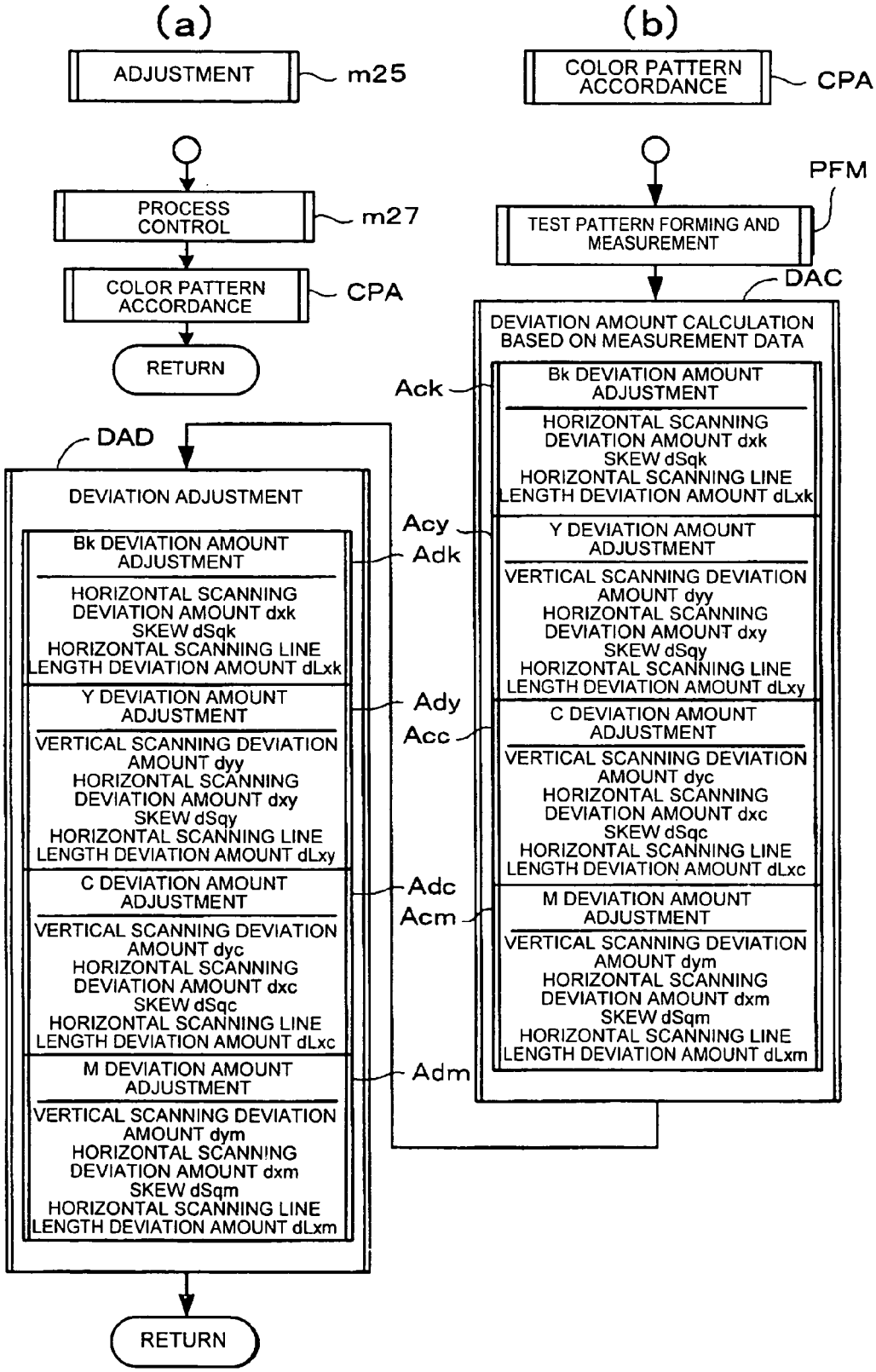
FIG. 29 are flowcharts of "adjustment" and "color pattern accordance" in the print control flow.

FIG. 29A depicts the details of the "adjustment" (m25). In the "adjustment" (m25), first, the MPU 41 carries out the "process control" (m27) to set all image forming conditions in charging, exposure, development, and transfer to reference values and form images in Bk Y, C, and M on the rear r or the front f of the transfer conveying belt 10, detects the image densities by the light sensor 20*r* or 20*f*, and adjusts and sets voltages to be applied from the power source to the charging rollers 12, an exposure intensity in the writing unit 2, and developing biases of the developing units 13 so that the image densities reach reference values. Next, the MPU 41 executes "color pattern accordance" (CPA).

FIG. 29B depicts the details of "color pattern accordance" (CPA). In this "color pattern accordance," first, in the "test pattern forming and measurement" (PFM), the MPU 41 makes a test pattern signal generator that is not shown supply a test pattern signal to the writing unit 2 to form start marks Msr and Msf and eight mark sets as test patterns as shown in FIG. 26 on the respective rear r and front f of the transfer conveying belt 60 under the image forming conditions (parameters) set in the "process control" (m27), makes the light sensors 20*r* and 20*f* detect the marks of the test patterns, converts the mark detection signals Sdr and Sdf by the A/D converters 36*r* and 36*f* into digital data, that is, mark detection data Ddr and Ddf, and reads these data.

Then, the MPU 41 calculates the positions (distribution) on the transfer conveying belt 60 of the center points of the marks of the test patterns from the mark detection data Ddr and Ddf. Furthermore, the MPU 41 calculates a mean pattern (mean group of the mark positions) of the rear side eight mark sets and a mean pattern of the front side eight mark sets. The details of this "test pattern forming and measurement" (PFM) are described later with reference to FIG. 30 and subsequent figures.

After calculating the mean patterns, the MPU 41 calculates deviations of the images formed by the Bk, Y, C, and M image forming units (image forming system) based on the mean patterns (DAC), and performs adjustment to eliminate the deviations of the images based on the calculated deviations of the images (DAD).

Figure 30:
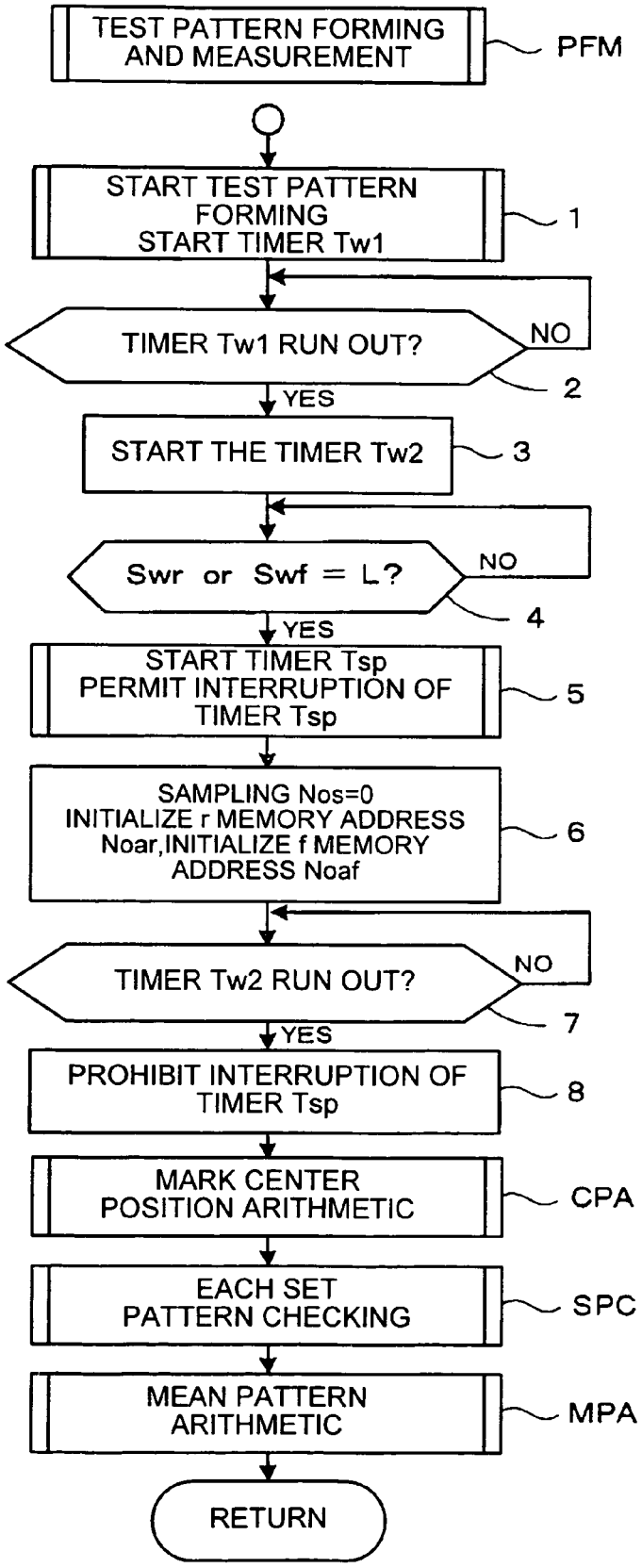
FIG. 30 is a flowchart of "test pattern forming and measurement" in the "color pattern accordance"

FIG. 30 depicts the details of the "test pattern forming and measurement" (PFM). In this "test pattern forming and measurement" (PFM), the MPU 41 makes the pattern signal generator supply a test pattern signal to the writing unit 5 and makes the image forming system start forming the start marks Msr and Msf and eight mark sets with, for example, a width w in the y direction of 1 mm, a length A in the x direction (length in the x direction of the last mark in the y direction of the mark set) of 20 mm, and pitches d 6 mm, at mark set intervals c of 9 mm, simultaneously on the surfaces of the respective rear side r and front side f of the transfer conveying belt 60 being driven at a constant speed of, for example, 125 mm/sec, and starts a timer Tw1 with a time limit Tw1 to measure the timing immediately before the start marks Msr and msf reach immediately below the light sensors 20*r* and 20*f* (1), and waits for time out (time's up) of the timer Tw1 (2). When the time of the timer Tw1 runs out, the MPU 41 starts a timer Tw2 with a time limit Tw2 to measure the timings of passing through the light sensors 20*r* and 20*f* of the last ones of the eight mark sets at the rear and front of the transfer conveying belt 60 (3).

Figure 34:
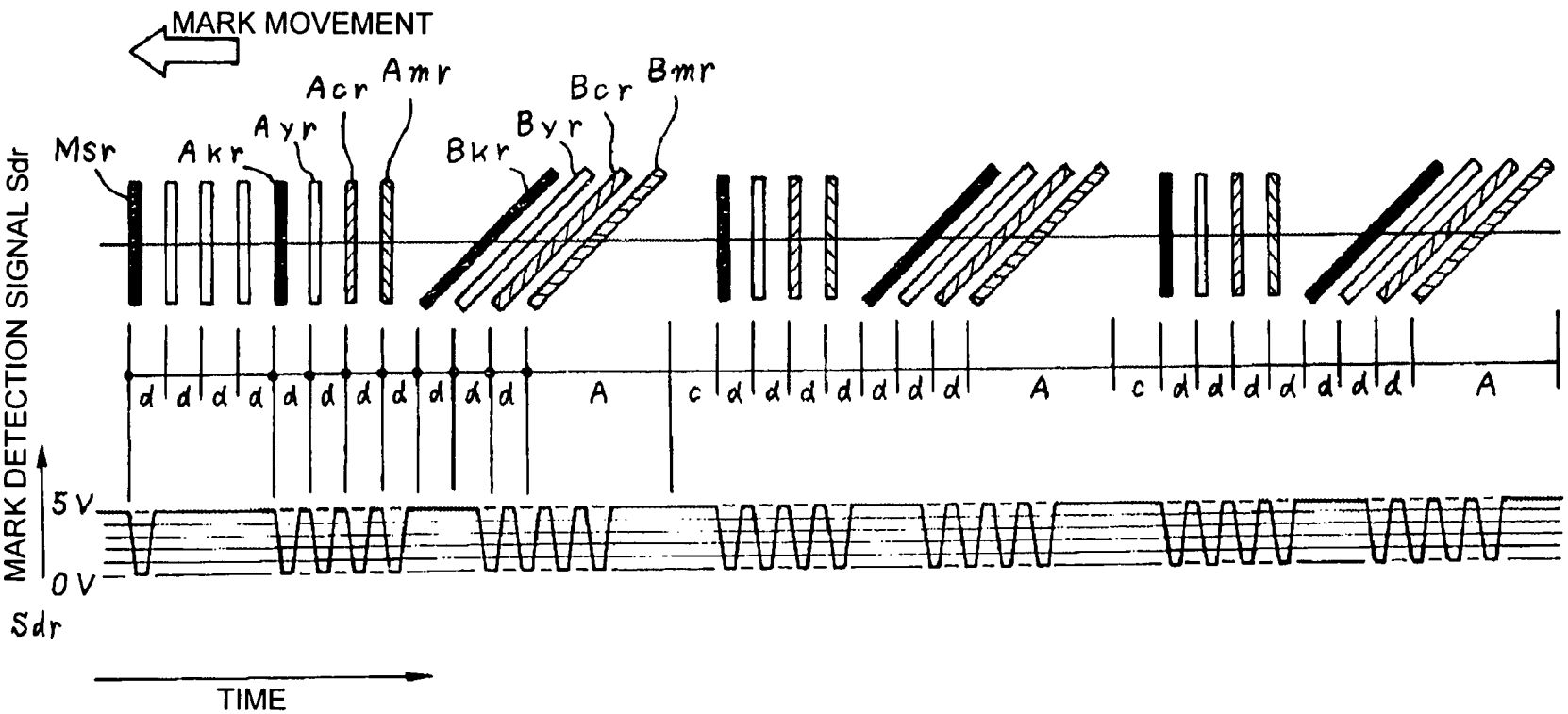
FIG. 34 is a plan view of color mark distribution formed on the transfer conveying belt and a time chart of level changes of a color mark detection signal Sdr of a light sensor 20*r* in the color image forming apparatus.
Figure 35A:
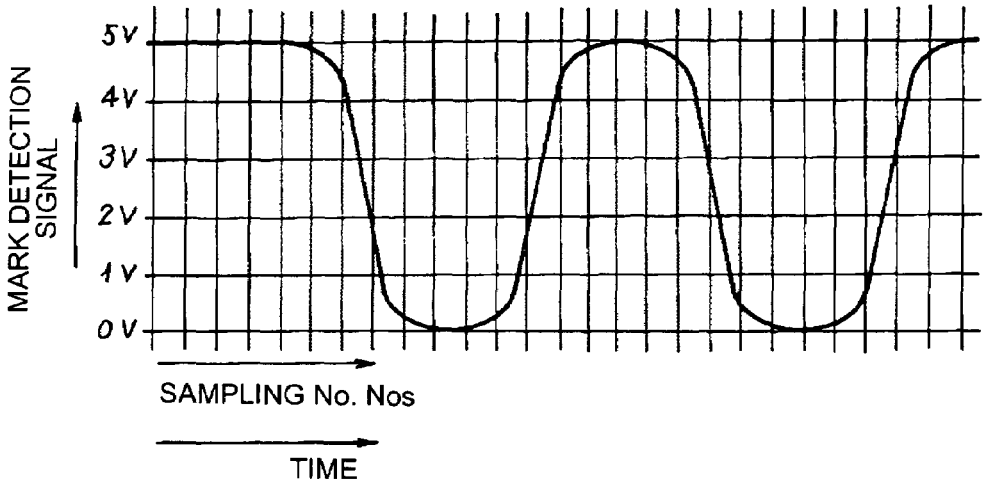
FIG. 35A is a time chart of a part of the time chart of the detection signal Sdr of FIG. 33 in an enlarged manner.

As described above, when the Bk, Y, C, and M marks are not in the fields of the light sensors 20*r* and 20*f*, the detection signals Sdr and Sdf from the light sensors 20*r* and 20*f* are at a high level H (5 volts), and when a mark is in the field of the light sensor 20*r* or 20*f*, the detection signal Sdr or Sdf from the light sensor 20*r* or 20*f* is at a low level L (0 volt), and the detection signal Sdr fluctuates its level as shown in FIG. 34 according to the constant speed movement of the transfer conveying belt 60. FIG. 35A depicts a part of the level fluctuation in an enlarged manner. In FIG. 35A, the lowering region in which the level of the mark detection signal lowers corresponds to a front end edge region of the mark, and the rising region in which the level of the mark detection signal rises corresponds to a rear end edge region of the mark, and the region of the width w of the mark is between these lowering region and rising region.

As shown in FIG. 30, at the step 4, in the process in which the start mark Msr or Msf reaches the field of the light sensor 20*r* or 20*f* and the detection signal Sdr or Sdf changes from H to L, the MPU 41 waits until the detection signal Swr or Swf from the window comparator 39*r* or 39*f* of FIG. 27 becomes L indicating that the detection signal Sdr or Sdf is at 2 through 3 volts. Namely, the MPU 41 monitors whether or not the edge region of at least one of the start marks Msr and Msf reaches the field of the light sensor 20*r* or 20*f*.

Figure 31:
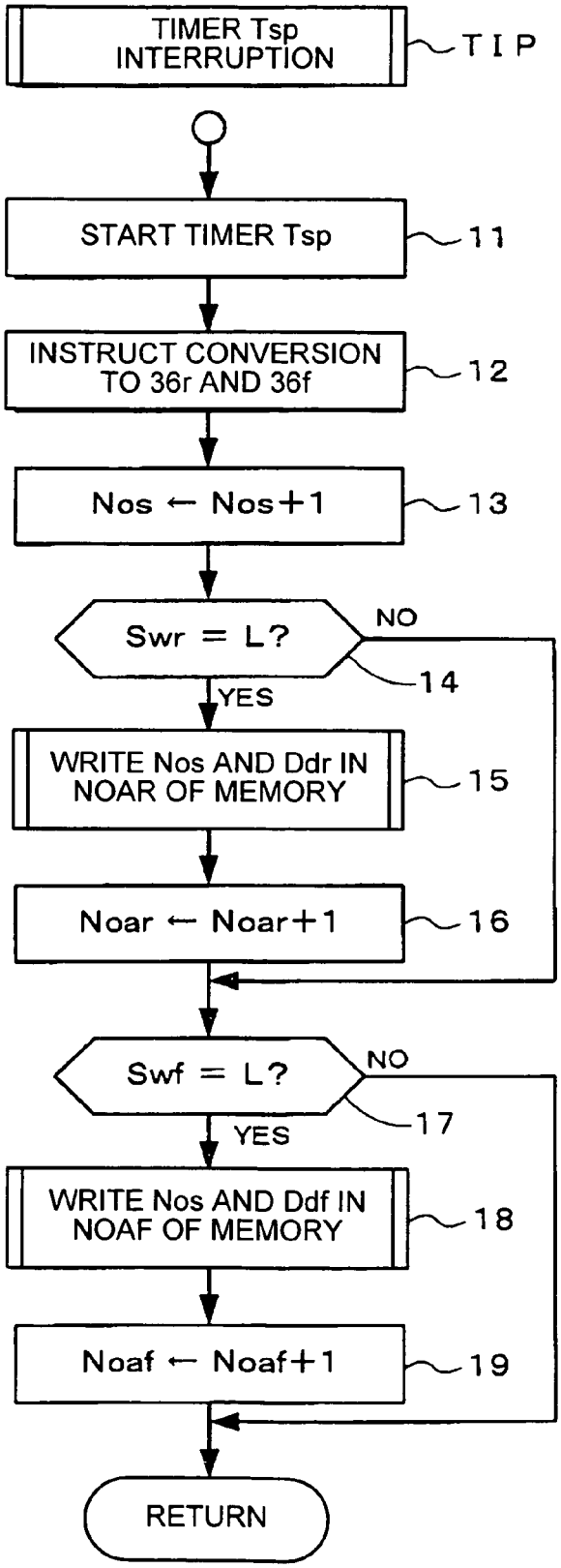
FIG. 31 is a flowchart of interruption in the "test pattern forming and measurement"

When the edge region of at least one of the start marks Msr and Msf reaches the field of the light sensor 20*r* or 20*f*, the MPU 41 starts a timer Tsp with a time limit Tsp (for example, 50 microseconds), and when the time of this timer runs out, the MPU permits and executes "timer Tsp interruption" (TIP) shown in FIG. 31 (5). Next, the MPU 41 initializes a sampling number of times Nos of a sampling number-of-times register Nos to zero, and initializes writing addresses Noar and Noaf of an r memory (rear side mark reading data storage region) and an f memory (front side mark reading data storage region) assigned to the FIFO memory in the MPU 41 to start addresses (6). The MPU 41 waits until the time of the timer Tw2 runs out (7), that is, the whole test pattern of the eight sets passes through the field of the light sensor 20*r* or 20*f*.

The details of the "timer Tsp interruption" (TIP) are explained with reference to FIG. 31. This "timer Tsp interruption" (TIP) is executed every time out of the timer Tsp with a time limit Tsp. At the beginning of this processing, the MPU 41 starts the timer Tsp (11), instructs the A/D converter 36*r* or 36*f* to perform A/D conversion, that is, sets the instruction signal Scr or Scf to an A/D conversion instruction level L, temporarily (12). Then, the MPU 41 increments the sampling number of times Nos of the sampling number-of-times register Nos as the A/D conversion instruction number of times by one (13).

Thereby, Nos×Tsp indicates the elapse time since the detection of the front end edge of the start mark Msr or Msf (=the current detecting position on the transfer conveying belt 60 by the light sensor 20*r* or 20*f* in the moving direction y of the transfer conveying belt 60 along the surface of the transfer conveying belt 60 based on the start mark Msr or Msf).

The MPU 41 checks whether the detection signal Swr from the window comparator 39*r* is L (whether the light sensor 20*r* is detecting the edge of the mark and 2V≦Sdr≦3V) (14), and when the detection signal Swr from the window comparator 39*r* is L, the MPU writes the sampling number of times Nos of the sampling number-of-time register Nos and the A/D converted data Ddr (digital value of the mark detection signal Sdr of the light sensor 20*r*) as writing data to the address Noar of the r memory (15), and increments the writing address Noar of the r memory by one (16).

When the detection signal Swr from the window comparator 39*r* is H (Sdr<2V or 3V<Sdr), the MPU 41 does not write data on the r memory. This is for reducing the writing data amount on the memory and simplifying subsequent data processing.

Next, in the same manner, the MPU 41 checks whether the detection signal Swf from the window comparator 39*f* is L (whether the light sensor 20*f* is detecting the mark edge and 2V≦2df≦3V) (17), and when the detection signal Swf from the window comparator 39*f* is L, the MPU writes the sampling number of times Nos of the sampling number-of-times register Nos and the A/D converted data Ddf (digital value of the mark detection signal Sdf of the light sensor 20*f*) as writing data to the address Noaf of the f memory (18), and increments the writing address Noaf of the f memory by one (19).

Figure 35B:
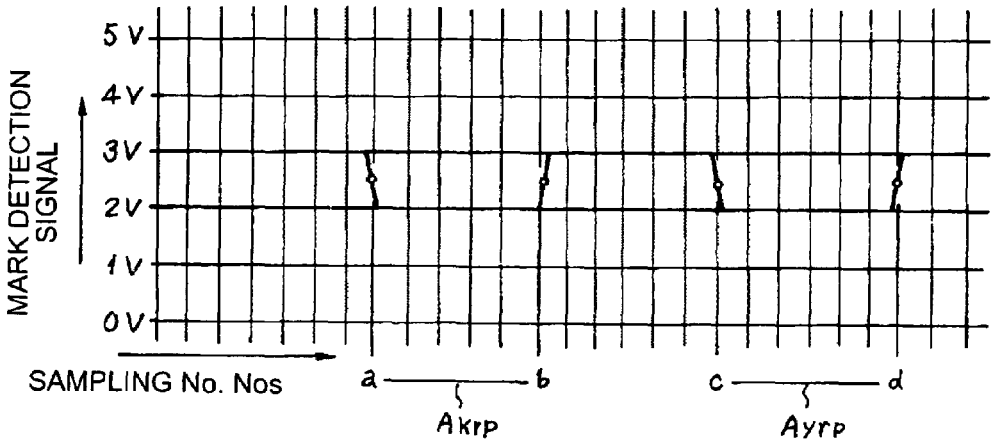
FIG. 35B is a time chart of only a range of data extracted from the detection signal of FIG. 35A to be A/D converted and written on an FIFO memory.

Such interruption is repeated in the Tsp periods, so that the mark detection signals Sdr and Sdf of the light sensors 20*r* and 20*f* change to high or low as shown in FIG. 35A, in the r memory and f memory assigned to the FIFO memory in the MPU 41, only the digital data Ddr and Ddf of the detection signals Sdr and Sdf in the range equal to or more than 2 volts and equal to or less than 3 volts, shown in FIG. 35B, are stored together with the sampling numbers of times Nos. The sampling number of times Nos of the sampling number-of-times register Nos is incremented by one in the Tsp period and the transfer conveying belt 60 moves at a constant speed, so that the sampling number of times Nos indicates the position of each mark in the y direction along the surface of the transfer conveying belt 60 from the detected start mark.

In the range equal to or more than 2 volts and equal to or less than 3 volts, the middle point Akrp between the center position a of the lowering region in which the mark detection signal level lowers and the center position b of the next rising region shown in FIG. 35B corresponds to the center position of the mark Akr in the y direction, and likewise, the middle point Ayrp between the center position c of the lowering region in which the next mark detection signal level lowers and the center position b of the next rising region corresponds to the center position of another mark Ayr in the y direction. In the arithmetic CPA of the mark center position described later (FIG. 32, FIG. 33), these mark center positions Akrp, Ayrp, and so on are calculated.

Referring back to FIG. 30, when the time of the timer Tw2 runs out after the last marks of the last eighth mark sets in the test patterns pass through the light sensors 20*r* and 20*f*, the MPU 41 prohibits interruption of the timer Tsp (7, 8). Thereby, the A/D conversion of the detection signals Sdr and Sdf in the Tsp period shown in FIG. 31 stops. The MPU 41 calculates the mark center positions based on the detection data Ddr and Ddf of the r memory and f memory of the FIFO memory inside the MPU (CPA), examines whether the distribution of the detected mark center positions of the eight mark sets is proper, and deletes an improper detection pattern (mark set) (SPC) and determines mean patterns of proper detection patterns (MPA).

Figure 32:
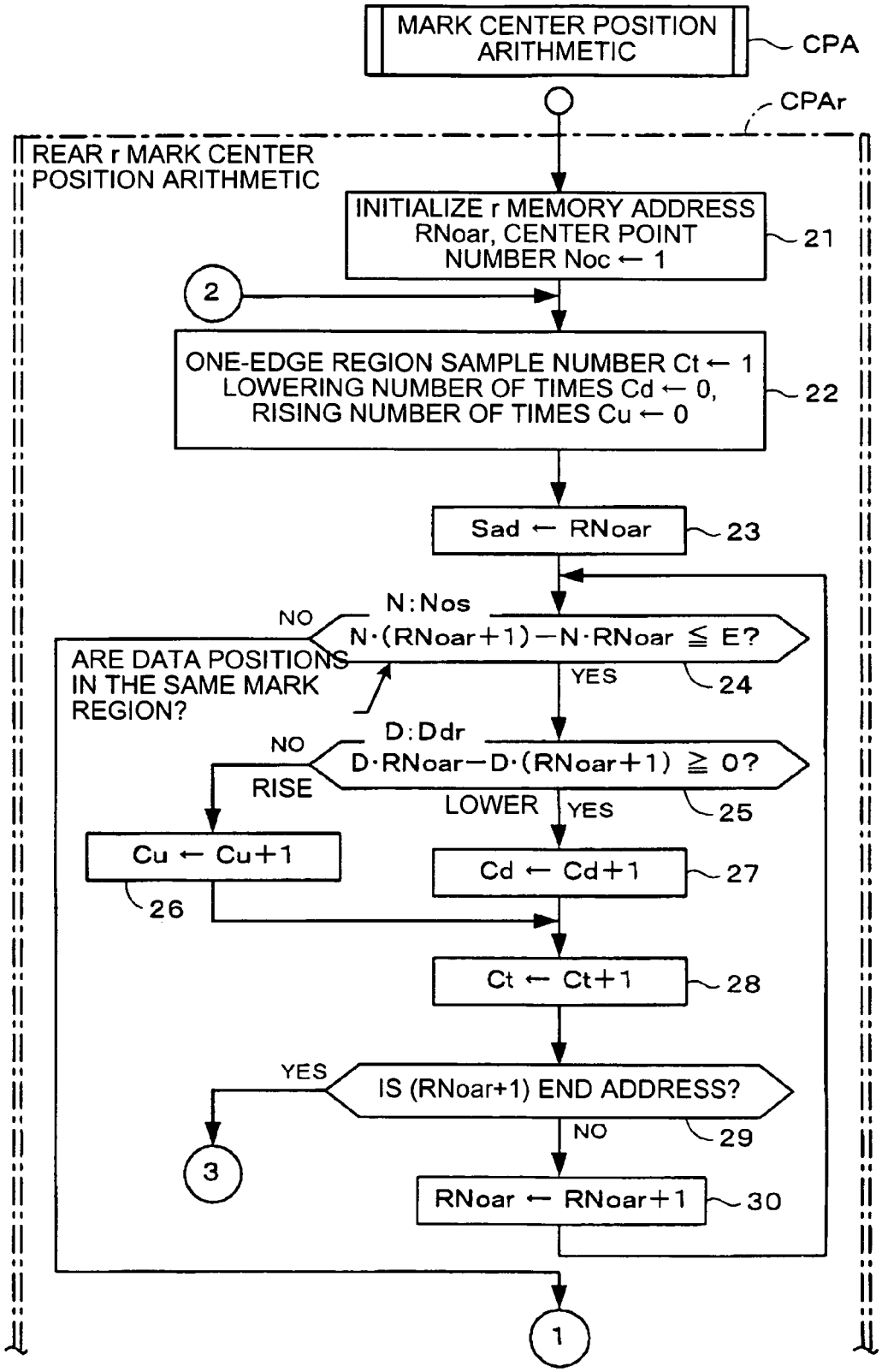
FIG. 32 is a flowchart of a part of "mark center position arithmetic" of FIG. 30.
Figure 33:
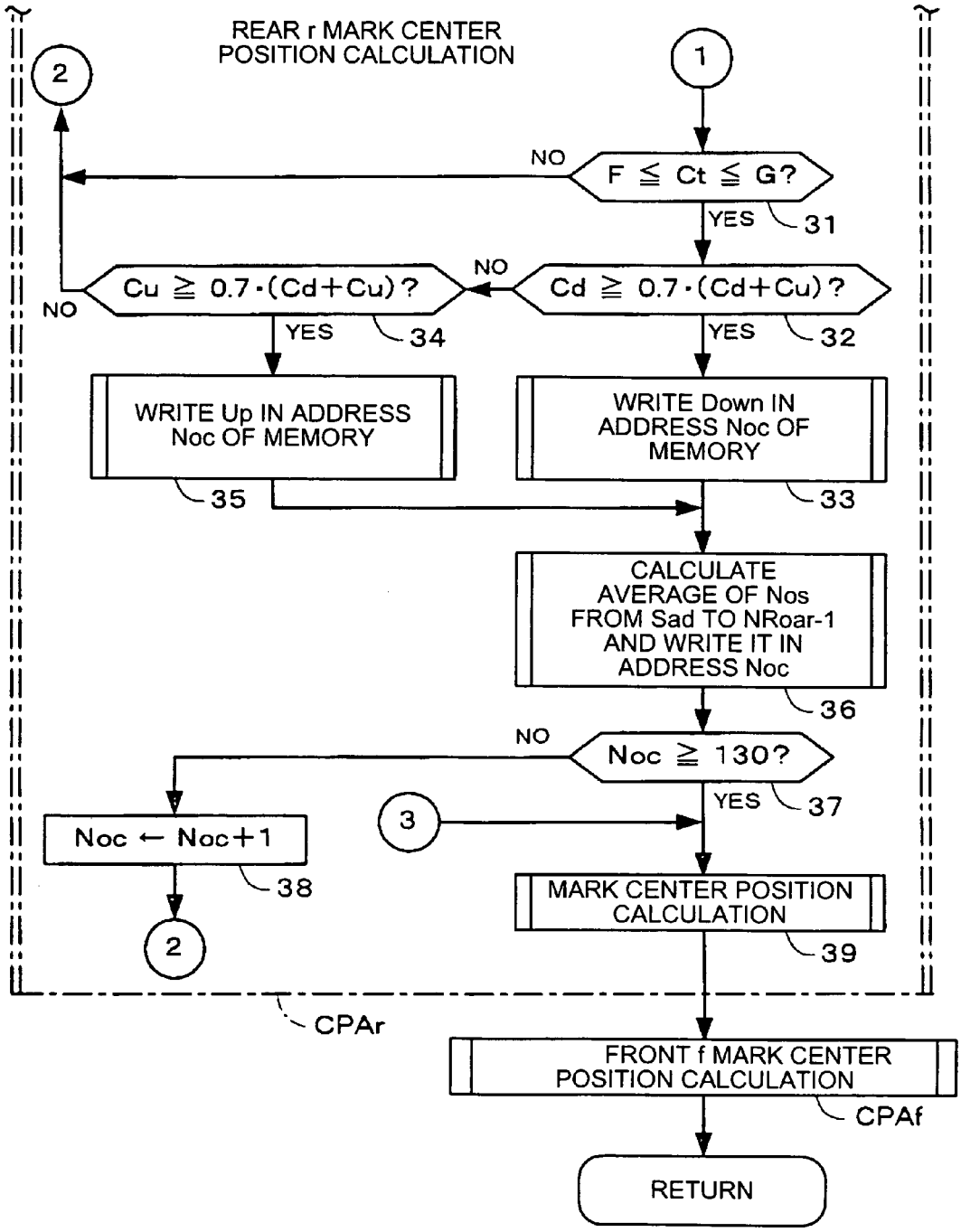
FIG. 33 is a flowchart of another part of the "mark center position arithmetic" CPA of FIG. 30.

FIGS. 32 and 33 depict the details of the "mark center position arithmetic." Herein, "mark center position arithmetic at the rear r" (CPAr) and "mark center position arithmetic at the front f" (CPAf) are executed.

In the "mark center position arithmetic at the rear f" (CPAr), first, the MPU 41 initializes a readout address RNoar of the r memory assigned to the FIFO memory inside the MPU and initializes data in the center point number register Noc to 1 that means the first edge (21). Next, the MPU 41 initializes data Ct of a one-edge region sampling number register Ct to 1, and initializes data Cd and Cu of lowering number-of-times register Cd and rising number-of-times register Cu to zero (22). Then, the MPU 41 writes the read out address RNoar on an edge-region data group head address register Sad (23). These are preparation processing for first edge region data processing.

The MPU 41 reads data (y position Nos: N·RNoar, detection level Ddr: D·RNoar) from the address RNoar of the r memory, and also reads data (y position Nos: N·(RNoar+1) detection level Ddr: D·(RNoar+1)) from the next address RNoar+1, and checks whether the positional difference in the y direction between these readout data (N·(RNoar+1)−N·RNoar) is equal to or less than E (for example, E=w/2=½ mm or equivalent) (in the same edge reunion) (24). When the positional difference in the y direction between these readout data is equal to or less than E, the MPU judges whether the difference in detection level between these readout data (D·RNoar−D·(RNoar+1)) is equal to or more than 0 to check whether the mark detection data Ddr has a lowering tendency or a rising tendency (25). When the mark detection data Ddr has a lowering tendency, the MPU increments the data Cd of the lowering number-of-times register Cd by one (27), and when the mark detection data Ddr has a rising tendency, the MPU increments the data Cu of the rising number-of-times register Cu by one (26).

The MPU 41 increments the data Ct of the one-edge region sampling number-of-times register Ct by one (28). Then, the MPU 41 checks whether the r memory readout address RNoar is an end address of the r memory (29), and when the r memory readout address RNoar is not the end address of the r memory, the MPU increments the memory readout address RNoar by one (30), and repeats the processes (24 through 30).

When the y position (Nos) of the readout data changes to one of the next edge region, the positional difference between the positional data of the front and rear memory addresses (N·(RNoar+1)−N·RNoar) becomes larger than E, and the MPU 41 advances to the step 31 of FIG. 33 from the step 24. Herein, checking of lowering and rising tendencies of all sampling data in one mark edge region (front end edge or rear end edge) has been finished.

Therefore, the MPU 41 checks whether the sampling number data Ct of the one-edge region sampling number register Ct at this point is a value within one edge region (in the range equal to or more than 2 volts and equal to or less than 3 volts), that is, checks whether the data Ct is F≦Ct≦G (31). F denotes a lower limit (set value) of the writing number of times of the sample value Ddr on the r memory when the front end edge or rear end edge of a normally formed mark is detected and the detection signal Sdr is equal to or more than 2 volts and equal to or less than 3 volts. G denotes an upper limit (set value) of the writing number of times of the sample value Ddr on the r memory when the front end edge or rear end edge of a normally formed mark is detected and the detection signal Sdr is equal to or more than 2 volts and equal to or less than 3 volts.

When Ct is F≦Ct≦G, the MPU 41 completes correct/error check on the data of one mark edge that has been normally read and stored, and the result becomes "proper," so that the MPU checks whether the detection data group obtained concerning this mark edge has a lowering tendency or a rising tendency as a whole of the edge region (equal to or more than 2 volts and equal to or less than 3 volts) (32, 34). In this laser printer, when the data Cd of the lowering number-of-times register Cd is equal to or more than 70 percent of the sum Cd+Cu of this data and the data Cu of the rising number-of-times register Cu (Cd≧0.7(Cd+Cu)), the MPU 41 writes data Down meaning lowering of the address to the edge No. Noc of the memory (33), and when the data Cu of the rising number-of-times register Cu is equal to or more than 70 percent of Cd+Cu (Cu≧0.7(cd+Cu)), the MPU 41 writes data Up meaning a rise of the address of the memory edge No. Noc of the memory (34, 35). Furthermore, the MPU 41 calculates the average number of the y position data of the edge region, that is, the center position (a, b, c, d . . . of FIG. 35B) of the edge region and writes it on the address of the edge No. Noc of the memory (36).

Next, the MPU 41 checks whether the edge No. Nos has become equal to or more than 130, that is, whether calculation of the center positions of the marks in the front end edge regions and rear end edge regions of all of the start mark Msr and eight mark sets has been completed. When the calculation of the center positions of the marks is completed, or when reading-out of all stored data from the r memory is completed and the r memory readout address RNoar is the end address of the r memory at the step 39, the MPU 41 calculates the mark center positions based on the edge center position data (y position data calculated at the step 36) (39).

Namely, the MPU 41 reads the data (lowering/rising data and edge center position data) of the address to the edge No. Noc of the memory and checks whether the positional difference between the center position in the preceding lowering edge region and the rising edge region immediately after the lowering edge region is within the range corresponding to the width w in the y direction of the mark, and when the positional difference between the center position of the preceding lowering edge region and the center position of the rising edge region immediately after the lowering edge region is out of the range corresponding to the width w in the y direction of the mark, the MPU deletes these data. When the positional difference between the center position of the preceding lowering edge region and the center position of the rising edge region immediately after the lowering edge region is within the range corresponding to the width w in the y direction of the mark, the MPU 41 calculates the average of these data, and writes this to the address to the mark number from the head in the memory as one mark center position. When mark formation, mark detection, and detection data processing are all proper, regarding the rear r, center position data of 65 marks as the total of the start mark Msr and eight mark sets (8 marks in 1 mark set>:8 sets=64 marks) are obtained, and stored in the memory.

The MPU 41 executes the "mark center position arithmetic on the front f" CPAf in the same manner as in the "mark center position arithmetic on the rear r" CPAr to process the measurement data on the memory. Regarding the front f, when mark formation, measurement, and measurement data processing are all proper, center position data of 65 marks as the total of the start mark Msf and eight mark sets (8 marks in 1 mark set×8 sets=64 marks) are obtained, and stored in the memory.

When the mark center positions are calculated as described above (CPA), the MPU 41 executes the next "each set pattern check" (SPC) to inspect whether the mark center position data group written to the memory indicates the center point distribution corresponding to the mark distribution shown in FIG. 26. Herein, in the mark center position data group written to the memory, the MPU 41 deletes data deviating from the mark distribution shown in FIG. 26 on a set basis, and leaves only the data sets (1 set: a group of eight positional data) indicating the distribution pattern corresponding to the mark distribution shown in FIG. 26. When all sets are proper, in the mark center position data group written to the memory, 8 data sets of the rear r side and 8 data sets of the front f side remain.

The MPU 41 changes the center position data of the first marks in each set of the second and subsequent sets to the center position of the first mark in the leading set (first set) of the data sets on the rear r side, and also changes the center position data of second through eighth marks by the differences of the change. Namely, the MPU 41 changes the center position data group of the marks in each set of the second and subsequent sets to values shifted in the y direction so as to match the center positions of the leading marks of the respective sets with the center position of the leading mark of the first set. The MPU 41 also changes the center position data of the second and subsequent sets on the front f side in the same manner.

Figure 36:
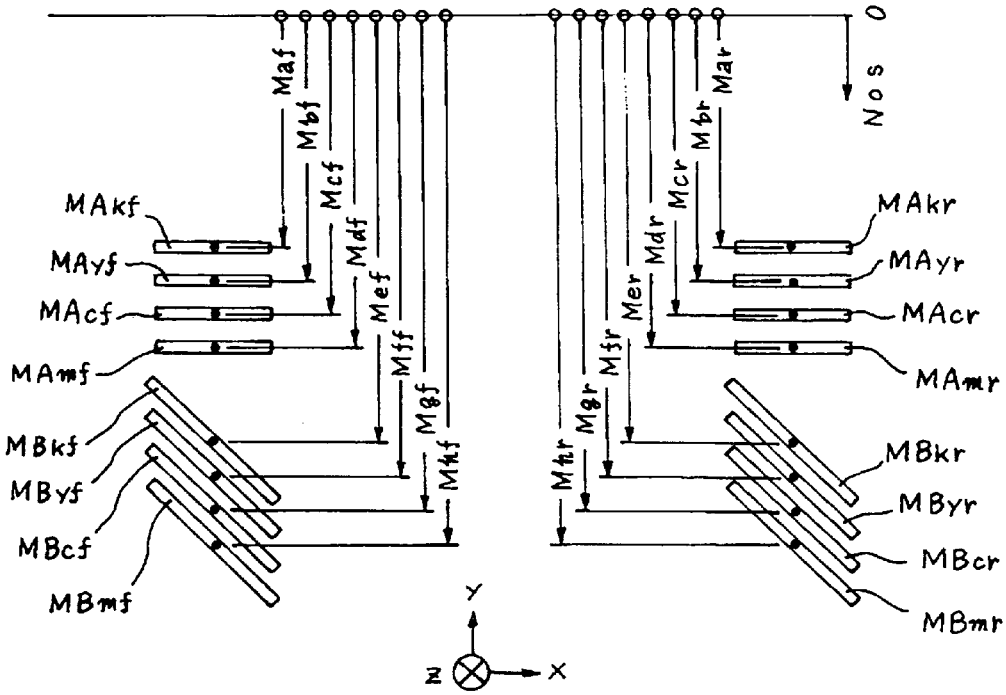
FIG. 36 is a plan view of average data Mar . . . calculated by the "mean pattern arithmetic" MPA of FIG. 30 and virtual marks MAkr . . . the center positions of which are on the average data, that is, mark rows indicated by the average data group.

The MPU 41 executes the "mean pattern arithmetic" (MPA) to calculate the averages Mar through Mhr (see FIG. 36) of the center position data of the marks of all sets on the rear r side, and calculates the averages Maf through Mhf of the center position data of the marks of all sets on the front f side (see FIG. 36). These averages indicate the center positions of virtual average position marks distributing as shown in FIG. 36:

MAkr (representative of Bk rear side orthogonal marks);
MAyr (representative of Y rear side orthogonal marks);
MAcr (representative of C rear side orthogonal marks);
MAmr (representative of M rear side orthogonal marks);
MBkr (representative of Bk rear side diagonal marks);
MByr (representative of Y rear side diagonal marks);
MBcr (representative of C rear side diagonal marks);
MBmr (representative of M rear side diagonal marks);
MAkf (representative of Bk front side orthogonal marks);
MAyf (representative of Y front side orthogonal marks);
MAcf (representative of C front side orthogonal marks);
MAmf (representative of M front side orthogonal marks);
MBkf (representative of Bk front side diagonal marks);
MByf (representative of Y front side diagonal marks);
MBcf (representative of C front side diagonal marks); and
MBmr (representative of M front side diagonal marks).

These are the details of the "test pattern forming and measurement" (PFM) shown in FIG. 30 and subsequent figures.

Referring back tD FIGS. 29B and 36, in the deviation amount calculation (DAC) shown in FIG. 29B, the MPU 41 calculates the image forming deviation amounts as follows. The details of the calculation (Acy) of the Y image deviation amount by the MPU 41 are as follows.

The MPU 41 calculates a vertical scanning deviation amount dyy in the image forming of the Y image from the calculation of dyy=(Mbr−Mar)−d as a deviation amount of the center position difference (Mbr−Mar) between Bk orthogonal mark MAkr and the Y orthogonal mark MAyr on the rear r side from the reference value d (see FIG. 26).

As an average of the deviation amount of the center position difference (Mfr−Mbr) between the orthogonal mark MAyr and the diagonal mark MByr on the rear r side from the reference value 4*d* (see FIG. 26) dxy=(Mfr−Mbr)−4*d* and the deviation amount of the center position difference (Mff−Mbf) between the orthogonal mark MAyf and the diagonal mark MByf on the front f side from the reference value 4*d* (see FIG. 26) dxyf=(Mff−Mbf)−4*d*, the MPU 41 calculates the horizontal scanning deviation amount dxy in the image forming of the Y image from $$dxy=(dxyr+dxyf)/2=(Mrf-Mbr+Mff-Mbf-8d)/2.$$

The MPU 41 calculates a skew dsqy in the image forming of the Y image as a center position difference between the orthogonal mark MAyr on the rear r side and the orthogonal mark MAyf on the front f side from the calculation of: dSqy=(Mbf−Mbr). The MPU 41 calculates a deviation amount dLxy of the horizontal scanning line length in the image forming of the Y image as a valve obtained by subtracting the skew dSqy=(Mff−Mfr) from the center position difference (Mff−Mfr) between the diagonal mark MByr on the rear r side and the diagonal mark MByf on the front f side from $$dLxy=(Mff-Mfr)-dSqy=(Mff-Mfr)-(Mbf-Mbr)$$

The MPU 41 calculates the image forming deviation amounts of other C and M images (vertical scanning deviation amounts: dyc and dym, horizontal scanning deviation amounts: dxc and dxm, skews: dsqc and dsqm, horizontal scanning line length deviation amounts: dLxc and dLxm) in the same manner as in the calculation of the image forming deviation amounts of the Y image (Acc, Acm). The MPU 41 also calculates the image forming deviation amounts of the Bk image (horizontal scanning amount: dxk, skew: dSqk, horizontal scanning line length deviation amount dLxk) in almost the same manner as in the calculation of the image forming deviation amounts of the Y image, however, in this laser printer, color pattern accordance in the vertical scanning direction y is based on Bk, so that the position deviation amount dyk of Bk in the vertical scanning direction is not calculated (Ack).

In the deviation adjustment (DAD) shown in FIG. 29B, the MPU 41 adjusts the image forming deviation amounts of the respective colors as follows. The MPU 41 performs Y deviation amount adjustment (Ady) as follows.

For adjustment of the vertical scanning deviation amount dyy, the MPU 41 shifts the starting timing of image exposure for forming the Y toner image (forming a latent image by means of exposure by the exposure unit 5) by the calculated deviation amount dyy.

The MPU 41 sets the timing of transmitting image data on the line head (in the x direction) to a modulator of the exposure unit 2 in response to a line synchronization signal indicating the line head of image exposure for forming a Y toner image (latent image forming by means of exposure by the exposure unit 2) by shifting it by the calculated deviation amount dxy from a reference timing.

In the writing unit 2, the rear r side of a mirror extending in the x direction which faces the photoconductor drum 11*y* and reflects and projects a laser beam modulated based on the Y image data onto the photoconductor drum 11*y* is supported by a supporting point, and the front f side of this mirror is supported by a block being slidable in the y direction. The MPU 41 can adjust the skew dSqy by reciprocating the block of the writing unit 2 in the y direction by a y drive mechanism mainly including a pulse motor and a screw, and in the "skew dSqy adjustment," the MPU drives the pulse motor of the y drive mechanism to drive the block from the reference y position by a distance corresponding to the calculated skew dSqy.

In the adjustment of the horizontal scanning line length deviation amount dLxy, the MPU 41 sets the frequency of the pixel synchronization clock that allots the image data on a pixel basis to the horizontal scanning lines on the photoconductor drum to reference frequency×Ls/(Ls+dLxy). Ls denotes the reference line length. The MPU 41 adjusts other C and M image forming deviation amounts as in the same manner as the adjustment of the Y image forming deviation amounts (Adc, Adm). The MPU 41 also adjusts the Bk image forming deviation amounts in the same manner as in the adjustment of the Y image forming deviation amounts, however, in this laser printer, color pattern accordance in the vertical scanning direction y is based on Bk, so that regarding Bk, the position deviation amount dyk in the vertical scanning direction is not adjusted (Adk). Until the next "color pattern accordance," color image forming is performed in these adjusted conditions.

According to the present embodiment, in the laser printer, the Bk first orthogonal mark Akr and the Y second orthogonal mark Ayr are arranged in reverse and the Bk first diagonal mark Bkr and the Y second diagonal mark Byr are arranged in reverse on the r side, the Bk first orthogonal mark Akf and the Y second orthogonal mark Ayf are arranged in reverse and the Bk first diagonal mark Bkf and the Y second diagonal mark Byf are arranged in reverse on the f side.

As shown in FIGS. 2 and 3, the transfer conveying belt 60 is laid across the entrance roller 61, the exit roller 62, the drive roller 63, the roller 64 that pushes the transfer conveying belt 60, the tension roller 65, and the driven roller 66, and the drive roller 63 is connected to the drive gear of the motor 302 via the timing belt 303. To the driven roller 66, the encoder 301 is attached, and in the same manner as according to the present embodiment described above, the transfer drive motor controller performs feedback control of the motor 302 based on a pulse signal from the encoder 301 and controls the moving speed of the transfer conveying belt 60 to a set speed. In this case (when performing color shift correction), by the same method as according to the present embodiment described above, the transfer drive motor controller drives the transfer conveying belt 60 by means of control to stabilize speed fluctuation occurring due to thickness unevenness of the transfer conveying belt.

The transfer conveying belt 60 is driven to rotate according to the rotating drive of the drive roller 63 by the motor 302. The transfer members 67*k*, 67*y*, 67*c*, and 67*m* use transfer rollers to which transfer biases are applied from the power source. The photoconductor drums 11*k*, 11*y*, 11*c*, and 11*m* are connected to drum motors as drive motors via idler gears that are not shown, and are driven to rotate by the drum motors. Unillustrated encoders are attached to the photoconductor drums 11*k*, 11*y*, 11*c*, and 11*m* or the drum motors, and the drive motor controller feedback controls the drum motors based on pulse signals from the encoders, and controls the rotation velocities of the photoconductor drums 11*k*, 11*y*, 11*c*, and 11*m* to set velocities.

According to the present embodiment, as mark intervals in the mark set and mark set intervals, 1. intervals ma between the mark of the reference color Bk and marks of other colors Y, C, and M in the same mark set, 2. intervals mb between marks in the same color in the same mark set, and 3. mark set intervals L are set so that when calculating color shift amounts with respect to a synthesized wave including at least two or more of driving unevenness frequencies generated from the image carrier drive system that drives the photoconductor drums 11$k$, 11$y$, 11$c$, and 11$m$, the transfer drive system that drives the transfer conveying belt 60, and one round fluctuation unevenness of the transfer conveying belt and the photoconductor belt, calculation errors due to the synthesized wave fall within the correctable range of image deviation, and are set to, for example, equal to or less than 20 μm. Therefore, the color shift correction accuracies become equal to or less than 20 μm.

Here, 20 μm is the half of 1 dot with 40 μm in 60 dots per inch, and color shift amounts larger than 20 μm are corrected by the adjustment described above. Color shift amounts equal to or less than 20 μm cannot be corrected by the adjustment described above.

In this mark interval setting, as shown in FIG. 38, the waves of the driving unevenness frequencies of the photoconductor drums 11$k$, 11$y$, 11$c$, and 11$m$ (OPC drums) as an image carrier drive system, the idler gears, the drive roller 63 as the transfer drive system, the transfer drive motor (independent motor) 302, the driven roller 66, the exit roller 62, and the entrance roller 61 are assumed as sine waves $$A \sin(2\pi f+\theta)$$

where A is amplitude, f is frequency, and θ is phase, and these are all synthesized to compose a synthesized wave to become a base of simulation in the PC.

Regarding the transfer conveying belt 60, the drive motor controller cancels fluctuation components by means of control to stabilize speed fluctuation occurring due to thickness unevenness, of the transfer conveying belt 60. Therefore, there is no problem with calculation without including the speed fluctuation occurring due to the thickness unevenness of the transfer conveying belt 60 in the plurality of fluctuation components shown in FIG. 38.

According to the present invention, the mark intervals are determined by considering rotation fluctuations generated from the photoconductor drive system and rotation fluctuations generated from the transfer image forming drive system.

However, it is not necessary that a rotation period of the transfer conveying belt is assumed as driving unevenness with a longer period than the mark pattern entire length as in the case of Japanese Patent Application No. 2004-161416 and the number of mark set groups is set to two and the interval in the rotating direction of the transfer conveying belt 60 between the mark sets of the first group and the mark sets of the second group (8 mark sets on the r side and 8 mark sets on the f side) is set so that the phase shifts by 360 degrees/2=180 degrees from the 60 periods of the transfer conveying belt, and only one mark set is enough. However, there is no problem with a plurality of mark sets drawn to further improve the correction accuracies. Namely, this means that it is not necessary to consider the wave of the period of the transfer conveying belt 60 as a wave of one round frequency lower than the frequency required from the one-group mark set length.

In this example, only the first group mark set is formed on the transfer conveying belt. In detail, the circumferential length of the transfer conveying belt 60 is 815 mm, and the interval between the pattern groups (mark sets) is 285 mm that is approximately 35 percent of the circumferential length of the transfer conveying belt 60.

The average thickness t of the transfer conveying belt 60 is 0.1 mm, and the thickness deviations within one round of the transfer conveying belt 60 are equal to or less than 20 percent of the thickness t of the transfer conveying belt 60.

In this case, the waves of the driving unevenness frequencies of the photoconductor drums 11$k$, 11$y$, 11$c$, and 11$m$ (OPC drums), the drum motors, and the idler gears as an image carrier drive system are assumed as sine waves A1 through A3 and these are synthesized by the operation of $\alpha A1+\beta A2+\gamma A3$, and the waves of the driving unevenness frequencies of the drive roller 63, the transfer drive motor (independent motor) 302, the driven roller 66, the exit roller 62, and the entrance roller 61 are assumed as sine waves A4 through A8 and these are synthesized by the operation of $\eta(A4+A5+A6+A7+A8)$ to obtain a synthesized wave.

The frequencies and single-side amplitudes of the sine waves A1 through A8 are set as shown in FIG. 38A. The coefficients α, β, and γ are set for each color as shown in FIG. 38B, and η is set to, for example, 1 as shown in FIG. 38C.

In the PC, the test patterns on the transfer conveying belt 60 are applied to the synthesized wave, and as shown in FIG. 38D, by simulation, image forming deviation amounts of the colors Y, Bk (K), C, and M (deviation amounts and color shift correction accuracies of toner images in the colors Y, Bk, C, and M to be transferred onto the transfer conveying belt 60) are calculated while the intervals ma between orthogonal marks (horizontal marks) and between diagonal marks (oblique marks) as mark intervals in the respective mark sets are changed in the range between 2.5 mm and 5.5 mm in 0.5 mm increments, the intervals mb between an orthogonal mark (horizontal marks) and a diagonal marks (oblique marks) in the respective mark sets are changed in the range between 17.5 mm and 35 mm in 0.5 mm increments, and the mark set intervals L are changed in the range between 35 mm and 70 mm in 1.0 mm increments.

In this example, the process linear speed is 125 mm/s, ma=3.000 mm corresponds to 0.024 sec, and mb=32.300 mm corresponds to 0.2584 sec, and L=61.300 mm corresponds to 4904 sec. The phases θ of A1 through A8 are set to zero. By calculating deviation amounts in the synthesized wave of the orthogonal mark intervals ma and diagonal mark intervals ma in the same mark set (changes in the periods corresponding to orthogonal mark intervals ma and diagonal mark intervals ma in the synthesized wave), the first calculation results are obtained.

Figure 76:
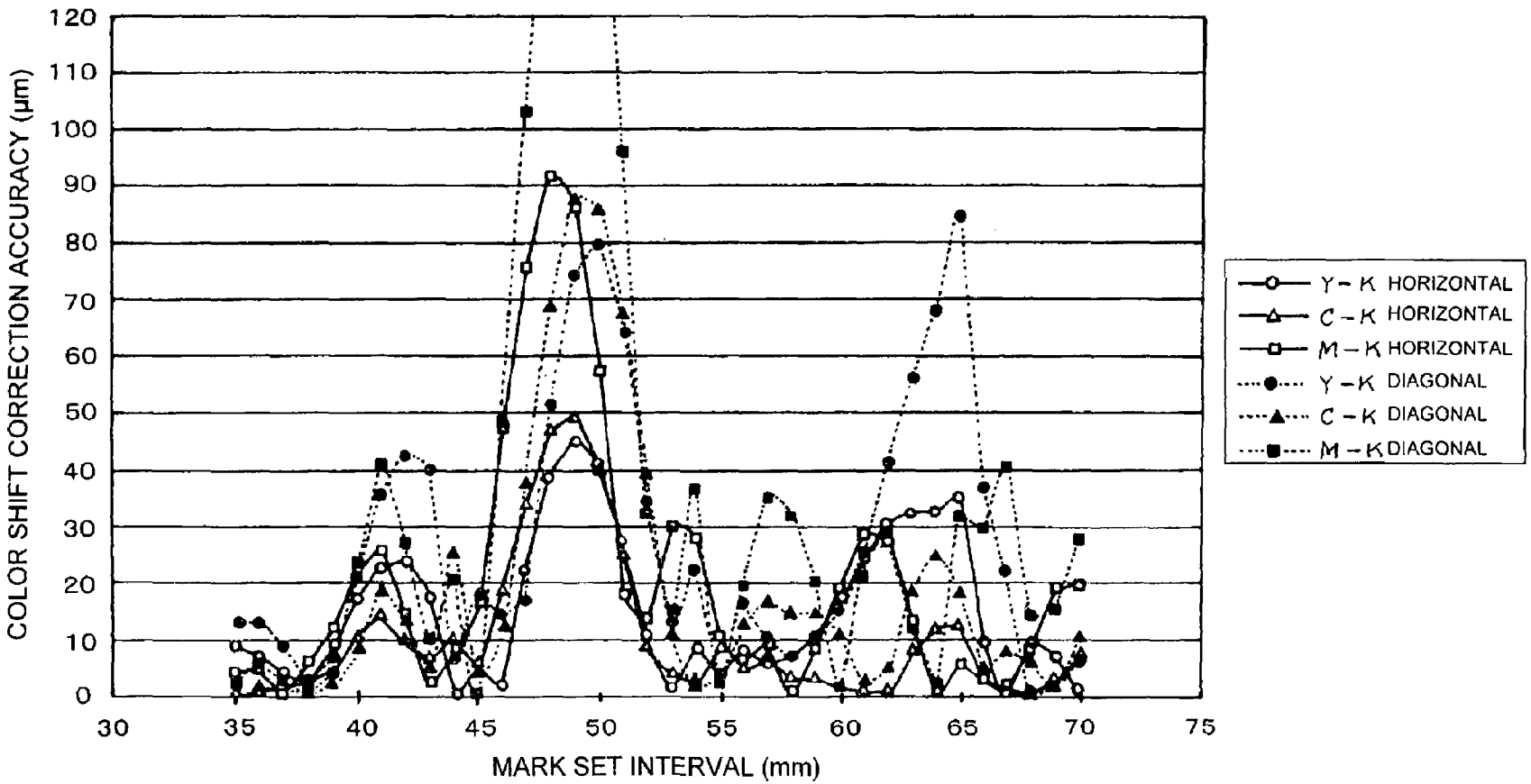
FIG. 76 is a diagram of first calculation results for determining mark arrangement of the present embodiment.
Figure 78:
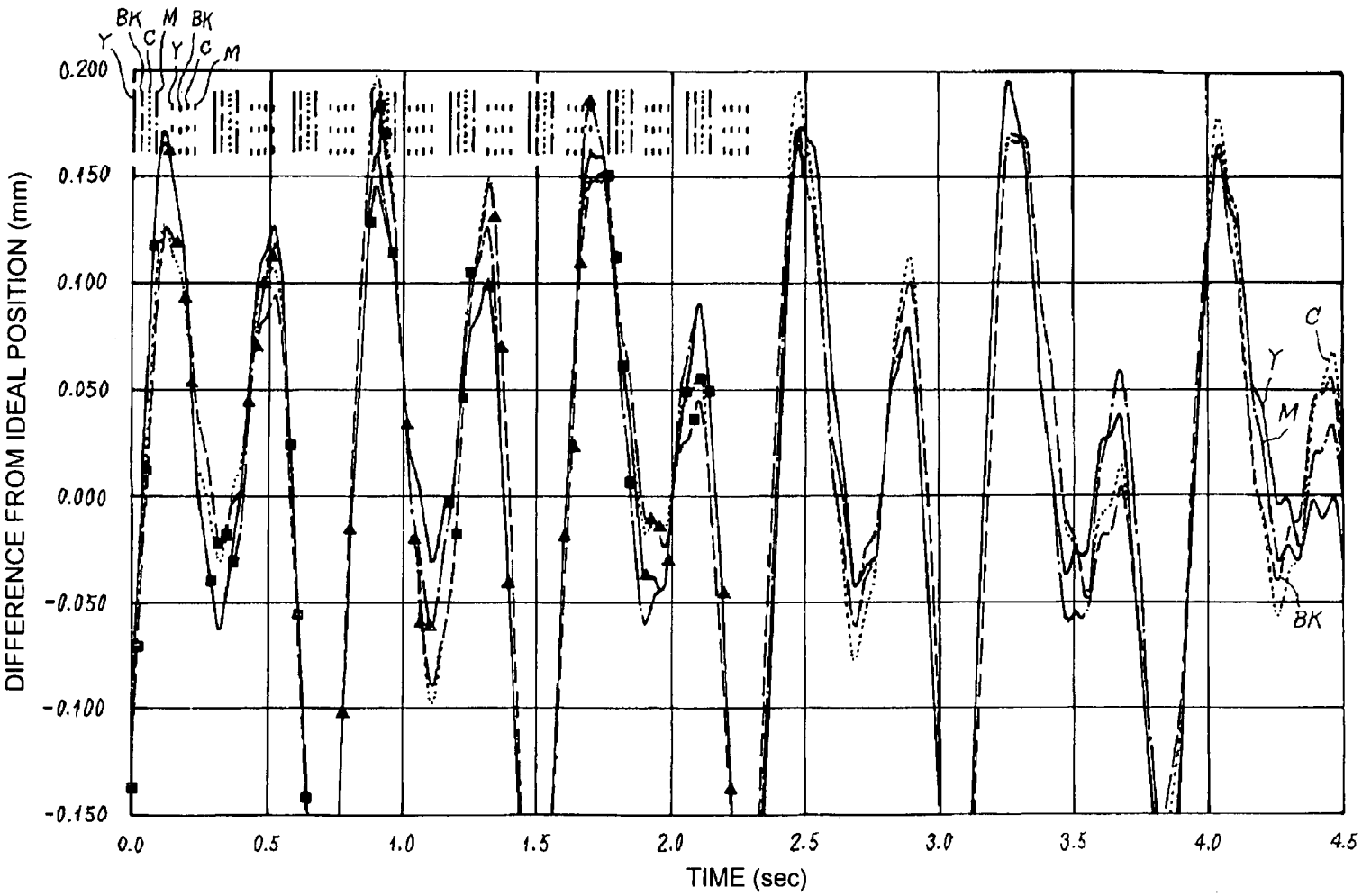
FIG. 78 is a diagram of deviation amounts of the marks in the respective colors formed from the third calculation results.

FIG. 76 depicts the results of calculation of image forming deviation amounts (color shift correction accuracies) while changing the mark set intervals in 1.0 mm increments in the range between 35 mm and 70 mm upon setting the interval of the orthogonal marks (horizontal marks) in the same mark set to 3.0 mm and the interval between the orthogonal mark (horizontal mark) and the diagonal mark (oblique mark) in the same mark set to 17.5 mm. In this calculation, the phases θ of the OPC drums, drum motors, the idler gears, the drive roller 63, the transfer drive motor (independent motor) 302, the driven roller 66, the exit roller 62, and the entrance roller 61 are zero.

In the first calculation results, combinations of ma, mb, and L whose color shift correction accuracies became equal to or less than 20 μm are extracted, and concerning these combinations, in the PC, test patterns on the transfer conveying belt 60 are applied to the synthesized wave and the color shift correction accuracies are calculated while changing the phases θ of A6 and A1 according to the driven roller 66 and the OPC drums in 30-degree increments from 0 degrees to 330 degrees by simulation, whereby the second calculation results are obtained. FIGS. 39 to 74 depict a part of the second calculation results at the phases (lower right 0 degree, lower right 30 degrees, lower right 60 degrees, and so on) of A6 according to the driven roller 66. In FIGS. 39 to 74, the vertical axis indicates the color shift correction accuracies (μm), and the horizontal axis indicates deviation amounts (mm) of the interval of orthogonal marks (horizontal marks) in the same mark set, the interval of diagonal marks (oblique marks) in the same mark set (Bk orthogonal mark and Y orthogonal mark (Y-K horizontal), the interval between a Bk orthogonal mark and a C orthogonal mark (C-K horizontal), the interval between a Bk orthogonal mark and an M orthogonal mark (M-K horizontal), the interval between a Bk diagonal mark and a Y diagonal mark (Y-K diagonal), the interval between a Bk diagonal mark and a C diagonal mark (C-K diagonal), and the interval between a Bk diagonal mark and an M diagonal mark (M-K diagonal)).

From the second calculation results, ma, mb, and L whose color shift correction accuracies become equal to or less than 20 μm in all phase combinations are extracted, and the test patterns on the transfer conveying belt 60 are applied to the synthesized wave, and color shift correction accuracies are calculated in the same manner while changing the phase of A8 from 0 degrees to 330 degrees in 90-degree increments by means of simulation in the PC, whereby third calculation results are obtained.

The reason for changes in phases of the A1, A6, and A8 of the driven roller 66, the entrance roller 61, and the OPC drums in the second and third calculations is that the amplitudes of A6 and A1 of the driven roller 66 and the OPC drums are large, and A8 of the entrance roller 61 is a frequency that influences the driven roller 66 and has a phase that does not coincide among the colors.

Figure 75:
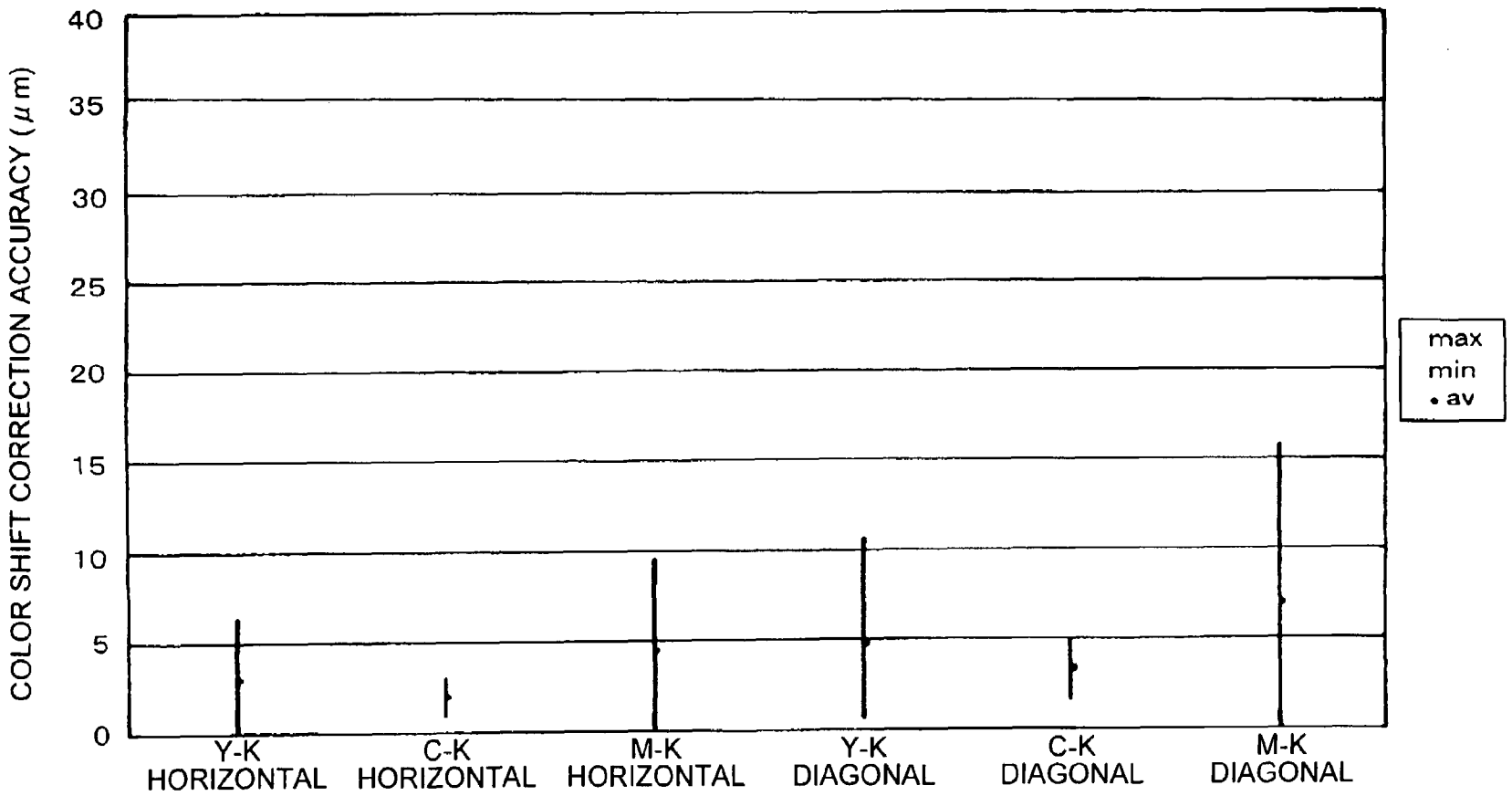
FIG. 75 is a diagram of an example of distribution, maximum value max, minimum value min, and average av of mark interval deviation amounts as third calculation results for determining mark arrangement of the present embodiment.

FIG. 77 depicts a part of the third calculation results, and FIG. 75 depicts distribution, a maximum value max, a minimum value min, and an average av of deviation amounts of the interval between the Bk orthogonal mark and the Y orthogonal mark (Y-K horizontal), the interval between the Bk orthogonal mark and the C orthogonal mark (C-K horizontal), the interval between the Bk orthogonal mark and the M orthogonal mark (M-K horizontal), the interval between the Bk diagonal mark and the Y diagonal mark (Y-K diagonal), the interval between the Bk diagonal mark and the C diagonal mark (C-K diagonal), and the interval between the Bk diagonal mark and the M diagonal mark (M-K diagonal). FIG. 75 depicts deviation amounts of the respective color marks from the reference position determined from the third calculation results. In FIG. 77, the OPC phase, the lower right roller phase, and the entrance phase are the phase A1, phase A6, and phase A8, respectively.

From the third calculation results, conditions that make all the intervals (maximum of the intervals) between the marks of the reference color Bk and the marks of other colors Y, C, M, that is, the interval between the Bk orthogonal mark and the Y orthogonal mark (Y-K horizontal), the interval between the Bk orthogonal mark and the C orthogonal mark (C-K horizontal), the interval between the Bk orthogonal mark and the M orthogonal mark (M-K horizontal), the interval between the Bk diagonal mark and the Y diagonal mark (Y-K diagonal), the interval between the Bk diagonal mark and the C diagonal mark (C-K diagonal), and the interval between the Bk diagonal mark and the M diagonal mark (M-K diagonal), not exceed 20 μm at all combinations of the phases of A1, A6, and A8 of the driven roller 66, the entrance roller 61, and the OPC drums, are calculated, and mark intervals ma and mb in mark sets and mark set intervals L:

1. mark intervals ma between the reference color Bk mark and other color Y, C, and M marks,
2. mark intervals mb of the same color, and
3. mark set intervals L are set so as to satisfy the calculated conditions.

Namely, the test pattern signal generator that supplies a test pattern signal to the writing unit 2 is constructed to generate a test pattern signal for forming, on the transfer conveying belt 60, test patterns having mark intervals ma and mb in mark sets and mark set intervals L:

1. mark intervals ma between the reference color Bk mark and other colors Y, C, and M marks,
2. mark intervals mb of the same color, and
3. mark set intervals L that makes all the intervals (maximum of the intervals) of the interval between the Bk orthogonal mark and the Y orthogonal mark (Y-K horizontal); the interval between the Bk orthogonal mark and the C orthogonal mark (C-K horizontal), the interval between the Bk orthogonal mark and the M orthogonal mark (M-K horizontal), the interval between the Bk diagonal mark and the Y diagonal mark (Y-K diagonal), the interval between the Bk diagonal mark and the C diagonal mark (C-K diagonal), and the interval between the Bk diagonal mark and the M diagonal mark (M-K diagonal), not exceed 20 μm at all combinations of the phases of A1, A6, and A8 of the driven roller 66, the entrance roller 61, and the OPC drums.

According to the present embodiment, it is assumed that the waves of the driving unevenness frequencies of the OPC drums, drum motors, and the idler gears as an image carrier drive system, the drive roller 63, the motor 302, the driven roller 66, the exit roller 62, and the entrance roller 61 as a transfer drive system are sine waves and these eight waves are all synthesized to compose a synthesized wave that becomes a base of simulation, however, the number of waves to compose the synthesized wave does not need to be limited to eight.

The elements (OPC drums, drum motors, the idler gears, the drive roller 63, the motor 302, the driven roller 66, the exit roller 62, and the entrance roller 61) of the eight waveforms described herein do not need to be limited, either.

In this example, as mark intervals in a mark set and mark intervals between mark sets, intervals between a reference color mark and other color marks, same color mark intervals, and mark set intervals are set so that when color shift amounts are calculated with respect to a synthesized wave composed of at least two or more waves of the driving unevenness frequencies generated from the image carrier drive system (OPC drums, drum motors, the idler gears) and the transfer drive system (the drive roller 63, the motor 302, the driven roller 66, the exit roller 62, the entrance roller 61), calculation errors due to the synthesized wave fall within a range in that deviations of images in a plurality of colors are correctable. Therefore, by considering various actual fluctuation causes and assuming test pattern arrangement in a state similar to the actual fluctuation on the transfer conveying belt, it becomes possible to improve the color shift detection reliability, minimize errors due to mark arrangement in the test pattern, and improve color shift correction accuracies.

The mark intervals are determined by considering rotation fluctuation generated from a photoconductor drive system and rotation fluctuation generated from the transfer image forming drive system, and upon performing control to stabilize speed fluctuation of driving unevenness of the transfer conveying belt as driving unevenness in a period longer than the mark pattern entire length, the mark sets are drawn. Thereby, it becomes possible to cancel the transfer conveying belt period fluctuation with low-frequency components that greatly influence color shifts when color shifts are corrected, and obtain color shift correction accuracies equivalent to conventional accuracies only by drawing only one group of mark sets. This shortens the correction time and reduces toner consumption.

Based on color pattern accordance instruction from the operation panel or the PC manual execution of color shift detection and correction is enabled, and by executing color shift detection and correction when a customer desires it, an image without color shifts can be obtained in a desired timing.

Furthermore, color shift detection and correction can be automatically executed in predetermined timing set in the image forming apparatus of this example, so that excellent images can always be obtained without troubling a customer.

Figure 81:
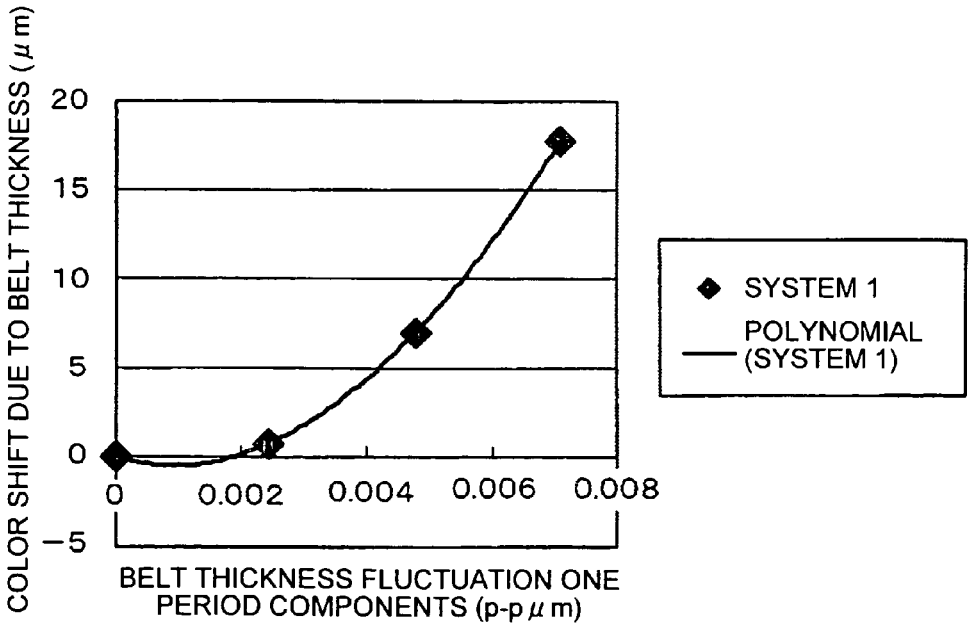
FIG. 81 is a diagram of the relationship between thickness deviation of the transfer conveying belt and color shift amounts influenced by the thickness deviation according to the present embodiment.

The thickness of the transfer conveying belt 60 is conventionally set so that the average thickness t of the transfer conveying belt 60 is 0.1 mm and thickness deviation within one round of the transfer conveying belt 60 is equal to or less than 10 percent (equal to or less than 0.01 mm) of the thickness t of transfer conveying belt 60. According to the inventor's examination, when no control technique to stabilize the speed fluctuation due to the thickness unevenness of the transfer conveying belt is installed, the thickness deviation and color shift amounts are closely correlated with each other in a 4-drum tandem full-color copying machine (see FIG. 81), and when the thickness deviation becomes equal to or more than 10 percent, the level of the color shift amounts becomes impermissible. FIG. 81 depicts the relationship between the thickness deviation of the transfer conveying belt 60 and color shift amounts influenced by the thickness deviation. From this FIG. 81, it is understood that when the thickness deviation of the transfer conveying belt 60 is great, the color shift amounts increase, and when thickness deviation of the transfer conveying belt 60 is small, color shift amounts become small.

However, to reduce thickness deviation of the transfer conveying belt 60, a cost increase is inevitable (due to yield lowering and a mold cost increase due to a mold accuracy increase). The transfer conveying belt 60 is at a higher rank in terms of parts costs in the image forming apparatus. In addition, the transfer conveying belt 60 is a part to be replaced at a comparatively high frequency in the market. From these facts, it is demanded that a cost increase of the transfer conveying belt 60 is avoided.

Figure 82:
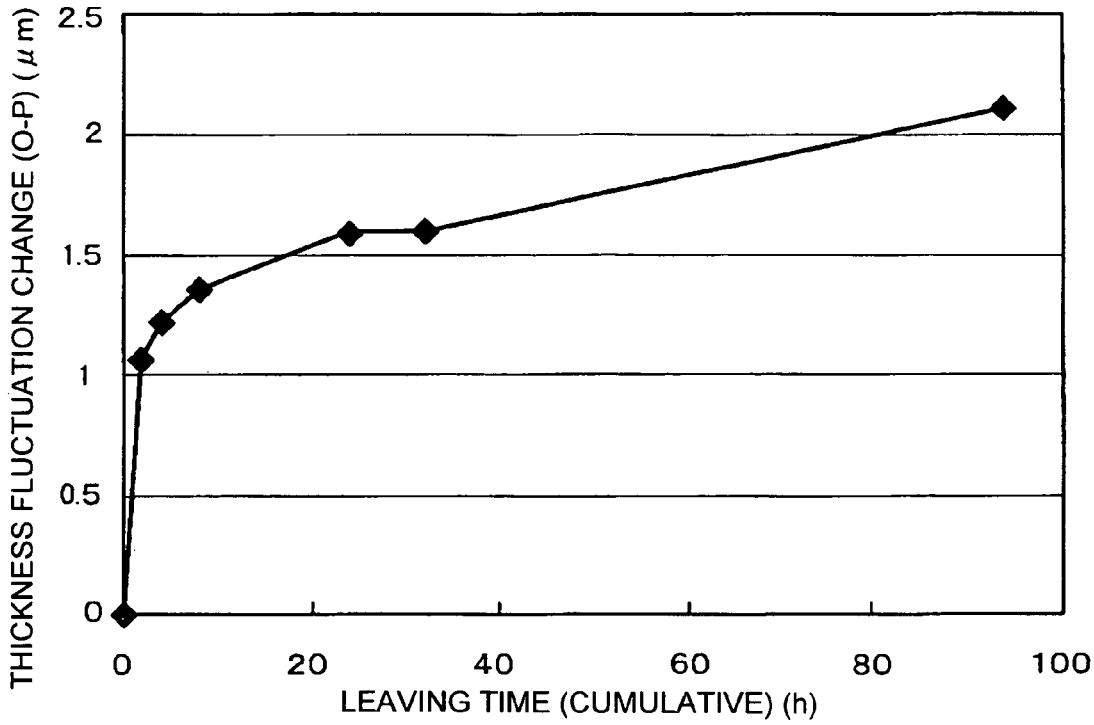
FIG. 82 is a diagram of the relationship between a leaving time of the transfer conveying belt and thickness deviation fluctuation amounts according to the present embodiment.

According to the present invention, it does not matter what percentage the thickness deviation of the transfer conveying belt 60 is, theoretically. However, the thickness deviation is approximated by a sine wave, so that it becomes slightly different from the actual deviation and approximation errors occur. Therefore, in this example, the thickness deviation of the transfer convening belt 60 is set equal to or less than 20 percent of the average thickness of the transfer conveying belt 60, and a control technique to stabilize the speed fluctuation due to thickness unevenness of the transfer conveying belt is installed to prevent a cost increase and improve image quality, simultaneously. However, the thickness deviation, maximum amplitude and phase of the angular displacement error of the transfer conveying belt are accompanied by aging deterioration, so that it is necessary that the phase and the maximum amplitude are updated in proper timings by taking the aging deterioration into account. FIG. 82 depicts the relationship between the leaving time and the thickness deviation fluctuation of the transfer conveying belt. According to the present embodiment of the present invention, when the machine suspension period exceeds 20 hours, the phase and the maximum amplitude are automatically calculated. However, the machine suspension period is not limited to 20 hours, and can be set according to the characteristics of the image forming apparatus.

According to the present embodiment, the present invention is applied to a transfer unit 6 in a tandem-type printer including then plurality of photoconductor drums 11Y, 11M, 11C, and 11K arranged on the transfer conveying belt 60, however, the printer and belt-drive control device to which the present invention is applicable is not limited to these. The present invention is also applicable to a printer having a belt-drive control device that drives and rotates an endless belt laid across a plurality of rollers by at least one or more rollers of said rollers, and the belt-drive control device of this printer.

Although in the example, the present invention is applied to a direct transfer method in which the transfer conveying belt 60 conveys a transfer sheet and toner images in four colors on the photoconductor drums 11Y, 11M, 11C, and 11K are superposed and transferred onto the transfer sheet, the present invention is also applicable to an intermediate transfer method in which toner images in four colors on the photoconductor drums 11Y, 11M, 11C, and 11K are superposed and transferred onto the transfer conveying belt 60 to form a full-color image, and this full-color image is transferred onto a transfer sheet. Although a laser light source is used as an exposure light source in the example, the exposure light source is not limited to this, and can be, for example, an LED array.

According to the present invention, when controlling the speed of the endless belt by using the encoder attached to the driven roller that follows the endless belt, control to stabilize the speed fluctuation caused by the belt thickness is performed by an inexpensive method, and color shift detection and correction are performed in this control state. Therefore, the color shift correction accuracies can be improved more than conventionally, whereby a higher-quality image can be obtained.

Furthermore, according to the present invention, control to stabilize speed fluctuation caused by the belt thickness can be performed by an inexpensive method, color shift correction accuracies can be improved, and image quality that a customer desires can be provided in a desired timing.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A belt-drive control device comprising:

an endless belt;

a belt driving unit that rotates the endless belt;

at least one driven roller that is in contact with the endless belt;

an encoder that is attached to the driven roller;

a mark detecting unit that detects a mark that is a reference position of the endless belt;

an angular-displacement-error detecting unit that detects an angular displacement error of the encoder caused by thickness fluctuation of the endless belt, based on an output signal from the mark detecting unit;

a first calculating unit that calculates a phase and a maximum amplitude to the mark, based on the detected angular displacement error of the encoder;

a nonvolatile memory that stores a result of calculation by the first calculating unit;

a second calculating unit that calculates correction data according to a distance from the mark on the endless belt based on the result of calculation stored in the nonvolatile memory; and a volatile memory that stores the calculated correction data, wherein the belt-drive control device controls the belt driving unit by adding the correction data stored in the volatile memory to a preset control target value to stabilize speed fluctuation of the endless belt due to the thickness fluctuation.

2. The belt-drive control device according to claim 1, wherein a timing for developing a value stored in the nonvolatile memory to the volatile memory is set to either of a power turning-on time and a drive starting timing for the endless belt.

3. The belt-drive control device according to claim 1, wherein the second calculating unit calculates the correction data by using either one of a sine function and an approximation from the phase and the amplitude stored in the nonvolatile memory.

4. The belt-drive control device according to claim 1, wherein when calculating the correction data and storing the calculated correction data in the volatile memory, the correction data is reduced to save a capacity of the volatile memory.

5. The belt-drive control device according to claim 1, wherein when starting a control of the belt driving unit, the correction data is set to zero to correct transitional fluctuation of the preset control target value.

6. The belt-drive control device according to claim 1, wherein a value to be stored in the nonvolatile memory is input from an operation panel.

7. A color-shift detecting method for a color image forming apparatus that uses a belt drive system for controlling at least one of an image carrier and a transfer medium, rotates the image carrier by an image carrier drive system, rotates the transfer medium by a transfer drive system, forms images in a plurality of colors on the image carrier, and transfers the images onto the transfer medium in a superimposing manner to form a color image, the belt drive system including an endless belt, a belt driving unit that rotates the endless belt, at least one driven roller that is in contact with the endless belt, an encoder that is attached to the driven roller, a mark detecting unit that detects a mark that is a reference position of the endless belt, an angular-displacement-error detecting unit that detects an angular displacement error of the encoder caused by thickness fluctuation of the endless belt, based on an output signal from the mark detecting unit, a first calculating unit that calculates a phase and a maximum amplitude to the mark, based on the detected angular displacement error of the encoder, a nonvolatile memory that stores a result of calculation by the first calculating unit, a second calculating unit that calculates correction data according to a distance from the mark on the endless belt based on the result of calculation stored in the nonvolatile memory, and a volatile memory that stores the calculated correction data, the belt drive system controlling the belt driving unit by adding the correction data stored in the volatile memory to a preset control target value to stabilize speed fluctuation of the endless belt due to the thickness fluctuation, the color-shift detecting method comprising:

forming a plurality of mark sets including an array of marks in respective colors arranged in a moving direction of the transfer medium on the transfer medium;

detecting each of the marks of the mark sets to detect an amount of deviation of the images; and setting mark intervals between a reference color and other colors, mark intervals in a same color, and an interval of the mark sets in such a manner that, when calculating an amount of the color shift with respect to a synthesized wave including two or more of driving unevenness frequencies generated from the image carrier drive system and the belt drive system, a calculation error due to the synthesized wave is within a range in which the deviation of the images is correctable.

8. The color-shift detecting method according to claim 7, wherein a timing for developing a value stored in the nonvolatile memory to the volatile memory is set to either of a power turning-on time and a drive starting timing for the endless belt.

9. The color-shift detecting method according to claim 7, further comprising:

converting the output signal of the mark detecting unit into digital data at predetermined pitches;

specifying a scanning position to store in a memory; and creating mark distribution data based on a scanning position of a data group in which scanning positions are adjacent to each other so that the data group belongs to a specific detection signal changing area.

10. The color-shift detecting method according to claim 7, wherein a value to be stored in the nonvolatile memory is input from an operation panel.

11. A color-shift detecting method for a color image forming apparatus that uses a belt drive system for controlling at least one of an image carrier and a transfer medium, rotates the image carrier by an image carrier drive system, rotates the transfer medium by a transfer drive system, forms images in a plurality of colors on the image carrier, and transfers the images onto the transfer medium in a superimposing manner to form a color image, the belt drive system including an endless belt, a belt driving unit that rotates the endless belt, at least one driven roller that is in contact with the endless belt, an encoder that is attached to the driven roller, a mark detecting unit that detects a mark that is a reference position of the endless belt, an angular-displacement-error detecting unit that detects an angular displacement error of the encoder caused by thickness fluctuation of the endless belt, based on an output signal from the mark detecting unit, a first calculating unit that calculates a phase and a maximum amplitude to the mark, based on the detected angular displacement error of the encoder, a nonvolatile memory that stores a result of calculation by the first calculating unit, a second calculating unit that calculates correction data according to a distance from the mark on the endless belt based on the result of calculation stored in the nonvolatile memory, and a volatile memory that stores the calculated correction data, the belt drive system controlling the belt driving unit by adding the correction data stored in the volatile memory to a preset control target value to stabilize speed fluctuation of the endless belt due to the thickness fluctuation, the color-shift detecting method comprising:

forming a plurality of mark sets including an array of marks in respective colors arranged in a moving direction of the transfer medium on the transfer medium;

detecting each of the marks of the mark sets to detect an amount of deviation of the images; and setting mark intervals between a reference color and other colors, mark intervals in a same color, and an interval of the mark sets in such a manner that, when calculating an amount of the color shift with respect to a synthesized wave including two or mouse of driving unevenness frequencies generated from the image carrier drive system and the belt drive system, a calculation error due to the synthesized wave is equal to or less than 20 micrometers.

12. The color-shift detecting method according to claim 11, wherein a timing for developing a value stored in the nonvolatile memory to the volatile memory is set to either of a power turning-on time and a drive starting timing for the endless belt.

13. The color-shift detecting method according to claim 11, further comprising:

converting the output signal of the mark detecting unit into digital data at predetermined pitches;

specifying a scanning position to store in a memory; and creating mark distribution data based on a scanning position of a data group in which scanning positions are adjacent to each other so that the data group belongs to a specific detection signal changing area.

14. The color-shift detecting method according to claim 11, wherein a value to be stored in the nonvolatile memory is input from an operation panel.

15. A color-shift detecting device for a color image forming apparatus that uses a belt drive system for controlling at least one of an image carrier and a transfer medium, rotates the image carrier by an image carrier drive system, rotates the transfer medium by a transfer drive system, forms images in a plurality of colors on the image carrier, and transfers the images onto the transfer medium in a superimposing manner to form a color image, the belt drive system including an endless belt, a belt driving unit that rotates the endless belt, at least one driven roller that is in contact with the endless belt, an encoder that is attached to the driven roller, a mark detecting unit that detects a mark that is a reference position of the endless belt, an angular-displacement-error detecting unit that detects an angular displacement error of the encoder caused by thickness fluctuation of the endless belt, based on an output signal from the mark detecting unit, a first calculating unit that calculates a phase and a maximum amplitude to the mark, based on the detected angular displacement error of the encoder, a nonvolatile memory that stores a result of calculation by the first calculating unit, a second calculating unit that calculates correction data according to a distance from the mark on the endless belt based on the result of calculation stored in the nonvolatile memory, and a volatile memory that stores the calculated correction data, the belt drive system controlling the belt driving unit by adding the correction data stored in the volatile memory to a preset control target value to stabilize speed fluctuation of the endless belt due to the thickness fluctuation, the color-shift detecting device comprising:

a test-pattern forming unit that forms a plurality of mark sets including an array of marks in respective colors arranged in a moving direction of the transfer medium on the transfer medium;

a sensor that detects each of the marks of the mark sets;

an image-deviation-amount detecting unit that detects an amount of deviation of the images; and a setting unit that sets mark intervals between a reference color and other colors, mark intervals in a same color, and an interval of the mark sets in such a manner that, when calculating an amount of the color shift with respect to a synthesized wave including two or more of driving unevenness frequencies generated from the image carrier drive system and the belt drive system, a calculation error due to the synthesized wave is within a range in which the deviation of the images is correctable.

16. The color-shift detecting device according to claim 15, wherein a timing for developing a value stored in the nonvolatile memory to the volatile memory is set to either of a power turning-on time and a drive starting timing for the endless belt.

17. The color-shift detecting device according to claim 15, wherein the image-deviation-amount detecting unit converts the output signal of the mark detecting unit into digital data at predetermined pitches, specifies a scanning position to store in a memory, and creates mark distribution data based on a scanning position of a data group in which scanning positions are adjacent to each other so that the data group belongs to a specific detection signal changing area.

18. A color-shift detecting device for a color image forming apparatus that uses a belt drive system for controlling at least one of an image carrier and a transfer medium, rotates the image carrier by an image carrier drive system, rotates the transfer medium by a transfer drive system, forms images in a plurality of colors on the image carrier, and transfers the images onto the transfer medium in a superimposing manner to form a color image, the belt drive system including an endless belt, a belt driving unit that rotates the endless belt, at least one driven roller that is in contact with the endless belt, an encoder that is attached to the driven roller, a mark detecting unit that detects a mark that is a reference position of the endless belt, an angular-displacement-error detecting unit that detects an angular displacement error of the encoder caused by thickness fluctuation of the endless belt, based on an output signal from the mark detecting unit, a first calculating unit that calculates a phase and a maximum amplitude to the mark, based on the detected angular displacement error of the encoder, a nonvolatile memory that stores a result of calculation by the first calculating unit, a second calculating unit that calculates correction data according to a distance from the mark on the endless belt based on the result of calculation stored in the nonvolatile memory, and a volatile memory that stores the calculated correction data, the belt drive system controlling the belt driving unit by adding the correction data stored in the volatile memory to a preset control target value to stabilize speed fluctuation of the endless belt due to the thickness fluctuation, the color-shift detecting device comprising:

a test-pattern forming unit that forms a plurality of mark sets including an array of marks in respective colors arranged in a moving direction of the transfer medium on the transfer medium;

a sensor that detects each of the marks of the mark sets;

an image-deviation-amount detecting unit that detects an amount of deviation of the images; and a setting unit that sets mark intervals between a reference color and other colors, mark intervals in a same color, and an interval of the mark sets in such a manner that, when calculating an amount of the color shift with respect to a synthesized wave including two or more of driving unevenness frequencies generated from the image carrier drive system and the belt drive system, a calculation error due to the synthesized wave is equal to or less than 20 micrometers.

19. The color-shift detecting device according to claim 18, wherein a timing for developing a value stored in the nonvolatile memory to the volatile memory is set to either of a power turning-on time and a drive starting timing for the endless belt.

20. The color-shift detecting device according to claim 18, wherein the image-deviation-amount detecting unit converts the output signal of the mark detecting unit into digital data at predetermined pitches, specifies a scanning position to store in a memory, and creates mark distribution data based on a scanning position of a data group in which scanning positions are adjacent to each other so that the data group belongs to a specific detection signal changing area.

21. An image forming apparatus that uses a belt drive system for controlling at least one of an image carrier and a transfer medium, and detects a color shift by a color-shift detecting method, wherein the belt drive system includes an endless belt; a belt driving unit that rotates the endless belt;

at least one driven roller that is in contact with the endless belt;

an encoder that is attached to the driven roller;

a mark detecting unit that detects a mark that is a reference position of the endless belt;

an angular-displacement-error detecting unit that detects an angular displacement error of the encoder caused by thickness fluctuation of the endless belt, based on an output signal from the mark detecting unit;

a first calculating unit that calculates a phase and a maximum amplitude to the mark, based on the detected angular displacement error of the encoder;

a nonvolatile memory that stores a result of calculation by the first calculating unit;

a second calculating unit that calculates correction data according to a distance from the mark on the endless belt based on the result of calculation stored in the nonvolatile memory; and a volatile memory that stores the calculated correction data, the belt drive system controls the belt driving unit by adding the correction data stored in the volatile memory to a preset control target value to stabilize speed fluctuation of the endless belt due to the thickness fluctuation, and the color-shift detecting method includes forming a plurality of mark sets including an array of marks in respective colors arranged in a moving direction of the transfer medium on the transfer medium;

detecting each of the marks of the mark sets to detect an amount of deviation of the images; and setting mark intervals between a reference color and other colors, mark intervals in a same color, and an interval of the mark sets in such a manner that, when calculating an amount of the color shift with respect to a synthesized wave including two or more of driving unevenness frequencies generated from an image carrier drive system and the belt drive system, a calculation error due to the synthesized wave is within a range in which the deviation of the images is correctable.

22. The image forming apparatus according to claim 21, wherein the image forming apparatus is a four drum tandem type.

23. The image forming apparatus according to claim 21, wherein the endless belt is either one of an intermediate transfer belt and a direct transfer belt.

24. The image forming apparatus according to claim 21, wherein an execution of the calculation of the phase and the maximum amplitude is commanded by either one of an operation panel of the image forming apparatus and a personal computer that is connected to the image forming apparatus.

25. The image forming apparatus according to claim 21, wherein an execution of detection and correction of the color shift includes a manual execution commanded from either one of an operation panel of the image forming apparatus and a personal computer that is connected to the image forming apparatus; and an automatic execution based on a predetermined specification of the image forming apparatus.

26. The image forming apparatus according to claim 25, wherein a timing of the automatic execution is when a fixing temperature in the image forming apparatus is less than a predetermined temperature or power turning-on time.

27. The image forming apparatus according to claim 25, wherein a timing of the automatic execution is when a latent image forming unit or a developing unit of the image forming apparatus is replaced.

28. The image forming apparatus according to claim 25, wherein a timing of the automatic execution is when a number of formed images reaches a predetermined number.

29. The image forming apparatus according to claim 25, wherein a timing of the automatic execution is when an internal temperature of the image forming apparatus reaches a predetermined temperature.

30. The image forming apparatus according to claim 25, wherein a timing of the automatic execution is after the execution of the calculation of the phase and the maximum amplitude to be stored in the nonvolatile memory.

31. The image forming apparatus according to claim 24, wherein a timing of the calculation of the phase and the maximum amplitude is when the image forming apparatus is suspended for a predetermined time.

32. An image forming apparatus that uses a belt drive system for controlling at least one of an image carrier and a transfer medium, and detects a color shift by a color-shift detecting method, wherein the belt drive system includes an endless belt; a belt driving unit that rotates the endless belt;

at least one driven roller that is in contact with the endless belt;

an encoder that is attached to the driven roller;

a mark detecting unit that detects a mark that is a reference position of the endless belt;

an angular-displacement-error detecting unit that detects an angular displacement error of the encoder caused by thickness fluctuation of the endless belt, based on an output signal from the mark detecting unit;

a first calculating unit that calculates a phase and a maximum amplitude to the mark, based on the detected angular displacement error of the encoder;

a nonvolatile memory that stores a result of calculation by the first calculating unit;

a second calculating unit that calculates correction data according to a distance from the mark on the endless belt based on the result of calculation stored in the nonvolatile memory; and a volatile memory that stores the calculated correction data, the belt drive system controls the belt driving unit by adding the correction data stored in the volatile memory to a preset control target value to stabilize speed fluctuation of the endless belt due to the thickness fluctuation, and the color-shift detecting method includes forming a plurality of mark sets including an array of marks in respective colors arranged in a moving direction of the transfer medium on the transfer medium;

detecting each of the marks of the mark sets to detect an amount of deviation of the images; and setting mark intervals between a reference color and other colors, mark intervals in a same color, and an interval of the mark sets in such a manner that, when calculating an amount of the color shift with respect to a synthesized wave including two or more of driving unevenness frequencies generated from an image carrier drive system and the belt drive system, a calculation error due to the synthesized wave is equal to or less than 20 micrometers.

33. The image forming apparatus according to claim 32, wherein the image forming apparatus is a four drum tandem type.

34. The image forming apparatus according to claim 32, wherein the endless belt is either one of an intermediate transfer belt and a direct transfer belt.

35. The image forming apparatus according to claim 32, wherein an execution of the calculation of the phase and the maximum amplitude is commanded by either one of an operation panel of the image forming apparatus and a personal computer that is connected to the image forming apparatus.

36. The image forming apparatus according to claim 32, wherein an execution of detection and correction of the color shift includes a manual execution commanded from either one of an operation panel of the image forming apparatus and a personal computer that is connected to the image forming apparatus; and an automatic execution based on a predetermined specification of the image forming apparatus.

37. The image forming apparatus according to claim 36, wherein a timing of the automatic execution is when a fixing temperature in the image forming apparatus is less than a predetermined temperature or power turning-on time.

38. The image forming apparatus according to claim 36, wherein a timing of the automatic execution is when a latent image forming unit or a developing unit of the image forming apparatus is replaced.

39. The image forming apparatus according to claim 36, wherein a timing of the automatic execution is when a number of formed images reaches a predetermined number.

40. The image forming apparatus according to claim 36, wherein a timing of the automatic execution is when an internal temperature of the image forming apparatus reaches a predetermined temperature.

41. The image forming apparatus according to claim 36, wherein a timing of the automatic execution is after the execution of the calculation of the phase and the maximum amplitude to be stored in the nonvolatile memory.

42. The image forming apparatus according to claim 35, wherein a timing of the calculation of the phase and the maximum amplitude is when the image forming apparatus is suspended for a predetermined time.

* * * * *